US007157220B2

(12) United States Patent
Yamamoto et al.

(10) Patent No.: US 7,157,220 B2
(45) Date of Patent: Jan. 2, 2007

(54) SILVER HALIDE PHOTOSENSITIVE MATERIAL AND PHOTOTHERMOGRAPHIC MATERIAL

(75) Inventors: Seiichi Yamamoto, Kanagawa (JP); Masahiko Taniguchi, Kanagawa (JP); Yasuhiro Yoshioka, Kanagawa (JP); Takanori Hioki, Kanagawa (JP); Hideo Hanawa, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 11/072,513

(22) Filed: Mar. 7, 2005

(65) Prior Publication Data

US 2005/0214700 A1 Sep. 29, 2005

(30) Foreign Application Priority Data

| | | | |
|---|---|---|---|
| Mar. 23, 2004 | (JP) | ..... | 2004-085655 |
| Aug. 24, 2004 | (JP) | ..... | 2004-244080 |
| Oct. 29, 2004 | (JP) | ..... | 2004-315901 |
| Feb. 1, 2005 | (JP) | ..... | 2005-025698 |

(51) Int. Cl.

| | |
|---|---|
| ***G03C 1/00*** | (2006.01) |
| ***G03C 1/76*** | (2006.01) |
| ***G03C 1/85*** | (2006.01) |
| ***G03C 1/08*** | (2006.01) |
| ***G03C 7/26*** | (2006.01) |

(52) U.S. Cl. ..... 430/618; 430/617; 430/619; 430/620; 430/523; 430/527; 430/559

(58) Field of Classification Search ..... 430/617, 430/618, 619, 620, 523, 559, 527
See application file for complete search history.

(56) References Cited

U.S. PATENT DOCUMENTS

| | | | | |
|---|---|---|---|---|
| 5,468,599 | A * | 11/1995 | Biavasco et al. | 430/512 |
| 6,727,057 | B1 * | 4/2004 | Suzuki et al. | 430/619 |
| 2003/0198907 | A1 | 10/2003 | Suzuki et al. | |
| 2004/0126717 | A1 * | 7/2004 | Nakagawa et al. | 430/619 |
| 2004/0234909 | A1 * | 11/2004 | Inoue et al. | 430/617 |

FOREIGN PATENT DOCUMENTS

| | | | |
|---|---|---|---|
| EP | 0 969 313 | A | 1/2000 |
| GB | 1 226 562 | A | 3/1971 |

* cited by examiner

*Primary Examiner*—Geraldine Letscher
(74) *Attorney, Agent, or Firm*—Margaret A. Burke; Sheldon J. Moss

(57) ABSTRACT

The present invention provides a silver halide photosensitive material and a photothermographic material having, on at least one side of a support, at least a photosensitive silver halide, a non-photosensitive organic silver salt, and a reducing agent for the organic silver salt, wherein the silver halide photosensitive material and the photothermographic material contain a phthalocyanine compound represented by the following formula (PC-1):

Formula (PC-1)

wherein, M represents a hydrogen atom or a metal atom; $R^1$, $R^4$, $R^5$, $R^8$, $R^9$, $R^{12}$, $R^{13}$, and $R^{16}$ each independently represent a hydrogen atom or a substituent; at least one of $R^1$, $R^4$, $R^5$, $R^8$, $R^9$, $R^{12}$, $R^{13}$, and $R^{16}$ represents an electron-attracting group; and $R^2$, $R^3$, $R^6$, $R^7$, $R^{10}$, $R^{11}$, $R^{14}$, and $R^{15}$ each independently represent a hydrogen atom or a substituent.

18 Claims, No Drawings

SILVER HALIDE PHOTOSENSITIVE MATERIAL AND PHOTOTHERMOGRAPHIC MATERIAL

CROSS-REFERENCE TO RELATED APPLICATION

This application claims priority under 35 USC 119 from Japanese Patent Application Nos. 2004-085655, 2004-244080, 2004-315901, and 2005-025698, the disclosures of which are incorporated by reference herein.

BACKGROUND OF THE INVENTION

1. Field of the Invention

The present invention relates to a silver halide photosensitive material and a photothermographic material. More specifically, the invention relates to a silver halide photosensitive material and a photothermographic material which exhibit excellent image quality with a good degree of sharpness and little residual color.

2. Description of the Related Art

In recent years, decrease in the amount of processing liquid waste in the field of films for medical imaging has been keenly desired from the viewpoints of environmental protection and economy of space. For this reason, techniques regarding photothermographic materials for medical diagnosis and graphic arts, which can be exposed efficiently by laser image setters or laser imagers and can form clear black-toned images of high resolution and sharpness, are required. Thermal development systems which do not require liquid processing chemicals are simpler and do not damage the environment can therefore be supplied to customers.

While similar requirements also exist in the field of general image forming materials, images for medical imaging require a particularly high image quality excellent in sharpness and granularity since fine representation is required, and are characterized in that images of blue-black tones are preferred from the viewpoint of easy diagnosis. At present, various kinds of hard copy systems utilizing dyes or pigments such as ink jet printers and electrophotographic systems have been marketed as general image forming systems, but they are not satisfactory as output systems for medical images.

Thermal image forming systems utilizing organic silver salts are known. Particularly, a photothermographic material generally comprises an image forming layer in which a catalytically active amount of photocatalyst (for example, a silver halide), a reducing agent, a reducible silver salt (for example, an organic silver salt), and if necessary, a toner for controlling the color tone of silver, are dispersed in a binder. A photothermographic material forms a black silver image by being heated to a high temperature (for example, 80° C. or higher) after imagewise exposure to cause an oxidation-reduction reaction between a silver halide or a reducible silver salt (functioning as an oxidizing agent) and a reducing agent. The oxidation-reduction reaction is accelerated by the catalytic action of a latent image on the silver halide generated by exposure. As a result, a black silver image is formed in the exposed region. This system has been described in many documents, and the Fuji Medical Dry Imager FM-DP L is an example of a practical medical image forming system using a photothermographic material that has been marketed.

A thermal developing process for photothermographic materials does not require the processing solutions used in conventional wet processing, and has an advantage in that processing can be carried out easily and rapidly. However, there are problems to be solved in thermal developing process, which do not occur in conventional wet processing. One of them involves decolorizing dyes. Photosensitive materials commonly incorporate dyes in order to provide light filter and prevent halation or irradiation therein. The added dyes function during imagewise exposure. If the dyes remain in a photosensitive material after their use during exposure and development, the formed images may be colored thereby. Therefore the residual dyes must be removed from the photosensitive materials during the developing process. In a wet developing process, the residual dyes can be removed easily from the photosensitive materials by the processing solution. On the other hand, in the case of the thermal developing process, it is a difficult task to remove the residual dyes from the photosensitive materials.

More specifically, in order to attain images with a good degree of sharpness, the incorporation of dyes is very important for photosensitive materials exposed by a laser beam to provide sufficient antihalation and anti-irradiation effects over the wavelength region for the exposure. As for the wavelength of a laser beam used for the exposure, a wide range of wavelength regions such as the near infrared region, the infrared region, or the visible region from red to blue can be applied.

For photosensitive materials exposed imagewise by a near infrared laser beam or an infrared laser beam, dyes which have an absorption maximum within the near infrared or infrared region which are non-visible, a narrow half band width and little light absorption within the visible region are effectively applied. Japanese Patent Application Laid-Open (JP-A) Nos. 9-146220, and 11-228698 disclose photosensitive materials comprising such dyes described above, which require substantially no color bleaching mechanism.

However, in the case of a photosensitive material exposed by a laser beam of the visible region from blue to red, the inclusion of some color bleaching reaction mechanism therein is required.

Several methods to decolorize residual dyes upon heating during thermal a developing process have been proposed. For example, U.S. Pat. No. 5,135,842 discloses a decoloring method by heating for polymethine dyes having a specific structure. Moreover, U.S. Pat. Nos. 5,314,795, 5,324,627 and 5,384,237 disclose methods where polymethine dyes are decolorized by heating using a carbanion generating agent.

The inclusion of the discoloring mechanism described above may often bring about problems such as incomplete decoloring of dyes or dye decolorization during the storage of photothermographic materials due to the insufficient stability of dyes. Moreover, in the case where the polymethine dyes are used, the decomposition products of dyes remaining after a decoloring process have some light absorption within the visible region, whereby residual color in the image (especially in the highlight portion) may cause problems. Furthermore, the problem of recoloring after a thermal developing process (especially in contact with acids) and by-products formed by a complicated reaction mechanism may often worsen the handling properties of the photothermographic materials after processing.

Therefore, dye utilization techniques to solve the problems described above have been eagerly desired for photothermographic materials exposed by a laser beam of the visible spectrum regions or by a near infrared laser beam.

SUMMARY OF THE INVENTION

A first aspect of the invention is to provide a silver halide photosensitive material comprising a phthalocyanine compound represented by the following formula (PC-1):

Formula (PC-1)

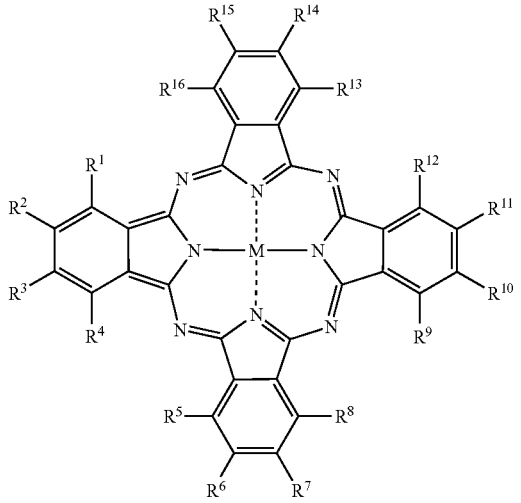

wherein, M represents a hydrogen atom or a metal atom; $R^1$, $R^4$, $R^5$, $R^8$, $R^9$, $R^{12}$, $R^{13}$, and $R^{16}$ each independently represent a hydrogen atom or a substituent; at least one of $R^1$, $R^4$, $R^5$, $R^8$, $R^9$, $R^{12}$, $R^{13}$, and $R^{16}$ is an electron-attracting group; and $R^2$, $R^3$, $R^6$, $R^7$, $R^{10}$, $R^{11}$, $R^{14}$, and $R^{15}$ each independently represent a hydrogen atom or a substituent.

A second aspect of the invention is to provide a photothermographic material having, on at least one side of a support, an image forming layer comprising at least a photosensitive silver halide, a non-photosensitive organic silver salt, and a reducing agent for the organic silver salt, and at least one non-photosensitive layer, wherein the photothermographic material contains a phthalocyanine compound represented by the following formula (PC-1):

Formula (PC-1)

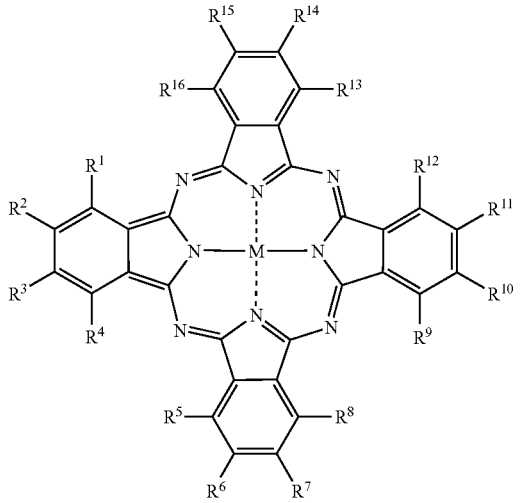

wherein, M represents a hydrogen atom or a metal atom; $R^1$, $R^4$, $R^5$, $R^8$, $R^9$, $R^{12}$, $R^{13}$, and $R^{16}$ each independently represent a hydrogen atom or a substituent; at least one of $R^1$, $R^4$, $R^5$, $R^8$, $R^9$, $R^{12}$, $R^{13}$, and $R^{16}$ is an electron-attracting group; and $R^2$, $R^3$, $R^6$, $R^7$, $R^{10}$, $R^{11}$, $R^{14}$, and $R^{15}$ each independently represent a hydrogen atom or a substituent.

DETAILED DESCRIPTION OF THE INVENTION

An object of the present invention is to provide a silver halide photosensitive material and a photothermographic material which exhibit excellent image quality with a good degree of sharpness and little residual color.

The present invention is explained below in detail.

(Phthalocyanine Compound)

Phthalocyanine compounds of formula (PC-1) according to the present are set forth below.

Formula (PC-1)

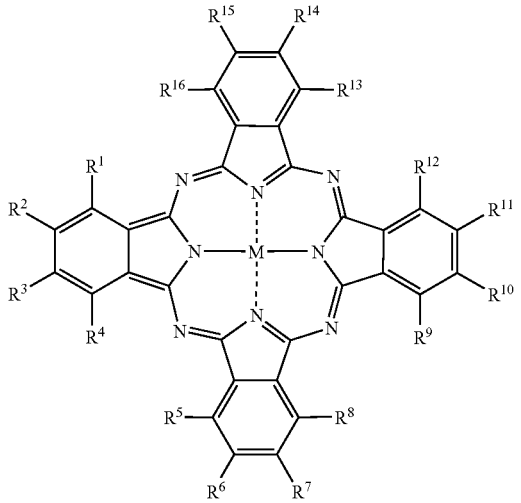

In formula (PC-1), M represents a hydrogen atom or a metal atom. The metal atom represents any metal which forms a stable complex, and Li, Na, K, Be, Mg, Ca, Ba, Al, Si, Cd, Hg, Cr, Fe, Co, Ni, Cu, Zn, Ge, Pd, Sn, Pt, Pb, Sr, or Mn can be used. Mg, Ca, Co, Zn, Pd, or Cu is preferably used, more preferably, Co, Pd, Zn, or Cu is used, and particularly preferably, Cu is used.

When M is a hydrogen atom, formula (PC-1) is expressed as follows.

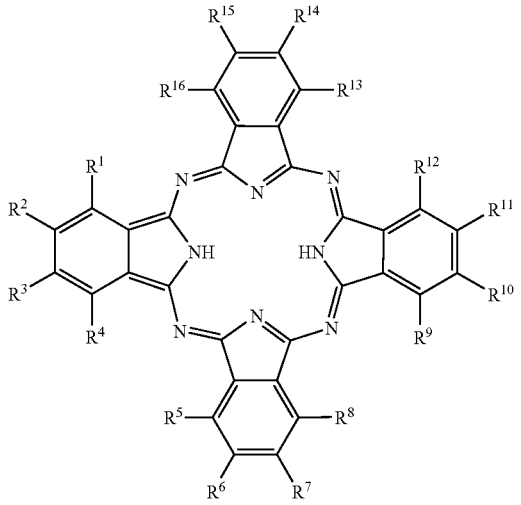

<<Subsutituents and the Like>>

In formula (PC-1), $R^1$, $R^4$, $R^5$, $R^8$, $R^9$, $R^{12}$, $R^{13}$, and $R^{16}$ each independently represent a hydrogen atom or a substituent, and at least one of $R^1$, $R^4$, $R^5$, $R^8$, $R^9$, $R^{12}$, $R^{13}$, and $R^{16}$ is an electron-attracting group. The electron-attracting group herein is selected from groups represented by a halogen atom, a cyano group, a nitro group, —C(═O)—R, —C(═O)—C (═O)—R, —S(═O)—R, —S(═O)$_2$—R, —C(═N—R')—R, —S(═NR')—R, —S(═NR')$_2$—R, —P(═O)$R_2$, —O——S—R", —N(—R')—C(═O)—R, —N(—R')—S(═O)—R, —N(—R')—S(═O)$_2$—R, —N(—R')—C(═N—R')—R, N(—R')—S(═NR')$_2$—R, and —N(—R')—P(═O)$R_2$. Herein R represents one selected from a hydrogen atom, an alkyl group, an aryl group, a heterocyclic group, an amino group, an alkyloxy group, an aryloxy group, a heterocyclic oxy group, an OH group, an alkylthio group, an arylthio group, a heterocyclic thio group, and an SH group. R' represents one selected from a hydrogen atom, an alkyl group, an aryl group, a heterocyclic group, an acyl group, a sulfonyl group, a sulfinyl group, and a phosphoryl group. R" represents one selected from a perfluoro alkyl group, a cyano group, an acyl group, a sulfonyl group, and a sulfinyl group.

The groups represented by R, R', and R" may be substituted by a substituent. Specific examples of the substituent include a halogen atom (a fluorine atom, a chlorine atom, a bromine atom, or an iodine atom), an alkyl group (including an aralkyl group, a cycloalkyl group, an active methine group, and the like), an alkenyl group, an alkynyl group, an aryl group, a heterocyclic group (at any substitution position), a heterocyclic group containing a quaternary nitrogen atom (for example, a pyridinio group, an imidazolio group, a quinolinio group, or an isoquinolinio group), an acyl group, an alkoxycarbonyl group, an aryloxycarbonyl group, a carbamoyl group, a carboxyl group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group, an alkoxy group (including a group in which ethylene oxy group units or propylene oxy group units are repeated), an aryloxy group, a heterocyclic oxy group, an acyloxy group, an alkoxy carbonyloxy group, an aryloxy carbonyloxy group, a carbamoyloxy group, a sulfonyloxy group, an amino group, an alkylamino group, an arylamino group, a heterocyclic amino group, an acylamino group, a sulfonamide group, an ureido group, a thioureido group, an imide group, an alkoxycarbonylamino group, an aryloxycarbonylamino group, a sulfamoylamino group, a semicarbazide group, a thiosemicarbazide group, a hydrazino group, an ammonio group, an oxamoylamino group, an alkylsulfonylureido group, an arylsulfonylureido group, an acylureido group, an acylsulfamoylamino group, a nitro group, a mercapto group, an alkylthio group, an arylthio group, a heterocyclic thio group, an alkylsulfonyl group, an arylsulfonyl group, an alkylsulfinyl group, an arylsulfinyl group, a sulfo group or a salt thereof, a sulfamoyl group, an acylsulfamoyl group, a sulfonylsulfamoyl group or a salt thereof, a group containing a phosphoric amide structure or a phosphate ester structure), a silyloxy group (for example, trimethylsilyloxy, or t-butyldimethylsilyloxy), a silyl group (for example, trimethylsilyl, t-butyldimethylsilyl, or phenyldimethylsilyl), and the like. These substituents may be further substituted by these substituents.

In formula (PC-1), a group represented by formula (II) is preferably used as an electron-attracting group.

$$-L^1-R^{17} \qquad \text{Formula (II)}$$

$L^1$ represents a group selected from **—$SO_2$—*, **—$SO_3$—*, —$SO_2NR_N$—*, **—SO—*, **—CO—*, **—$CONR_N$—*, **—COO—*, **—$COCO_2$—*, and **$COCONR_N$—*. ** denotes a bond with a phthalocyanine skeleton at this position. * denotes a bond with $R^{17}$ at this position. $R_N$ represents one selected from a hydrogen atom, an alkyl group, an aryl group, a heterocyclic group, an acyl group, an alkoxycarbonyl group, a carbamoyl group, a sulfonyl group, and a sulfamoyl group. $R_N$ may further be substituted by a substituent which $R^1$, $R^4$, $R^5$, $R^8$, $R^9$, $R^{12}$, $R^{13}$, or $R^{16}$ in formula (PC-1) may have. $L^1$ is preferably **—$SO_2$—*, **—$SO_2NR_N$—*, **—CO—*, **—$CONR_N$—*, more preferably **—$SO_2$—*, **—$SO_2NR_N$—*, or **—$CONR_N$—*, particularly preferably **—$SO_2$—* or **—$SO_2NR_N$—* and, most preferably **—$SO_2$—*.

$R_N$ is preferably a hydrogen atom, an alkyl group, an aryl group, or a heterocyclic group, preferably a hydrogen atom, an alkyl group having 1 to 20 carbon atoms, an aryl group having 6 to 20 carbon atoms, or a heterocyclic group having 1 to 20 carbon atoms, still more preferably a hydrogen atom, an alkyl group having 1 to 10 carbon atoms, an aryl group having 6 to 10 carbon atoms, or a heterocyclic group having 1 to 10 carbon atoms, and particularly preferably a hydrogen atom or an alkyl group having 1 to 6 carbon atoms.

$R^{17}$ represents one selected from a hydrogen atom, an alkyl group, an aryl group, and a heterocyclic group. In the case where $R^{17}$ represents an alkyl group, an aryl group or a heterocyclic group, these groups may be further substituted by substituents which $R^1$, $R^4$, $R^5$, $R^8$, $R^9$, $R^{12}$, $R^{13}$, or $R^{16}$ in formula (PC-1) may have. $R^{17}$ represents preferably an alkyl group or an aryl group, and particularly preferably an alkyl group. $R^{17}$ has 1 to 30 carbon atoms, preferably 1 to 20 carbon atoms, more preferably 1 to 10 carbon atoms, further preferably 2 to 4 carbon atoms, and most preferably 3 carbon atoms.

$R^{17}$ is preferably substituted by a hydrophilic group. Herein, a hydrophilic group indicates a carboxyl group, a sulfo group, a phosphate group, a group having a structure of quaternary salt of nitrogen, a group having a structure of quaternary salt of phosphorus, or a group in which ethylene oxy group units are repeated. In the case where the hydrophilic group is a carboxyl group, a sulfo group or a phosphate group, the hydrophilic group may have a counter cation, when necessary. As the counter ion, a metal cation, an ammonium cation, a group having a structure of quaternary salt of nitrogen, or a group having a structure of a quaternary salt of phosphorus is used.

In the case where W is a group having a structure of quaternary salt of nitrogen, or a group having a structure of quaternary salt of phosphorus, W may have a counter anion, when necessary. As examples of the counter anion, a halogen ion, sulfate ion, a nitrate ion, a phosphate ion, a oxalate ion, an alkanesulfonate ion, an arylsulfonate ion, an alkanecarboxylate ion, an arylcarboxylate ion, and the like can be described. The hydrophilic group is preferably a carboxyl group, a sulfo group, or a phosphate group, and more preferably, a carboxyl group or a sulfo group. In this case, as a counter cation, $Li^+$, $Na^+$, $K^+$, $Mg^{2+}$, $Ca^{2+}$ or $NH_4^+$ is preferably used, more preferably, $Li^+$, $Na^+$, $K^+$ or $NH_4^+$ is used, and particularly preferably, $Li^+$ or $Na^+$ is used.

In formula (PC-1), when at least one of $R^1$, $R^4$, $R^5$, $R^8$, $R^9$, $R^{12}$, $R^{13}$, and $R^{16}$ is a substituent, these groups may be the substituents selected from the same groups which R, R', or R" in formula (PC-1) may have. These substitutents may be further substituted by these substituents.

The substituents are preferably a halogen atom, an alkyl group, an alkenyl group, an alkynyl group, an aryl group, a heterocyclic group (at any substitution position), a heterocyclic group containing a quaternary nitrogen atom (for example, a pyridinio group, an imidazolio group, a quinolinio group, or an isoquinolinio group), an acyl group, an alkoxycarbonyl group, an aryloxycarbonyl group, a carbamoyl group, a carboxyl group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a sulfonyloxy group, an imide group, a sulfamoylamino group, a semicarbazide group, a thiosemicarbazide group, a nitro group, an alkylsulfonyl group, an arylsulfonyl group, an alkylsulfinyl group, an arylsulfinyl group, a sulfo group or a salt thereof, a sulfamoyl group, an acylsulfamoyl group, a sulfonylsulfamoyl group or a salt thereof, or a group containing a phosphoric amide structure or a phosphate ester structure. More preferably, an alkyl group, an aryl group, a heterocyclic group, an acyl group, an alkoxycarbonyl group, a carbamoyl group, a carboxyl group or a salt thereof, an oxalyl group, an oxamoyl group, a cyano group, an imide group, a sulfamoylamino group, an alkylsulfonyl group, an arylsulfonyl group, an alkylsulfinyl group, an arylsulfinyl group, a sulfo group or a salt thereof, a sulfamoyl group, an acylsulfamoyl group, or a sulfonylsulfamoyl group or a salt thereof is used. And further preferably, an aryl group, a heterocyclic group, an acyl group, an alkoxycarbonyl group, a carbamoyl group, a carboxyl group or a salt thereof, an alkylsulfonyl group, an arylsulfonyl group, an alkylsulfinyl group, an arylsulfinyl group, a sulfo group or a salt thereof, or a sulfamoyl group is used.

In the compounds represented by formula (PC-1), 4 or more of $R^1$, $R^4$, $R^5$, $R^8$, $R^9$, $R^{12}$, $R^{13}$, and $R^{16}$ are preferably the group represented by formula (II), and more preferably, at least one of R in the combinations of $R^1$ and $R^4$, $R^5$ and $R^8$, $R^9$ and $R^{12}$, and $R^{13}$ and $R^{16}$ are represented by formula (II). Particularly preferably, at least one of R in combination of $R^1$ and $R^4$, $R^5$ and $R^8$, $R^9$ and $R^{12}$, and $R^{13}$ and $R^{16}$ are represented by formula (II) and others are a hydrogen atom. When plural number of groups, which are represented by formula (II), are present in a same molecule, these may be the same or different from each other, however preferably the same.

In formula (PC-1), $R^2$, $R^3$, $R^6$, $R^7$, $R^{10}$, $R^{11}$, $R^{14}$, and $R^{15}$ each independently represent a hydrogen atom or a substituent.

$R^2$, $R^3$, $R^6$, $R^7$, $R^{10}$, $R^{14}$, and $R^{15}$ are preferably a hydrogen atom, a halogen atom, a carboxyl group, an alkoxycarbonyl group, an acyl group, a sulfo group, a sulfamoyl group, a sulfonyl group, an alkyl group, an aryl group, or a heterocyclic group. More preferable are a hydrogen atom, a halogen atom, a sulfo group, a sulfamoyl group, and a sulfonyl group, particularly preferable are a hydrogen atom, a sulfo group, and a halogen atom, and most preferable is a hydrogen atom.

In general, phthalocyanine compounds having a plural number of substituents may have a regio isomer, which has a different bonding position with the substituents. The compounds represented by formula (PC-1) in the invention are not exceptional. In some cases several kinds of regio isomers are present. In the invention, the phthalocyanine compound may be used as a single compound but it may be used as a mixture of regio isomers. In the case where a mixture of regio isomers is used, any number of regio isomers, any substitution positon of isomer, and any ratios of isomers are employed.

Examples of the compound represented by formula (PC-1) used in the present invention are shown below.

But, the present invention is not limited by these examples. Examples of compounds hereinafter are described as a single compound for a mixture of region isomers.

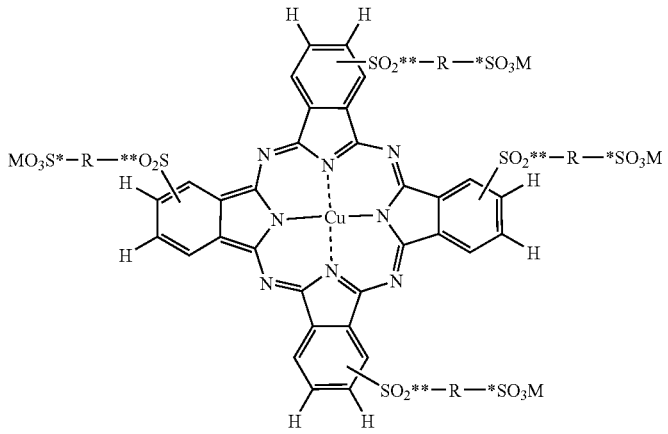

| | Compound No. | | |
|---|---|---|---|
| | M=Li | M=Na | M=K |
| **—R—* = **—$CH_2CH_2$—* | 1 | 10 | 19 |
| **—$CH_2CH_2CH_2$—* | 2 | 11 | 20 |
| **—$CH_2CH_2CH_2CH_2$—* | 3 | 12 | 21 |
| **—$CH_2CH_2CH_2CH_2CH_2$—* | 4 | 13 | 22 |
| **—$CH_2CH_2$—$(OCH_2CH_2)n$—* n = 1 | 5 | 14 | 23 |

-continued
| | | | |
|---|---|---|---|
| 2 | 6 | 15 | 24 |
| 3 | 7 | 16 | 25 |
| 4 | 8 | 17 | 26 |
| 5 | 9 | 18 | 27 |
| | Compound No. | |
|---|---|---|
| | M=Li | M=Na |
| 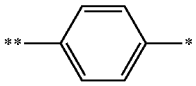 | 28 | 31 |
| 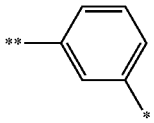 | 29 | 32 |
| 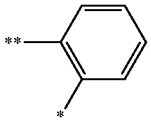 | 30 | 33 |
| 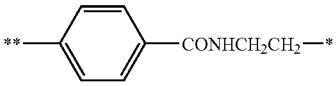 | 34 | 37 |
| 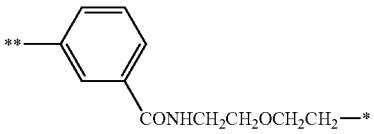 | 35 | 38 |
| 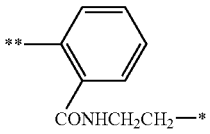 | 36 | 39 |
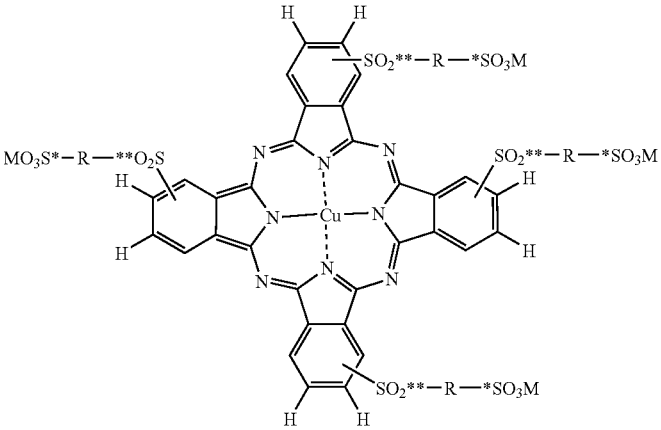
| | Compound No. | |
|---|---|---|
| **—R—* = **—$CH_2CH_2$—* | 40 | M=Li&$NH_4$ (Li/$NH_4$ = 3/1) |
| | 41 | M=Li&$NH_4$ (Li/$NH_4$ = 2/2) |
| | 42 | M=Na&$NH_4$ (Na/$NH_4$ = 3/1) |
| | 43 | M=Na&$NH_4$ (Na/$NH_4$ = 2/2) |
| | 44 | M=Na&$NH_4$ (Na/$NH_4$ = 1/3) |
| **—$CH_2CH_2CH_2$—* | 45 | M=Li&$NH_4$ (Li/$NH_4$ = 3/1) |
| | 46 | M=Li&$NH_4$ (Li/$NH_4$ = 2/2) |
| | 47 | M=Li&$NH_4$ (Li/$NH_4$ = 1/3) |

-continued
| | | |
|---|---|---|
| | 48 | M=Na&$NH_4$ (Na/$NH_4$ = 3/1) |
| | 49 | M=Na&$NH_4$ (Na/$NH_4$ = 2/2) |
| | 50 | M=Na&$NH_4$ (Na/$NH_4$ = 1/3) |
| | 51 | M=K&$NH_4$ (K/$NH_4$ = 3/1) |
| | 52 | M=K&$NH_4$ (K/$NH_4$ = 2/2) |
| | 53 | M=K&$NH_4$ (K/$NH_4$ = 1/3) |
| | 54 | M=$Et_4N$ |
| **—$CH_2CH_2CH_2CH_2$—* | 55 | M=Li&$NH_4$ (Li/$NH_4$ = 3/1) |
| | 56 | M=Li&$NH_4$ (Li/$NH_4$ = 2/2) |
| | 57 | M=Na&$NH_4$ (Na/$NH_4$ = 3/1) |
| | 58 | M=Na&$NH_4$ (Na/$NH_4$ = 2/2) |
| | 59 | M=Na&$NH_4$ (Na/$NH_4$ = 1/3) |
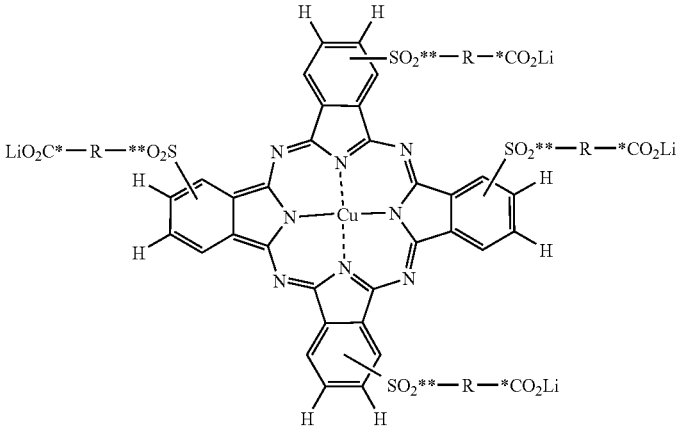
| | Compound No. |
|---|---|
| **—R—* = **—$CH_2CH_2$—* | 60 |
| **—$CH_2CH_2CH_2$—* | 61 |
| **—$CH_2CH_2CH_2CH_2$—* | 62 |
| **—$CH_2CH_2CH_2CH_2CH_2$—* | 63 |
| **—$CH_2CH_2$—($OCH_2CH_2$)n—* | 64 |
| n = 1 | 65 |
| 2 | 66 |
| 3 | 67 |
| 4 | 68 |
| 5 | 69 |
| | Compound No. |
|---|---|
| 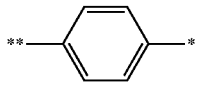 | 70 |
| 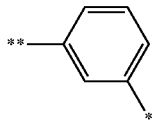 | 71 |
| 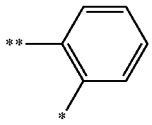 | 72 |
| 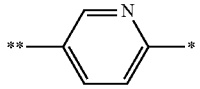 | 73 |
| 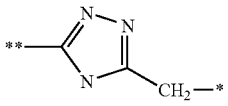 | 74 |

-continued
| | |
|---|---|
| 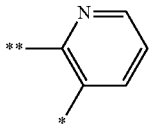 | 75 |
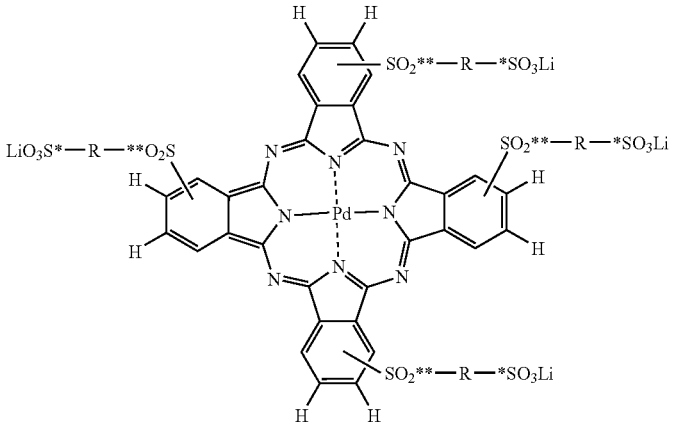
| | Compound No. |
|---|---|
| **—R—* = **—$CH_2CH_2$—* | 76 |
| **—$CH_2CH_2CH_2$—* | 77 |
| **—$CH_2CH_2CH_2CH_2$—* | 78 |
| **—$CH_2CH_2CH_2CH_2CH_2$—* | 79 |
| **—$CH_2CH_2$—$(OCH_2CH_2)n$—* | |
| n = 1 | 80 |
| 2 | 81 |
| 3 | 82 |
| 4 | 83 |
| 5 | 84 |
| | Compound No. |
|---|---|
| 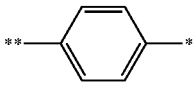 | 85 |
| 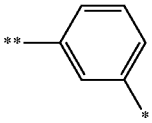 | 86 |
| 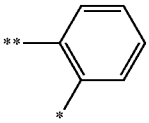 | 87 |
| 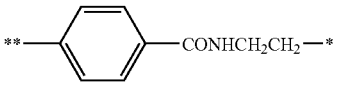 | 88 |
| 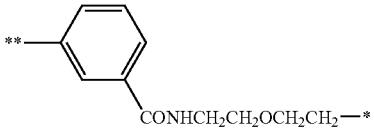 | 89 |

-continued
| | |
|---|---|
| 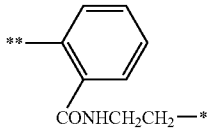 | 90 |
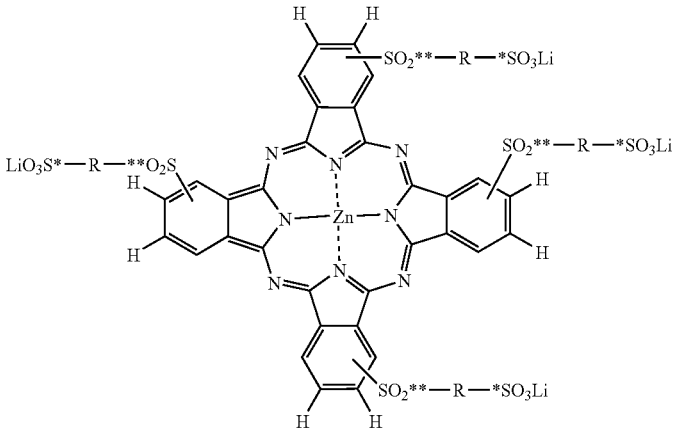
| | Compound No. |
|---|---|
| **—R—* = **—$CH_2CH_2$—* | 91 |
| **—$CH_2CH_2CH_2$—* | 92 |
| **—$CH_2CH_2CH_2CH_2$—* | 93 |
| **—$CH_2CH_2CH_2CH_2CH_2$—* | 94 |
| **—$CH_2CH_2$—$OCH_2CH_2)n$—* | |
| n = 1 | 95 |
| 2 | 96 |
| 3 | 97 |
| 4 | 98 |
| 5 | 99 |
| | Compound No. |
|---|---|
| 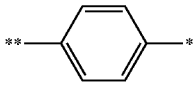 | 100 |
| 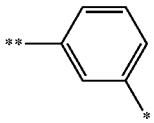 | 101 |
| 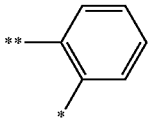 | 102 |
| 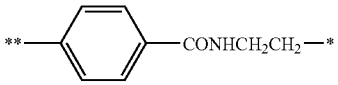 | 103 |

-continued
| | |
|---|---|
| 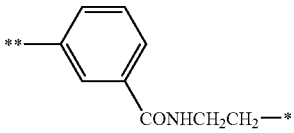 | 104 |
| 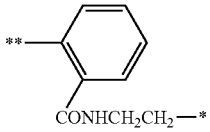 | 105 |
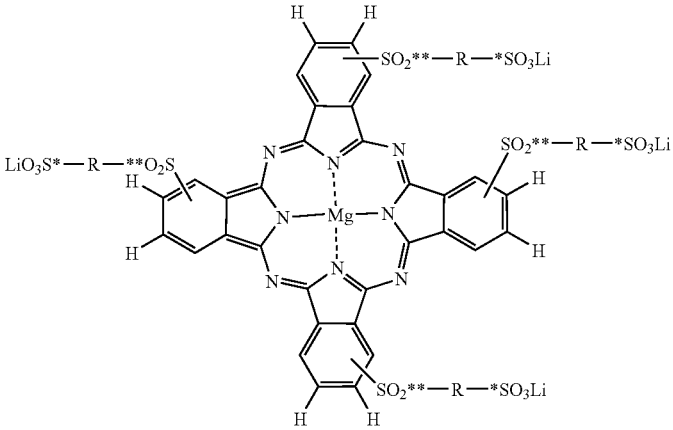
| | Compound No. |
|---|---|
| **—R—* = **—$CH_2CH_2$—* | 106 |
| **—$CH_2CH_2CH_2$—* | 107 |
| **—$CH_2CH_2CH_2CH_2$—* | 108 |
| **—$CH_2CH_2CH_2CH_2CH_2$—* | 109 |
| **—$CH_2CH_2$—$(OCH_2CH_2)n$—* | |
| n = 1 | 110 |
| 2 | 111 |
| 3 | 112 |
| 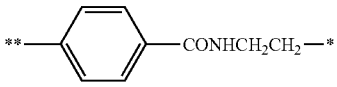 | 113 |
| 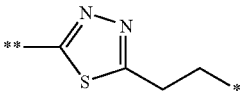 | 114 |
| 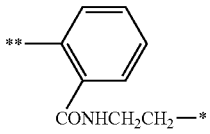 | 115 |

-continued
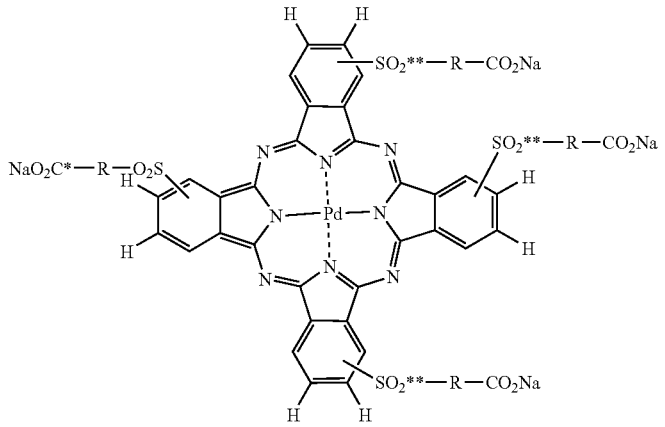
| | Compound No. |
|---|---|
| **—R—* = **—$CH_2CH_2CH_2$—* | 116 |
| **—$CH_2CH_2CH_2CH_2$—* | 117 |
| **—$CH_2CH_2CH_2CH_2CH_2$—* | 118 |
| **—$CH_2CH_2$—$(OCH_2CH_2)n$—* | |
| n = 1 | 119 |
| 2 | 120 |
| 3 | 121 |
| | Compound No. |
|---|---|
| 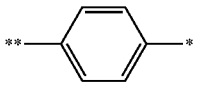 | 122 |
| 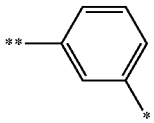 | 123 |
| 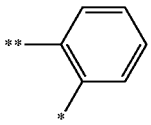 | 124 |
| 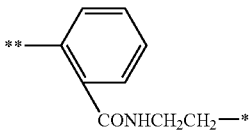 | 125 |

-continued
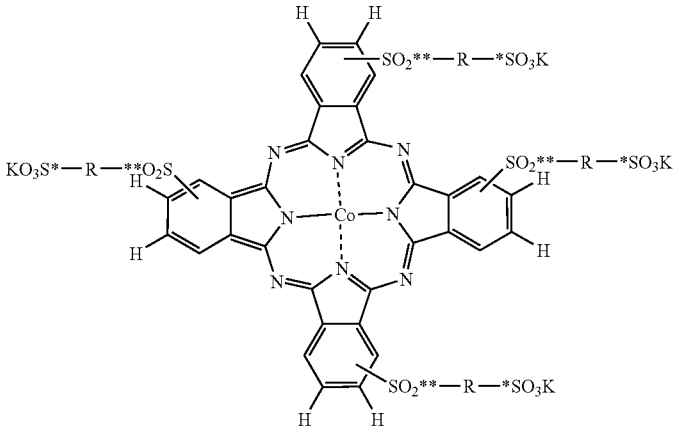
| | Compound No. |
|---|---|
| **—R—* = **—$CH_2CH_2CH_2$—* | 126 |
| **—$CH_2CH_2CH_2CH_2$—* | 127 |
| **—$CH_2CH_2CH_2CH_2CH_2$—* | 128 |
| **—$CH_2CH_2$—$(OCH_2CH_2)$n—* | |
| n = 1 | 129 |
| 2 | 130 |
| 3 | 131 |
| | Compound No. |
|---|---|
| 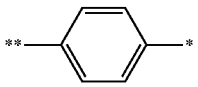 | 132 |
| 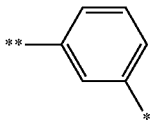 | 133 |
| 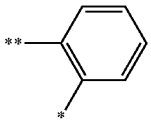 | 134 |
| 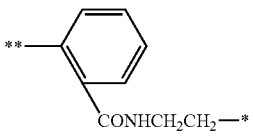 | 135 |

-continued
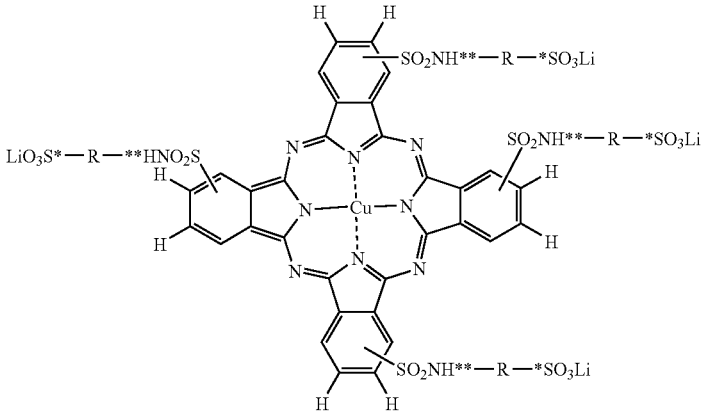
| | Compound No. |
|---|---|
| **—R—* = **—$CH_2CH_2$—* | 136 |
| **—$CH_2CH_2CH_2$—* | 137 |
| **—$CH_2CH_2CH_2CH_2$—* | 138 |
| **—$CH_2CH_2CH_2CH_2CH_2$—* | 139 |
| **—$CH_2CH_2$—$(OCH_2CH_2)n$—* | |
| n = 1 | 140 |
| 2 | 141 |
| 3 | 142 |
| | Compound No. |
|---|---|
| 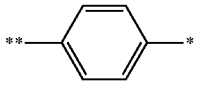 | 143 |
| 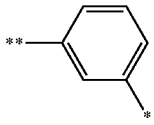 | 144 |
| 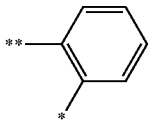 | 145 |
| 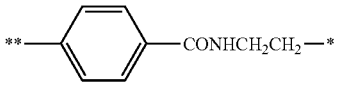 | 146 |
| 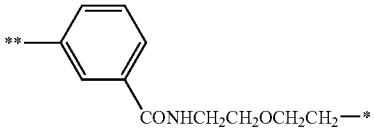 | 147 |
| 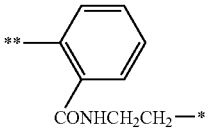 | 148 |

-continued
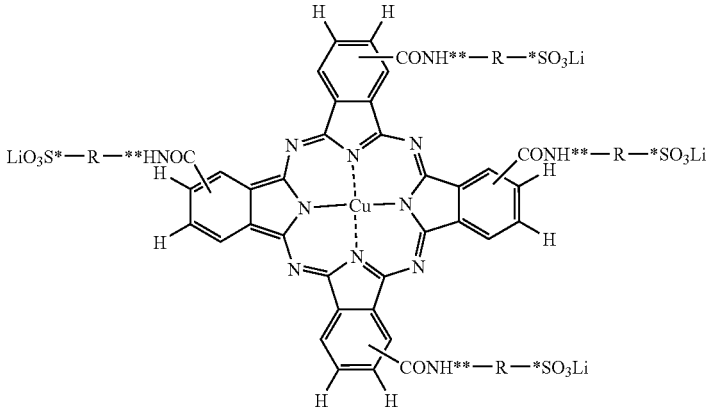
| | Compound No. |
|---|---|
| **—R—* = **—$CH_2CH_2$—* | 149 |
| **—$CH_2CH_2CH_2$—* | 150 |
| **—$CH_2CH_2CH_2CH_2$—* | 151 |
| **—$CH_2CH_2CH_2CH_2CH_2$—* | 152 |
| **—$CH_2CH_2$—$(OCH_2CH_2)n$—* | |
| n = 1 | 153 |
| 2 | 154 |
| 3 | 155 |
| | Compound No. |
|---|---|
| 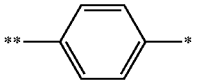 | 156 |
| 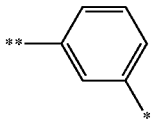 | 157 |
| 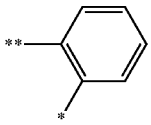 | 158 |
| 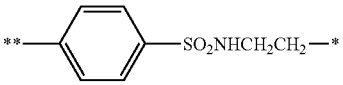 | 159 |
| 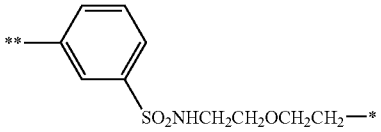 | 161 |
| 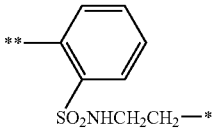 | 162 |

-continued
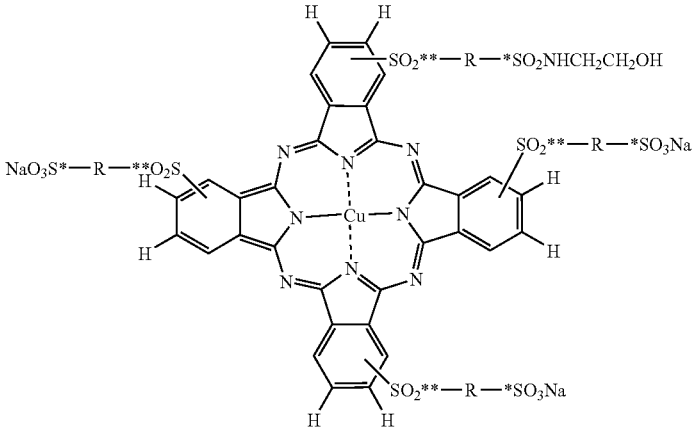
| | Compound No. |
|---|---|
| **—R—* = **—$CH_2CH_2CH_2$—* | 163 |
| **—$CH_2CH_2CH_2CH_2$—* | 164 |
| **—$CH_2CH_2CH_2CH_2CH_2$—* | 165 |
| **—$CH_2CH_2$—$(OCH_2CH_2)n$—* | |
| n = 1 | 166 |
| 2 | 167 |
| 3 | 168 |
| | Compound No. |
|---|---|
| 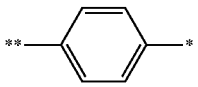 | 169 |
| 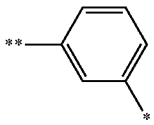 | 170 |
| 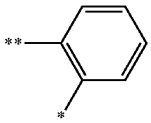 | 171 |
| 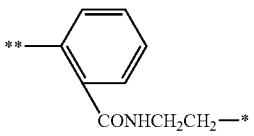 | 172 |

-continued
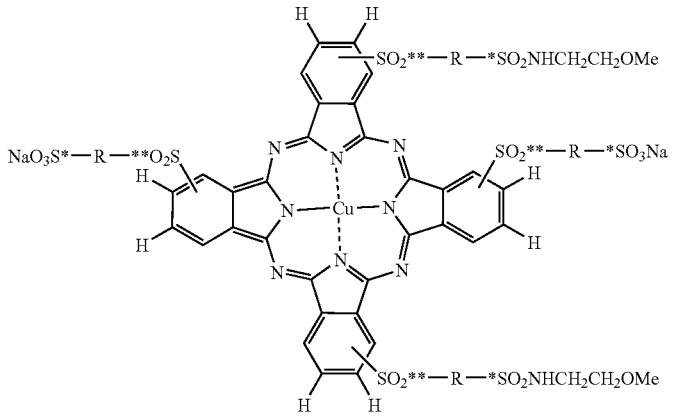
| | Compound No. |
|---|---|
| **—R—* = **—$CH_2CH_2CH_2$—* | 173 |
| **—$CH_2CH_2CH_2CH_2$—* | 174 |
| **—$CH_2CH_2CH_2CH_2CH_2$—* | 175 |
| **—$CH_2CH_2$—$(OCH_2CH_2)$n—* | |
| n = 1 | 176 |
| 2 | 177 |
| 3 | 178 |
| 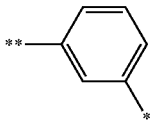 | 179 |
| 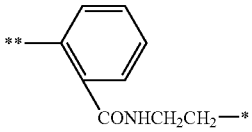 | 180 |
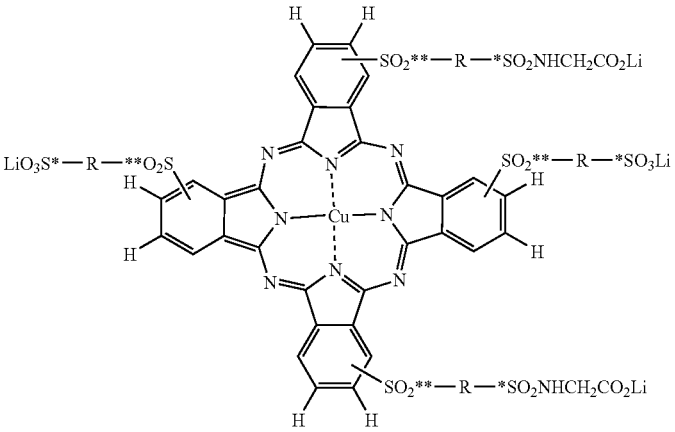
| | Compound No. |
|---|---|
| **—R—* = **—$CH_2CH_2CH_2$—* | 181 |
| **—$CH_2CH_2CH_2CH_2$—* | 182 |
| **—$CH_2CH_2CH_2CH_2CH_2$—* | 183 |
| **—$CH_2CH_2$—$(OCH_2CH_2)$n—* | |
| n = 1 | 184 |

-continued
| | |
|---|---|
| 2 | 185 |
| 3 | 186 |
| 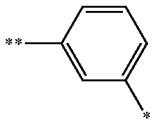 | 187 |
| 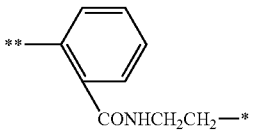 | 188 |
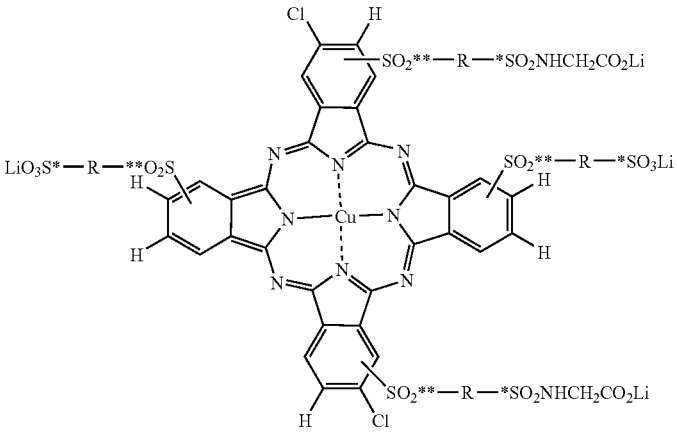
| | Compound No. |
|---|---|
| **—R—* = **—$CH_2CH_2CH_2$—* | 189 |
| **—$CH_2CH_2CH_2CH_2$—* | 190 |
| **—$CH_2CH_2CH_2CH_2CH_2$—* | 191 |
| 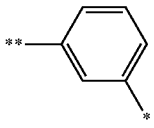 | 192 |
| 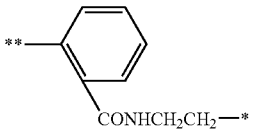 | 193 |

-continued
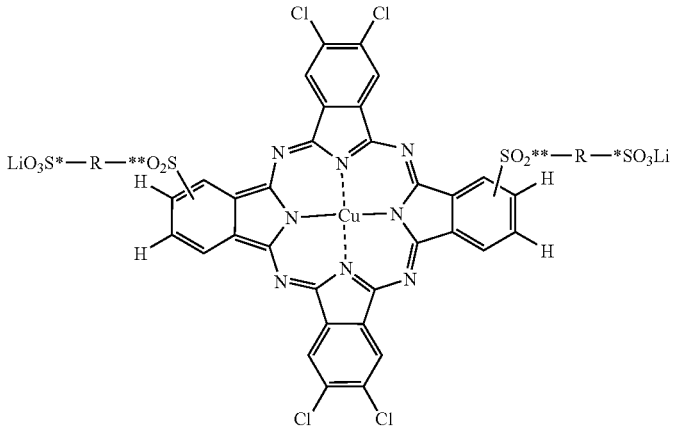
| | Compound No. |
|---|---|
| **—R—* = **—$CH_2CH_2CH_2$—* | 194 |
| **—$CH_2CH_2CH_2CH_2$—* | 195 |
| **—$CH_2CH_2CH_2CH_2CH_2$—* | 196 |
| 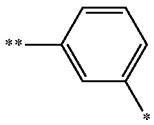 | 197 |
| 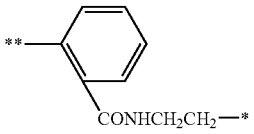 | 198 |
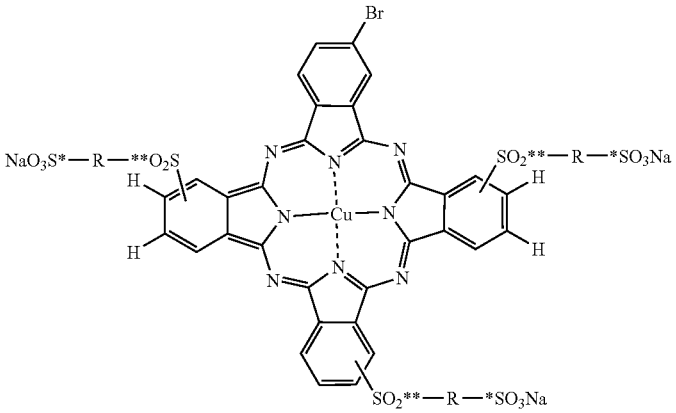
| | Compound No. |
|---|---|
| **—R—* = **—$CH_2CH_2CH_2$—* | 199 |
| **—$CH_2CH_2CH_2CH_2$—* | 200 |
| **—$CH_2CH_2CH_2CH_2CH_2$—* | 201 |

-continued
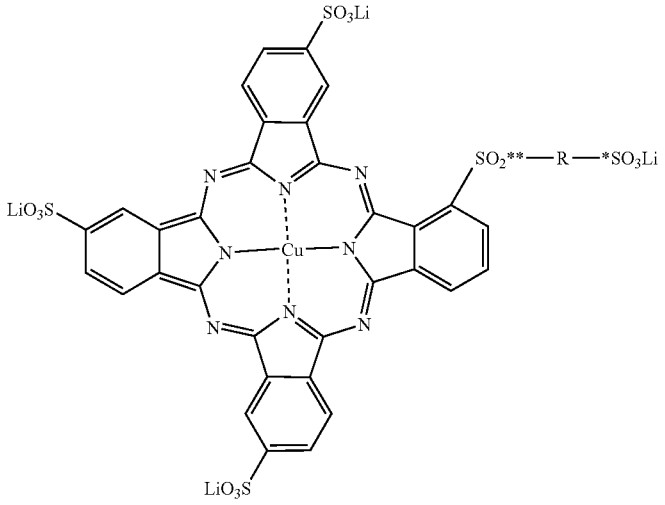
| | Compound No. |
|---|---|
| **—R—* = **—$CH_2CH_2CH_2$—* | 202 |
| **—$CH_2CH_2CH_2CH_2$—* | 203 |
| **—$CH_2CH_2CH_2CH_2CH_2$—* | 204 |
| 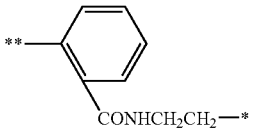 | 205 |
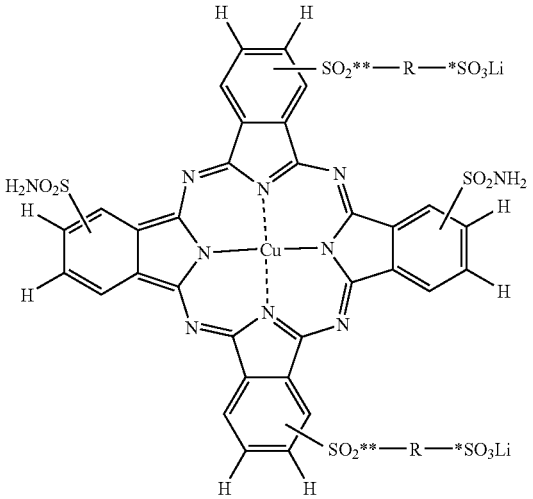
| | Compound No. |
|---|---|
| **—R—* = **—$CH_2CH_2$—* | 206 |
| **—$CH_2CH_2CH_2$—* | 207 |
| **—$CH_2CH_2CH_2CH_2$—* | 208 |
| **—$CH_2CH_2CH_2CH_2CH_2$—* | 209 |
| **—$CH_2CH_2$—$(OCH_2CH_2)n$—* | |
| n = 1 | 210 |
| 2 | 211 |
| 3 | 212 |

-continued
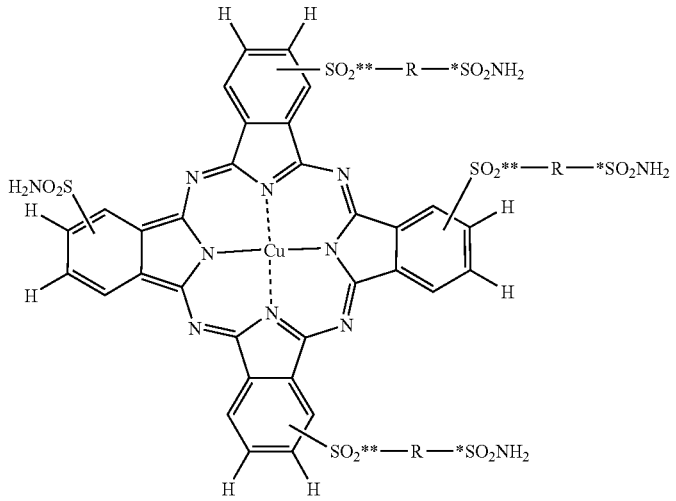
| | Compound No. |
|---|---|
| **—R—* = **—$CH_2CH_2$—* | 213 |
| **—$CH_2CH_2CH_2$—* | 214 |
| **—$CH_2CH_2CH_2CH_2$—* | 215 |
| **—$CH_2CH_2CH_2CH_2CH_2$—* | 216 |
| **—$CH_2CH_2$—$(OCH_2CH_2)n$—* | |
| n = 1 | 217 |
| 2 | 218 |
| 3 | 219 |
Synthesis of Illustrated Compound No. 2
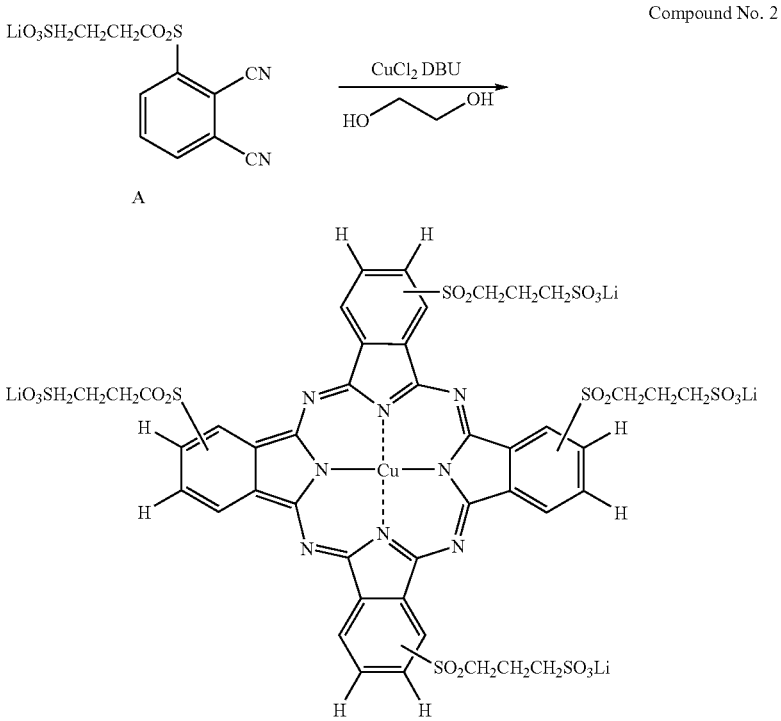

To a synthetic intermediate A (1.26 g, 4 mmol) in an ethylene glycol solution (10 mL) was added $CuCl_2$ (134 mg, 1 mmol), and heated to be 100° C. To the reaction mixture was added DBU (1.52 g, 10 mmol) and stirred for 10 hours at 100° C. The reaction mixture was acidified with hydrochloric acid, and thereto was added LiCl to separate a crude phthalocyanine. Thus obtained crude product was purified through a column chromatography using Sephadex G-15 as a carrier. 67 mg of the mixture of illustrated Compound No. 2 was obtained (yield 5%).

The phthalocyanine compound of the invention has preferably little residual color and has an antihalation effect to obtain a high quality image. When it is contained in a photothermographic material, a ratio of a light absorption density at 610 nm to a light absorption density at the exposure wavelength after thermal development is in a range from 0.2 to 0.8.

It is preferred that the light absorption density at 610 nm is 0.1 to 0.3, and the light absorption density at the aforementioned exposure wavelength is 0.3 to 0.8. It is more preferred that the ratio of a light absorption density at 610 nm to a light absorption density at the exposure wavelength after thermal development is 0.3 to 0.6.

<<Adding Method>>

The phthalocyanine compound of the invention is preferably water-soluble and is preferably used for the manufacturing of photothermographic material as an aqueous solution pre-arranged by water as a medium. In the said solution, the water-soluble phthalocyanine compound of the present invention is contained 0.1% by weight to 30% by weight, preferably 0.5% by weight to 20% by weight, and more preferably may be contained 1% by weight to 8% by weight. The said solution further may contain a water-soluble organic solvent and an auxiliary additive. The content of water-soluble organic solvent is 0% by weight to 30% by weight, and preferably 5% by weight to 30% by weight. The content of auxiliary additive is 0% by weight to 5% by weight, preferably 0% by weight to 2% by weight.

At the arranging of aqueous solution of water-soluble phthalocyanine compound according to the present invention, as specific examples of the usable water-soluble organic solvent, alkanols having 1 to 4 carbon atoms such as methanol, ethanol, propanol, isopropanol, butanol, isobutanol, sec-butanol, tert-butanol, and the like, carboxylic amides such as N,N-dimethlyfolmamide, N,N-dimethyl acetamide and the like, lactams such as ε-caprolactam, N-methylpirrolidine-2-one, and the like, urea, ring forming ureas such as 1,3-dimethylimidazolidine-2-one, 1,3-dimethylhexahydropyrimide-2-one and the like, ketones or ketoalcohols such as acetone, methyl ethyl ketone, 2-methyl-2-hydroxypentane-4-one and the like, ethers such as tertahydrofuran, dioxan and the like, mono-, oligo- and polyalkylene glycols or thioglycols having alkylene unit with 2 to 6 carbon atoms such as ethylene glycol, 1,2- or 1,3-propylene glycol, 1,2- or 1,4-butylene glycol, 1,6-hexylene glycol, diethylene glycol, triethylene glycol, dipropylene glycol, thiodiglycol, polyethylene glycol, polypropylene glycol and the like, polyols (triols) such as glycerine, hexane-1,2,6-triol and the like, alkylethers with 1 to 4 carbon atoms of multi-valent alcohol such as ethylene glycol monomethylether, ethylene glycol monoethylether, diethylene glycol monomethylether, diethylene glycol monoethylether, triethylene glycol monomethylether, triethylene glycol monoethylether and the like, γ-butylolactone, dimethylsulfoxide and the like can be described. Two or more types of these water-soluble organic solvents can be used in combination.

Among the water-soluble organic solvent described above, urea, N-methylpyrrolidine-2-one, mono, di, or trialkylene glycol having alkylene units with 2 to 6 carbon atoms are preferable, and mono, di, or triethylene glycol, dipropylene glycol, dimethylsulfoxide and the like are more preferable. Particularly, N-methlpyrrolidine-2-one, diethylene glycol, dimethysulfoxide, or urea is preferably used, and urea is most preferable. As the water-soluble phthalocyanine compound of the invention is diluted by mixing the said aqueous solution with various chemicals at the making of photothermographic material, the method to make an water-soluble organic solvent, besides the said aqueous solution, contain 1 mol to 500 mol per 1 mol of the phtalocyanine compound is also preferably used.

Examples of the auxiliary additives include an antiseptic, a pH control agent, a chelating agent, an antistain agent, a water-soluble ultraviolet-ray absorbing agent, a water-soluble polymer, a dye solvent, and a surfactant, and they are preferably added if necessary.

Examples of the antiseptic include sodium dihydroacetates, sodium sorbinates, sodium 2-pyridinethiol-1-oxides, sodium benzoates, sodium pentachloro phenols, benzisothiazolinons and salts thereof, p-hydroxybenzoic acid esters and the like.

As for the pH control agent, any compounds can be applied so long as to control the pH of the prepared solution at a range of 4 to 11 without any bad effect. Examples of the pH control agent include alkanolamines, such as diethanolamine and triethanol amine, alkali metal salts of hydroxide, such as lithium hydroxide, sodium hydroxide, and potassium hydroxide, and alkali metal salts of carbonic acid, such as lithium carbonate, sodium carbonate, and potassium carbonate.

Examples of the chelating agent include sodium salts of ethylenediaminetetraacetic acid, sodium salts of nitrilotriacetic acid, sodium salts of hydroxyethyl ethylenediaminetriacetic acid, sodium salts of diethylene triaminepentaacetic acid, sodium salts of uracil diacetic acid. Examples of the antistain agent include hyposulfites, sodium thiosulfate, thioglycolic acid ammonium salt, diisopropyl ammonium nitrite, pentaerythrithol tetranitrate, and dicyclohexylammonium nitrite. Examples of the water-soluble polymer compound include polyvinyl alcohol, cellulose derivatives, polyamines, and polyimines and the like. Examples of the water-soluble ultraviolet-ray absorbing agent include sulfonated benzophenones, sulfonated benztriazoles and the like. Examples of the dye solvent include ε-caprolactam, ethylene carbonate, urea and the like. Examples of the surfactant include well-known surfactants of anionic, cationic and nonionic surfactants, and a surfactant of acetyleneglycol type is preferably used.

<<Layer to be Added>>

The phthalocyanine compound used for the present invention can be incorporated in at least one layer on the side where the image forming layer is coated toward the support, or in at least one layer on the opposite side to the side where the image forming layer is coated. Preferred is the above compound incorporated in both sides of the support. At this time, it is a preferred embodiment that an organic polyhalogen compound is incorporated in at least one layer on the side where the image forming layer is coated.

<<Range of Addition Amount>>

To arrange the blueish image tone after thermal developing process, the addition amount of dye is determined by the combination with a color tone of developed silver image or a color tone obtained by other additives. Generally, the optical density (absorbance) measured at the objective wavelength is used under 1.5. The optical density is 0.01 to 1.2, preferably 0.05 to 1.0, and more preferably 0.1 to 0.8. To obtain the above optical density, the addition amount of dye is generally 0.5 mg/m$^2$ to 200 mg/m$^2$, preferably 1 mg/m$^2$ to 160 mg/m$^2$, and more preferably 5 mg/m$^2$ to 120 mg/m$^2$.

(Non-photosensitive Organic Silver Salt)

1) Composition

The organic silver salt which can be used in the present invention is relatively stable to light but serves as to supply silver ions and forms silver images when heated to 80° C. or higher under the presence of an exposed photosensitive silver halide and a reducing agent. The organic silver salt may be any organic material containing a source capable of supplying silver ions that are reducible by a reducing agent. Such a non-photosensitive organic silver salt is disclosed, for example, in JP-A No. 10-62899 (paragraph Nos. 0048 to 0049), European Patent (EP) No. 0803764A1 (page 18, line 24 to page 19, line 37), EP No. 0962812A1, JP-A Nos. 11-349591, 2000-7683, and 2000-72711, and the like. A silver salt of an organic acid, particularly, a silver salt of long chained aliphatic carboxylic acid (having 10 to 30 carbon atoms, and preferably having 15 to 28 carbon atoms) is preferable. Preferred examples of the silver salt of fatty acid can include, for example, silver lignocerate, silver behenate, silver arachidinate, silver stearate, silver oleate, silver laurate, silver capronate, silver myristate, silver palmitate, silver erucate and mixtures thereof. In the invention, among these silver salts of fatty acid, it is preferred to use a silver salt of fatty acid with a silver behenate content of 50 mol % or more, more preferably, 85 mol % or more, and further preferably, 95 mol % or more. Further, it is preferred to use a silver salt of fatty acid with a silver erucate content of 2 mol % or less, more preferably, 1 mol % or less, and further preferably, 0.1 mol % or less.

It is preferred that the content of silver stearate is 1 mol % or less. When the content of silver stearate is 1 mol % or less, a silver salt of organic acid having low fog, high sensitivity and excellent image storability can be obtained. The above-mentioned content of silver stearate is preferably 0.5 mol % or less, and particularly preferably, silver stearate is not substantially contained.

Further, in the case where the silver salt of organic acid includes silver arachidinate, it is preferred that the content of silver arachidinate is 6 mol % or less in order to obtain a silver salt of organic acid having low fog and excellent image storability. The content of silver arachidinate is more preferably 3 mol % or less.

2) Shape

There is no particular restriction on the shape of the organic silver salt usable in the invention and it may be needle-like, bar-like, tabular, or flake shaped.

In the invention, a flake shaped organic silver salt is preferred. Short needle-like, rectangular, cuboidal, or potato-like indefinite shaped particles with the major axis to minor axis ratio being 5 or less are also used preferably. Such organic silver particles suffer less from fogging during thermal development compared with long needle-like particles with the major axis to minor axis length ratio of more than 5. Particularly, a particle with the major axis to minor axis ratio of 3 or less is preferred since it can improve the mechanical stability of the coating film. In the present specification, the flake shaped organic silver salt is defined as described below. When an organic acid silver salt is observed under an electron microscope, calculation is made while approximating the shape of an organic acid silver salt particle to a rectangular body and assuming each side of the rectangular body as a, b, c from the shorter side (c may be identical with b) and determining x based on numerical values a, b for the shorter side as below.

$$x=b/a$$

As described above, x is determined for the particles by the number of about 200 and those capable of satisfying the relation: x (average)≧1.5 as an average value x is defined as a flake shape. The relation is preferably: 30≧x (average)≧1.5 and, more preferably, 15≧x (average)≧1.5. By the way, needle-like is expressed as 1≦x (average)<1.5.

In the flake shaped particle, a can be regarded as a thickness of a tabular particle having a main plate with b and c being as the sides. a in average is preferably 0.01 μm to 0.3 μm and, more preferably, 0.1 μm to 0.23 μm. c/b in average is preferably 1 to 9, more preferably 1 to 6, further preferably 1 to 4 and, most preferably 1 to 3.

By controlling the equivalent spherical diameter to 0.05 μm to 1 μm, it causes less agglomeration in the photothermographic material and image storability is improved. The equivalent spherical diameter is preferably 0.1 μm to 1 μm.

In the invention, an equivalent spherical diameter can be measured by a method of photographing a sample directly by using an electron microscope and then image processing the negative images.

In the flake shaped particle, the equivalent spherical diameter of the particle/a is defined as an aspect ratio. The aspect ratio of the flake particle is, preferably, 1.1 to 30 and, more preferably, 1.1 to 15 with a viewpoint of causing less agglomeration in the photothermographic material and improving the image storability.

As the particle size distribution of the organic silver salt, monodispersion is preferred. In the monodispersion, the percentage for the value obtained by dividing the standard deviation for the length of minor axis and major axis by the minor axis and the major axis respectively is, preferably, 100% or less, more preferably, 80% or less and, further preferably, 50% or less. The shape of the organic silver salt can be measured by analyzing a dispersion of an organic silver salt as transmission type electron microscopic images. Another method of measuring the monodispersion is a method of determining of the standard deviation of the volume weighted mean diameter of the organic silver salt in which the percentage for the value defined by the volume weight mean diameter (variation coefficient), is preferably, 100% or less, more preferably, 80% or less and, further preferably, 50% or less. The monodispersion can be determined from particle size (volume weighted mean diameter) obtained, for example, by a measuring method of irradiating a laser beam to organic silver salts dispersed in a liquid, and determining a self correlation function of the fluctuation of scattered light to the change of time.

3) Preparation

Methods known in the art may be applied to the method for producing the organic silver salt used in the invention and to the dispersing method thereof. For example, reference can be made to JP-A No. 10-62899, EP Nos. 0803763A1 and 0962812A1, JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870, and 2002-107868, and the like.

When a photosensitive silver salt is present together during dispersion of the organic silver salt, fog increases and sensitivity becomes remarkably lower, so that it is more preferred that the photosensitive silver salt is not substantially contained during dispersion. In the invention, the amount of the photosensitive silver salt to be disposed in the aqueous dispersion, is preferably, 1 mol % or less, more preferably, 0.1 mol % or less per 1 mol of the organic acid silver salt in the solution and, further preferably, positive addition of the photosensitive silver salt is not conducted.

In the invention, the photosensitive material can be prepared by mixing an aqueous dispersion of an organic silver salt and an aqueous dispersion of a photosensitive silver salt and the mixing ratio between the organic silver salt and the photosensitive silver salt can be selected depending on the purpose. The ratio of the photosensitive silver salt to the organic silver salt is, preferably, in a range from 1 mol % to 30 mol %, more preferably, from 2 mol % to 20 mol % and, particularly preferably, 3 mol % to 15 mol %. A method of mixing two or more kinds of aqueous dispersions of organic silver salts and two or more kinds of aqueous dispersions of photosensitive silver salts upon mixing is used preferably for controlling the photographic properties.

4) Addition Amount

While an organic silver salt in the invention can be used in a desired amount, a total amount of coated silver including silver halide is preferably in a range from 0.1 $g/m^2$ to 3.0 $g/m^2$, more preferably from 0.5 $g/m^2$ to 2.0 $g/m^2$, and further preferably from 0.8 $g/m^2$ to 1.7 $g/m^2$. Particularly, in order to improve image storability, the total amount of coated silver is preferably 1.5 $mg/m^2$ or less, and more preferably 1.3 $mg/m^2$ or less.

When a preferable reducing agent in the invention is used, it is possible to obtain a sufficient image density by even such a low amount of silver.

(Reducing Agent for Non-photosensitive Organic Silver Salt)

The photothermographic material of the invention contains a reducing agent for the organic silver salt. The reducing agent may be any substance (preferably, organic substance) capable of reducing silver ions into metallic silver. Examples of the reducing agent are described in JP-A No. 11-65021 (column Nos. 0043 to 0045) and EP No. 0803764A1 (page 7, line 34 to page 18, line 12).

In the invention, a so-called hindered phenolic reducing agent or a bisphenol reducing agent having a substituent at the ortho-position to the phenolic hydroxy group is preferred. The compound represented by the following formula (R) is more preferred.

Formula (R)

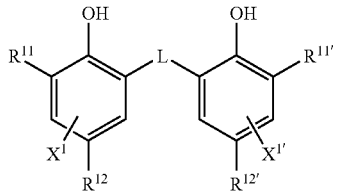

In formula (R), $R^{11}$ and $R^{11'}$ each independently represent an alkyl group having 1 to 20 carbon atoms. $R^{12}$ and $R^{12'}$ each independently represent a hydrogen atom or a substituent capable of substituting for a hydrogen atom on a benzene ring. L represents an —S— group or a —$CHR^{13}$— group. $R^{13}$ represents a hydrogen atom or an alkyl group having 1 to 20 carbon atoms. $X^1$ and $X^{1'}$ each independently represent a hydrogen atom or a group capable of substituting for a hydrogen atom on a benzene ring.

Formula (R) is to be Described in Detail.

1) $R^{11}$ and $R^{11'}$ $R^{11}$ and $R^{11'}$ each independently represent a substituted or unsubstituted alkyl group having 1 to 20 carbon atoms. The substituent for the alkyl group has no particular restriction and can include, preferably, an aryl group, a hydroxy group, an alkoxy group, an aryloxy group, an alkylthio group, an arylthio group, an acylamino group, a sulfonamide group, a sulfonyl group, a phosphoryl group, an acyl group, a carbamoyl group, an ester group, an ureido group, an urethane group, and a halogen atom.

2) $R^{12}$ and $R^{12'}$, $X^1$ and $X^{1'}$ $R^{12}$ and $R^{12'}$ each independently represent a hydrogen atom or a group capable of substituting for a hydrogen atom on a benzene ring. $X^1$ and $X^{1'}$ each independently represent a hydrogen atom or a group capable of substituting for a hydrogen atom on a benzene ring. Each of the groups capable of substituting for a hydrogen atom on the benzene ring can include, preferably, an alkyl group, an aryl group, a halogen atom, an alkoxy group, and an acylamino group.

3) L

L represents an —S— group or a —$CHR^{13}$— group. $R^{13}$ represents a hydrogen atom or an alkyl group having 1 to 20 carbon atoms in which the alkyl group may have a substituent. Specific examples of the unsubstituted alkyl group for $R^{13}$ can include, for example, a methyl group, an ethyl group, a propyl group, a butyl group, a heptyl group, an undecyl group, an isopropyl group, a 1-ethylpentyl group, a 2,4,4-trimethylpentyl group, a cyclohexyl group, a 2,4-dimetyl-3-cyclohexenyl group, a 3,5-dimethyl-3-cyclohexenyl group, and the like. Examples of the substituent for the alkyl group can include, similar to substituent of $R^{11}$, a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group, a sulfamoyl group, and the like.

4) Preferred Subsituents $R^{11}$ and $R^{11'}$ are, preferably, a primary, secondary or tertiary alkyl group having 1 to 15 carbon atoms and can include, specifically, a methyl group, an isopropyl group, a t-butyl group, a t-amyl group, a t-octyl group, a cyclohexyl group, a cyclopentyl group, a 1-methylcyclohexyl group, a 1-methylcyclopropyl group and the like. $R^{11}$ and $R^{11'}$ each represent, more preferably, an alkyl group having 1 to 8 carbon atoms and, among them, a methyl group, a t-butyl group, a t-amyl group, and a 1-methylcyclohexyl group are further preferred and, and a methyl group and a t-butyl group being most preferred.

$R^{12}$ and $R^{12'}$ are, preferably, an alkyl group having 1 to 20 carbon atoms and can include, specifically, a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, a methoxyethyl group and the like. More preferred are a methyl group, an ethyl group, a propyl group, an isopropyl group, and a t-butyl group, and particularly preferred are a methyl group and an ethyl group.

$X^1$ and $X^{1'}$ are, preferably, a hydrogen atom, a halogen atom, or an alkyl group, and more preferably, a hydrogen atom.

L is preferably a —$CHR^{13}$— group.

$R^{13}$ is preferably a hydrogen atom or an alkyl group having 1 to 15 carbon atoms. The alkyl group is preferably a chain or a cyclic alkyl group. And, a group which has a C=C bond in these alkyl group is also preferably used. Preferable examples of the alkyl group can include a methyl group, an ethyl group, a propyl group, an isopropyl group, a 2,4,4-trimethylpentyl group, a cyclohexyl group, a 2,4-dimethyl-3-cyclohexenyl group, a 3,5-dimetyl-3-cyclohexenyl group and the like. Particularly preferable $R^{13}$ is a hydrogen atom, a methyl group, an ethyl group, a propyl group, an isopropyl group, or a 2,4-dimethyl-3-cyclohexenyl group.

In the case where $R^{11}$ and $R^{11'}$ are a tertiary alkyl group and $R^{12}$ and $R^{12'}$ are a methyl group, $R^{13}$ is preferably a primary or secondary alkyl group having 1 to 8 carbon atoms (a methyl group, an ethyl group, a propyl group, an isopropyl group, a 2,4-dimethyl-3-cyclohexenyl group, or the like).

In the case where $R^{11}$ and $R^{11'}$ are tertiary alkyl group and $R^{12}$ and $R^{12'}$ are an alkyl group other than a methyl group, $R^{13}$ is preferably a hydrogen atom.

In the case where $R^{11}$ and $R^{11'}$ are not a tertiary alkyl group, $R^{13}$ is preferably a hydrogen atom or a secondary alkyl group, and particularly preferably a secondary alkyl group. As the secondary alkyl group for $R^{13}$, an isopropyl group and a 2,4-dimethyl-3-cyclohexenyl group are preferred.

The reducing agent described above shows different thermal developing performances, color tones of developed silver images, or the like depending on the combination of $R^{11}$, $R^{11'}$, $R^{12}$, $R^{12'}$, and $R^{13}$. Since these performances can be controlled by using two or more kinds of reducing agents at various mixing ratios, it is preferred to use two or more kinds of reducing agents in combination depending on the purpose.

Specific examples of the reducing agents of the invention including the compounds represented by formula (R) according to the invention are shown below, but the invention is not restricted to them.

R-1

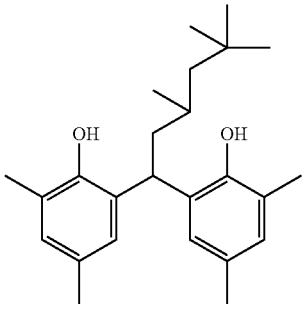

R-2

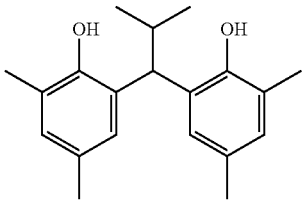

R-3

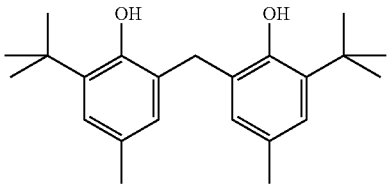

-continued

R-4

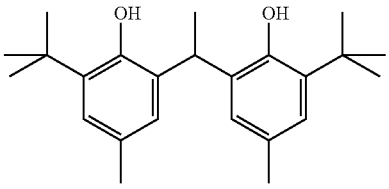

R-5

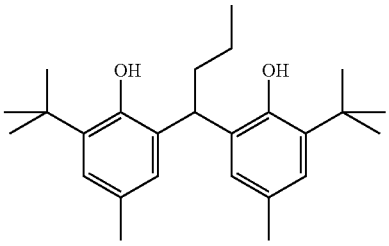

R-6

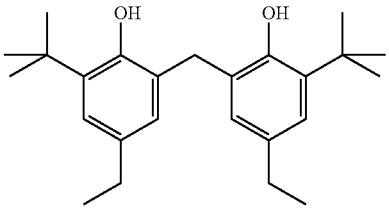

R-7

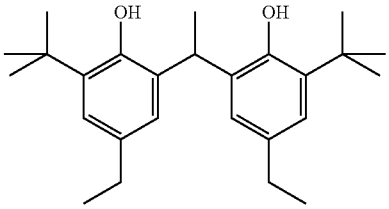

R-8

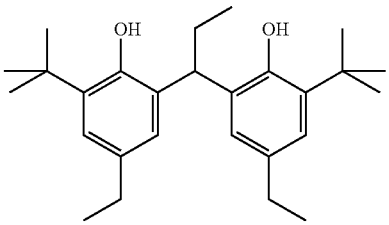

R-9

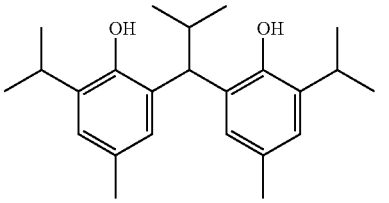

R-10

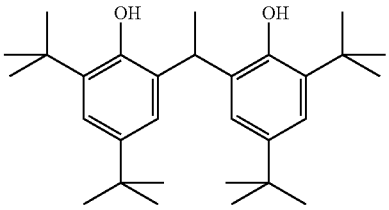

-continued

R-11

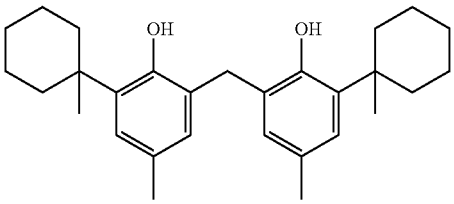

R-12

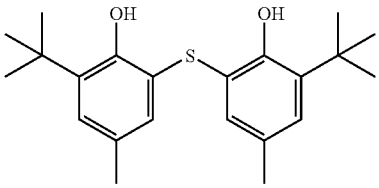

R-13

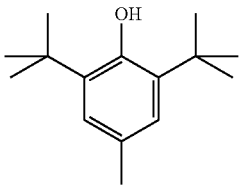

R-14

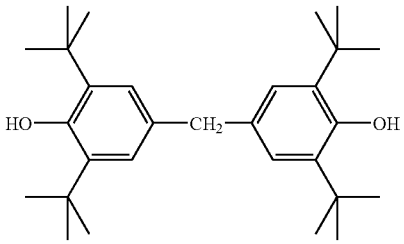

R-15

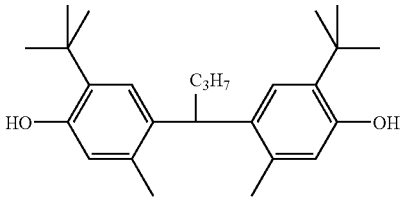

R-16

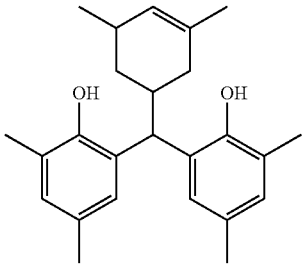

R-17

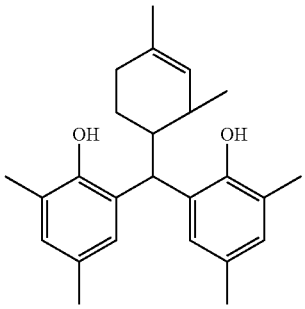

-continued

R-18

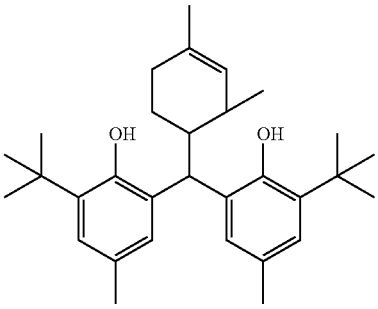

As preferred reducing agents of the invention other than those above, there can be mentioned compounds disclosed in JP-A Nos. 2001-188314, 2001-209145, 2001-350235, and 2002-156727, and EP No. 1278101A2.

In the invention, the addition amount of the reducing agent is, preferably, from 0.1 g/m$^2$ to 3.0 g/m$^2$, more preferably, 0.2 g/m$^2$ to 1.5 g/m$^2$ and, further preferably 0.3 g/m$^2$ to 1.0 g/m$^2$. It is preferably contained in a range of 5 mol % to 50 mol %, more preferably, 8 mol % to 30 mol % and, further preferably, 10 mol % to 20 mol % per 1 mol of silver in the image forming layer. The reducing agent of the invention is preferably contained in the image forming layer.

In the invention, the reducing agent may be incorporated into photothermographic material by being added into the coating solution, such as in the form of solution, emulsion dispersion, solid fine particle dispersion, and the like.

As a well known emulsion dispersing method, there can be mentioned a method comprising dissolving the reducing agent using an oil such as dibutyl phthalate, tricresyl phosphate, glyceryl triacetate, diethyl phthalate, or the like, as well as an auxiliary solvent such as ethyl acetate, cyclohexanone, or the like; from which an emulsion dispersion is mechanically produced.

As solid fine particle dispersing method, there can be mentioned a method comprising dispersing the powder of the reducing agent in a proper medium such as water, by means of ball mill, colloid mill, vibrating ball mill, sand mill, jet mill, roller mill, or ultrasonics, thereby obtaining solid dispersion. In this case, there can also be used a protective colloid (such as polyvinyl alcohol), or a surfactant (for instance, an anionic surfactant such as sodium triisopropylnaphthalenesulfonate (a mixture of compounds having the isopropyl groups in different substitution sites)). In the mills enumerated above, generally used as the dispersion media are beads made of zirconia and the like, and Zr and the like eluting from the beads may be incorporated in the dispersion. Although depending on the dispersing conditions, the amount of Zr and the like generally incorporated in the dispersion is in the range from 1 ppm to 1000 ppm. It is practically acceptable so long as Zr is incorporated in an amount of 0.5 mg or less per 1 g of silver.

Preferably, an antiseptic (for instance, benzisothiazolinone sodium salt) is added in the water dispersion.

In the invention, furthermore, the reducing agent is preferably used as a solid particle dispersion, and the reducing agent is added in the form of fine particles having mean particle size from 0.01 μm to 10 μm, and more preferably, from 0.05 μm to 5 μm, and further preferably, from 0.1 μm to 2 μm. In the invention, other solid dispersions are preferably used with this particle size range.

(Photosensitive Silver Halide)

1) Halogen Composition

For the photosensitive silver halide used in the invention, there is no particular restriction on the halogen composition and silver chloride, silver bromochloride, silver bromide, silver iodobromide, silver iodochlorobromide and silver iodide can be used. Among them, silver bromide, silver iodobromide and silver iodide are preferred. The distribution of the halogen composition in a grain may be uniform or the halogen composition may be changed stepwise, or it may be changed continuously. Further, a silver halide grain having a core/shell structure can be used preferably. Preferred structure is a twofold to fivefold structure and, more preferably, core/shell grain having a twofold to fourfold structure can be used. Further, a technique of localizing silver bromide or silver iodide to the surface of a silver chloride, silver bromide or silver chlorobromide grains can also be used preferably.

2) Method of Grain Formation

The method of forming photosensitive silver halide is well-known in the relevant art and, for example, methods described in Research Disclosure No. 10729, June 1978 and U.S. Pat. No. 3,700,458 can be used. Specifically, a method of preparing a photosensitive silver halide by adding a silver-supplying compound and a halogen-supplying compound in a gelatin or other polymer solution and then mixing them with an organic silver salt is used. Further, a method described in JP-A No. 11-119374 (paragraph Nos. 0217 to 0224) and methods described in JP-A Nos. 11-352627 and 2000-347335 are also preferred.

3) Grain Size

The grain size of the photosensitive silver halide is preferably small with an aim of suppressing clouding after image formation and, specifically, it is 0.20 μm or less, more preferably, 0.01 μm to 0.15 μm and, further preferably, 0.02 μm to 0.12 μm. The grain size as used herein means an average diameter of a circle converted such that it has a same area as a projected area of the silver halide grain (projected area of a main plane in a case of a tabular grain).

4) Grain Shape

The shape of the silver halide grain can include, for example, cubic, octahedral, tabular, spherical, rod-like or potato-like shape. The cubic grain is particularly preferred in the invention. A silver halide grain rounded at corners can also be used preferably. The surface indices (Miller indices) of the outer surface of a photosensitive silver halide grain is not particularly restricted, and it is preferable that the ratio occupied by the [100] face is large, because of showing high spectral sensitization efficiency when a spectral sensitizing dye is adsorbed. The ratio is preferably 50% or more, more preferably, 65% or more and, further preferably, 80% or more. The ratio of the [100] face, Miller indices, can be determined by a method described in T. Tani; J. Imaging Sci., vol. 29, page 165, (1985) utilizing adsorption dependency of the [111] face and [100] face in adsorption of a sensitizing dye.

5) Heavy Metal

The photosensitive silver halide grain of the invention can contain metals or complexes of metals belonging to groups 3 to 11 of the periodic table (showing groups 1 to 18). Preferred are metals or complexes of metals belonging to groups 8 to 10. The metal or the center metal of the metal complex from groups 8 to 10 of the periodic table is preferably ferrum, rhodium, ruthenium or iridium. The metal complex may be used alone, or two or more kinds of complexes comprising identical or different species of metals may be used together. A preferred content is in a range from $1\times10^{-9}$ mol to $1\times10^{-3}$ mol per 1 mol of silver. The heavy metals, metal complexes and the adding method thereof are described in JP-A No. 7-225449, in paragraph Nos. 0018 to 0024 of JP-A No. 11-65021 and in paragraph Nos. 0227 to 0240 of JP-A No. 11-119374.

In the present invention, a silver halide grain having a hexacyano metal complex present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. In the invention, hexacyano Fe complex is preferred.

Since the hexacyano complex exists in ionic form in an aqueous solution, paired cation is not important and alkali metal ion such as sodium ion, potassium ion, rubidium ion, cesium ion and lithium ion, ammonium ion, alkyl ammonium ion (for example, tetramethyl ammonium ion, tetraethyl ammonium ion, tetrapropyl ammonium ion, and tetra (n-butyl) ammonium ion), which are easily miscible with water and suitable to precipitation operation of a silver halide emulsion are preferably used.

The hexacyano metal complex can be added while being mixed with water, as well as a mixed solvent of water and an appropriate organic solvent miscible with water (for example, alcohols, ethers, glycols, ketones, esters, or amides) or gelatin.

The addition amount of the hexacyano metal complex is preferably from $1\times10^{-5}$ mol to $1\times10^{-2}$ mol and, more preferably, from $1\times10^{-4}$ mol to $1\times10^{-3}$ per 1 mol of silver in each case.

In order to allow the hexacyano metal complex to be present on the outermost surface of a silver halide grain, the hexacyano metal complex is directly added in any stage of: after completion of addition of an aqueous solution of silver nitrate used for grain formation, before completion of emulsion formation step prior to a chemical sensitization step, of conducting chalcogen sensitization such as sulfur sensitization, selenium sensitization and tellurium sensitization or noble metal sensitization such as gold sensitization, during a washing step, during a dispersion step and before a chemical sensitization step. In order not to grow fine silver halide grains, the hexacyano metal complex is rapidly added preferably after the grain is formed, and it is preferably added before completion of the emulsion formation step.

Addition of the hexacyano complex may be started after addition of 96% by weight of an entire amount of silver nitrate to be added for grain formation, more preferably started after addition of 98% by weight and, particularly preferably, started after addition of 99% by weight.

When any of the hexacyano metal complex is added after addition of an aqueous silver nitrate just before completion of grain formation, it can be adsorbed to the outermost surface of the silver halide grain and most of them form an insoluble salt with silver ions on the surface of the grain. Since the hexacyano iron (II) silver salt is a less soluble salt than AgI, re-dissolution with fine grains can be prevented and fine silver halide grains with smaller grain size can be prepared.

Metal atoms that can be contained in the silver halide grain used in the invention (for example, $[Fe(CN)_6]^{4-}$), desalting method of a silver halide emulsion and chemical sensitizing method are described in paragraph Nos. 0046 to 0050 of JP-A No. 11-84574, in paragraph Nos. 0025 to 0031 of JP-A No. 11-65021, and paragraph Nos. 0242 to 0250 of JP-A No. 11-119374.

6) Gelatin

As the gelatin contained the photosensitive silver halide emulsion used in the invention, various kinds of gelatins can be used. It is necessary to maintain an excellent dispersion state of a photosensitive silver halide emulsion in an organic silver salt containing coating solution, and gelatin having a molecular weight of 10,000 to 1,000,000 is preferably used. Phthalated gelatin is also preferably used. These gelatins may be used at grain formation step or at the time of dispersion after desalting treatment and it is preferably used at grain formation step.

7) Sensitizing Dye

As the sensitizing dye applicable in the invention, those capable of spectrally sensitizing silver halide grains in a desired wavelength region upon adsorption to silver halide grains having spectral sensitivity suitable to the spectral characteristic of an exposure light source can be advantageously selected. The sensitizing dyes and the adding method are disclosed, for example, JP-A No. 11-65021 (paragraph Nos. 0103 to 0109), as a compound represented by the formula (II) in JP-A No. 10-186572, dyes represented by the formula (I) in JP-A No. 11-119374 (paragraph No. 0106), dyes described in U.S. Pat. Nos. 5,510,236 and 3,871,887 (Example 5), dyes disclosed in JP-A Nos. 2-96131 and 59-48753, as well as in page 19, line 38 to page 20, line 35 of EP No. 0803764A1, and in JP-A Nos. 2001-272747, 2001-290238 and 2002-23306. The sensitizing dyes described above may be used alone or two or more of them may be used in combination. In the invention, sensitizing dye can be added preferably after desalting step and before coating step, and more preferably after desalting step and before the completion of chemical ripening.

In the invention, the sensitizing dye may be added at any amount according to the property of sensitivity and fogging, but it is preferably added from $10^{-6}$ mol to 1 mol, and more preferably from $10^{-4}$ mol to $10^{-1}$ mol, per 1 mol of silver halide in the image forming layer.

The photothermographic material of the invention may also contain super sensitizers in order to improve the spectral sensitizing effect.

The super sensitizers usable in the invention can include those compounds described in EP-A No. 587338, U.S. Pat. Nos. 3,877,943 and 4,873,184, JP-A Nos. 5-341432, 11-109547, and 10-111543, and the like.

8) Chemical Sensitization

The photosensitive silver halide grain in the invention is preferably chemically sensitized by sulfur sensitizing method, selenium sensitizing method or tellurium sensitizing method. As the compound used preferably for sulfur sensitizing method, selenium sensitizing method and tellurium sensitizing method, known compounds, for example, compounds described in JP-A No. 7-128768 can be used. Particularly, tellurium sensitization is preferred in the invention and compounds described in the literature cited in paragraph No. 0030 in JP-A No. 11-65021 and compounds shown by formulae (II), (III), and (IV) in JP-A No. 5-313284 are preferred.

The photosensitive silver halide grain in the invention is preferably chemically sensitized by gold sensitizing method alone or in combination with the chalcogen sensitization described above. As the gold sensitizer, those having an oxidation number of gold of either +1 or +3 are preferred and those gold compounds used usually as the gold sensitizer are preferred. As typical examples, chloroauric acid, bromoauric acid, potassium chloroaurate, potassium bromoaurate, auric trichloride, potassium auric thiocyanate, potassium iodoaurate, tetracyanoauric acid, ammonium aurothiocyanate and pyridyl trichloro gold are preferred. Further, gold sensitizers described in U.S. Pat. No. 5,858,637 and JP-A No. 2002-278016 are also used preferably.

In the invention, chemical sensitization can be applied at any time so long as it is after grain formation and before coating and it can be applied, after desalting, (1) before spectral sensitization, (2) simultaneously with spectral sensitization, (3) after spectral sensitization and (4) just before coating.

The amount of sulfur, selenium and tellurium sensitizer used in the invention may vary depending on the silver halide grain used, the chemical ripening condition and the like and it is used by about $10^{-8}$ mol to $10^{-2}$ mol, preferably, $10^{-7}$ mol to $10^{-3}$ mol, per 1 mol of silver halide.

The addition amount of the gold sensitizer may vary depending on various conditions and it is generally about $10^{-7}$ mol to $10^{-3}$ mol and, more preferably, $10^{-6}$ mol to $5\times10^{-4}$ mol, per 1 mol of silver halide.

There is no particular restriction on the condition for the chemical sensitization in the invention and, appropriately, the pH is 5 to 8, the pAg is 6 to 11, and the temperature is at 40° C. to 95° C.

In the silver halide emulsion used in the invention, a thiosulfonic acid compound may be added by the method shown in EP-A No. 293917.

A reductive compound is used preferably for the photosensitive silver halide grain in the invention. As the specific compound for the reduction sensitization, ascorbic acid or thiourea dioxide is preferred, as well as use of stannous chloride, aminoimino methane sulfonic acid, hydrazine derivatives, borane compounds, silane compounds and polyamine compounds are preferred. The reduction sensitizer may be added at any stage in the photosensitive emulsion production process from crystal growth to a preparation step just before coating. Further, it is preferred to apply reduction sensitization by ripening while keeping the pH to 7 or higher or the pAg to 8.3 or lower for the emulsion, and it is also preferred to apply reduction sensitization by introducing a single addition portion of silver ions during grain formation.

9) Compound that can be One-Electron-Oxidized to Provide a One-Electron Oxidation Product which Releases One or More Electrons The photothermographic material of the invention preferably contains a compound that can be one-electron-oxidized to provide a one-electron oxidation product which releases one or more electrons. The said compound can be used alone or in combination with various chemical sensitizers described above to increase the sensitivity of silver halide.

As the compound that can be one-electron-oxidized to provide a one-electron oxidation product which releases one or more electrons is a compound selected from the following Groups 1 and 2.

(Group 1) a compound that can be one-electron-oxidized to provide a one-electron oxidation product which further releases one or more electrons, due to being subjected to a subsequent bond cleavage reaction;

(Group 2) a compound that can be one-electron-oxidized to provide a one-electron oxidation product, which further releases one or more electrons after being subjected to a subsequent bond formation.

The compound of Group 1 will be explained below.

In the compound of Group 1, as for a compound that can be one-electron-oxidized to provide a one-electron oxidation product which further releases one electron, due to being subjected to a subsequent bond cleavage reaction, specific examples include examples of compound referred to as "one photon two electrons sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV 1 to 36); JP-W No. 2001-500996 (Compound 1 to 74, 80 to 87, and 92 to 122); U.S. Pat. Nos. 5,747,235 and 5,747,236; EP No. 786692A1 (Compound INV 1 to 35); EP No. 893732A1; U.S. Pat. Nos. 6,054,260 and 5,994,051; etc. Preferred ranges of these compounds are the same as the preferred ranges described in the quoted specifications.

In the compound of Group 1, as for a compound that can be one-electron-oxidized to provide a one-electron oxidation product which further releases one or more electrons, due to being subjected to a subsequent bond cleavage reaction, specific examples include the compounds represented by formula (1) (same as formula (1) described in JP-A No. 2003-114487), formula (2) (same as formula (2) described in JP-A No. 2003-114487), formula (3) (same as formula (1) described in JP-A No. 2003-114488), formula (4) (same as formula (2) described in JP-A No. 2003-114488), formula (5) (same as formula (3) described in JP-A No. 2003-114488), formula (6) (same as formula (1) described in JP-A No. 2003-75950), formula (7) (same as formula (2) described in JP-A No. 2003-75950), and formula (8), and the compound represented by formula (9) among the compounds which can undergo the chemical reaction represented by reaction formula (1). And the preferable range of these compounds is the same as the preferable range described in the quoted specification.

Formula (1)

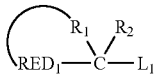

Formula (2)

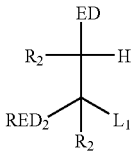

Formula (3)

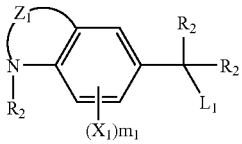

Formula (4)

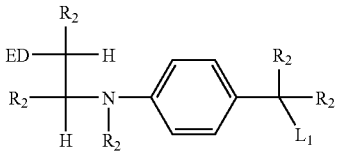

Formula (5)

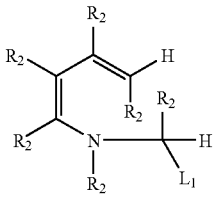

-continued

Formula (6)

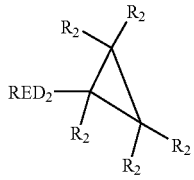

Formula (7)

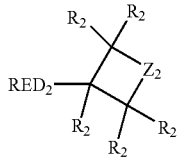

Formula (8)

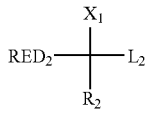

Reaction formula (1)

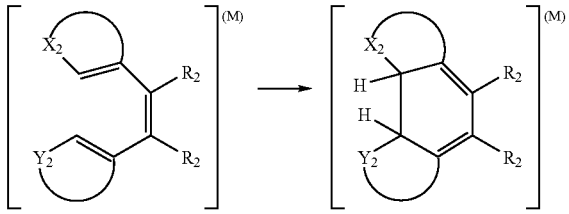

Formula (9)

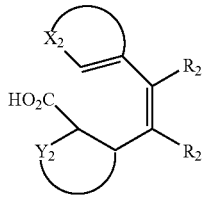

In the formulae, $RED_1$ and $RED_2$ represent a reducible group. $R_1$ represents a nonmetallic atomic group forming a cyclic structure equivalent to a tetrahydro derivative or an octahydro derivative of a 5 or 6-membered aromatic ring (including a hetero aromatic ring) with a carbon atom (C) and $RED_1$. $R_2$ represents a hydrogen atom or a substituent. In the case where plural $R_2$s exist in a same molecule, these may be identical or different from each other. $L_1$ represents a leaving group. ED represents an electron-donating group. $Z_1$ represents an atomic group capable to form a 6-membered ring with a nitrogen atom and two carbon atoms of a benzene ring. $X_1$ represents a substituent, and $m_1$ represents an integer of 0 to 3. $Z_2$ represents one selected from —$CR_{11}R_{12}$—, —$NR_{13}$—, or —O—. $R_{11}$ and $R_{12}$ each independently represent a hydrogen atom or a substituent. $R_{13}$ represents one selected from a hydrogen atom, an alkyl group, an aryl group, and a heterocyclic group. $X_1$ represents one selected from an alkoxy group, an aryloxy group, a heterocyclic oxy group, an alkylthio group, an arylthio group, a heterocyclic thio group, an alkylamino group, an arylamino group, and a heterocyclic amino group. $L_2$ represents a carboxyl group or a salt thereof, or a hydrogen atom. $X_2$ represents a group to form a 5-membered heterocycle with C═C. M represents one selected from a radical, a radical cation, and a cation.

Next, the compound of Group 2 is explained.

In the compound of Group 2, as for a compound that can be one-electron-oxidized to provide a one-electron oxidation product which further releases one or more electrons, after being subjected to a subsequent bond cleavage reaction, specific examples can include the compound represented by formula (10) (same as formula (1) described in JP-A No. 2003-140287), and the compound represented by formula (11) which can undergo the chemical reaction represented by reaction formula (1). The preferable range of these compounds is the same as the preferable range described in the quoted specification.

Formula (10)

$$X—L_2—Y$$

Reaction formula (1)

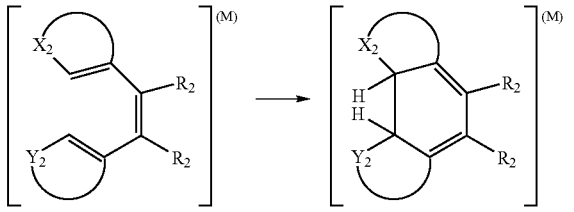

Formula (11)

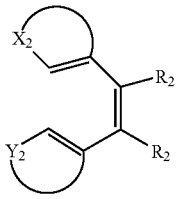

In the formulae described above, X represents a reducible group which can be one-electron-oxidized. Y represents a reactive group containing a carbon-carbon double bond part, a carbon-carbon triple bond part, an aromatic group part or benzo-condensed nonaromatic heterocyclic group which can react with one-electron-oxidized product formed by one-electron-oxidation of X to form a new bond. $L_2$ represents a linking group to link X and Y. $R_2$ represents a hydrogen atom or a substituent. In the case where plural $R_2$s exist in a same molecule, these may be identical or different from each other. $X_2$ represents a group to form a 5-membered heterocycle with C═C $Y_2$ represents a group to form a 5 or 6-membered aryl group or heterocyclic group with C═C. M represents one selected from a radical, a radical cation, and a cation.

The compounds of Groups 1 and 2 preferably are "the compound having an adsorptive group to silver halide in a molecule" or "the compound having a partial structure of a spectral sensitizing dye in a molecule". The representative adsorptive group to silver halide is the group described in JP-A No. 2003-156823, page 16 right, line 1 to page 17 right, line 12. A partial structure of a spectral sensitizing dye is the structure described in JP-A No. 2003-156823, page 17 right, line 34 to page 18 right, line 6.

As the compound of Groups 1 and 2, "the compound having at least one adsorptive group to silver halide in a molecule" is more preferred, and "the compound having two or more adsorptive groups to silver halide in a molecule" is further preferred. In the case where two or more adsorptive groups exist in a single molecule, those adsorptive groups may be identical or different with each other.

As preferable adsorptive group, a nitrogen containing heterocyclic group substituted by a mercapto group (e.g., a 2-mercaptothiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzothiazole group, a 1,5-dimethyl-1,2,4-triazolium-3-thiolate group, or the like) or a nitrogen containing heterocyclic group having —NH— group as a partial structure of heterocycle capable to form a silver imidate (>NAg) (e.g., a benzotriazole group, a benzimidazole group, an indazole group, or the like) are described. A 5-mercaptotetrazole group, a 3-mercapto-1,2,4-triazole group and a benzotriazole group are particularly preferable and a 3-mercapto-1,2,4-triazole group and a 5-mercaptotetrazole group are most preferable.

As an adsorptive group, the group which has two or more mercapto groups as a partial structure in a molecule is also particularly preferable. Herein, a mercapto group (—SH) may become a thione group in the case where it can tautomerize. Preferred examples of an adsorptive group having two or more mercapto groups as a partial structure (dimercapto-substituted nitrogen containing heterocyclic group and the like) are a 2,4-dimercaptopyrimidine group, a 2,4-dimercaptotriazine group and a 3,5-dimercapto-1,2,4-triazole group.

Further, a quaternary salt structure of nitrogen or phosphorus is also preferably used as an adsorptive group. As typical quaternary salt structure of nitrogen, an ammonio group (a trialkylammonio group, a dialkylarylammonio group, a dialkylheteroarylammonio group, an alkyldiarylammonio group, an alkyldiheteroarylammonio group, or the like) and a nitrogen containing heterocyclic group containing quaternary nitrogen atom can be used. As a quaternary salt structure of phosphorus, a phosphonio group (a trialkylphosphonio group, a dialkylarylphosphonio group, a dialkylheteroarylphosphonio group, an alkyldiarylphosphonio group, an alkyldiheteroarylphosphonio group, a triarylphosphonio group, a triheteroarylphosphonio group, or the like) is described. A quaternary salt structure of nitrogen is more preferably used and a 5 or 6-membered aromatic heterocyclic group containing a quaternary nitrogen atom is further preferably used. Particularly preferably, a pyrydinio group, a quinolinio group and an isoquinolinio group are used. These nitrogen containing heterocyclic groups containing a quaternary nitrogen atom may have any substituent.

Examples of counter anions of quaternary salt are a halogen ion, carboxylate ion, sulfonate ion, sulfate ion, perchlorate ion, carbonate ion, nitrate ion, $BF_4^-$, $PF_6^-$, $Ph_4B^-$, and the like. In the case where the group having negative charge at carboxylate group and the like exists in a molecule, an inner salt may be formed with it. As a counter ion outside of a molecule, chloro ion, bromo ion and methanesulfonate ion are particularly preferable.

The preferred structure of the compound represented by Groups 1 and 2 having a quaternary salt of nitrogen or phosphorus as an adsorptive group is represented by formula (X).

$$(P\text{-}Q_1\text{-})_i\text{-}R\ (\text{-}Q_2\text{-}S)_j \qquad \text{Formula (X)}$$

In formula (X), P and R each independently represent a quaternary salt structure of nitrogen or phosphorus, which is not a partial structure of a spectral sensitizing dye. $Q_1$ and $Q_2$ each independently represent a linking group and typically represent a single bond, an alkylene group, an arylene group, a heterocyclic group, —O—, —S—, —$NR_N$—, —C(═O)—, —$SO_2$—, —SO—, —P(═O)— and the group which consists of combination of these groups. Herein, $R_N$ represents one selected from a hydrogen atom, an alkyl group, an aryl group, and a heterocyclic group. S represents a residue which is obtained by removing one atom from the compound represented by Group 1 or 2. i and j are an integer of one or more and are selected in a range of i+j=2 to 6. The case where i is 1 to 3 and j is 1 to 2 is preferable, the case where i is 1 or 2 and j is 1 is more preferable, and the case where i is 1 and j is 1 is particularly preferable. The compound represented by formula (X) preferably has 10 to 100 carbon atoms in total, more preferably 10 to 70 carbon atoms, further preferably 11 to 60 carbon atoms, and particularly preferably 12 to 50 carbon atoms in total.

The compounds of Groups 1 and 2 may be used at any time during preparation of the photosensitive silver halide emulsion and production of the photothermographic material. For example, the compound may be used in a photosensitive silver halide grain formation step, in a desalting step, in a chemical sensitization step, and before coating, etc. The compound may be added in several times, during these steps. The compound is preferably added after the photosensitive silver halide grain formation step and before the desalting step; in the chemical sensitization step (just before the chemical sensitization to immediately after the chemical sensitization); or before coating. The compound is more preferably added, just before the chemical sensitization step to before mixing with the non-photosensitive organic silver salt.

It is preferred that the compound of Groups 1 and 2 used in the invention is dissolved in water, a water-soluble solvent such as methanol and ethanol, or a mixed solvent thereof. In the case where the compound is dissolved in water and solubility of the compound is increased by increasing or decreasing a pH value of the solvent, the pH value may be increased or decreased to dissolve and add the compound.

The compound of Groups 1 and 2 used in the invention is preferably used to the image forming layer comprising the photosensitive silver halide and the non-photosensitive organic silver salt. The compound may be added to a surface protective layer, or an intermediate layer, as well as the image forming layer comprising the photosensitive silver halide and the non-photosensitive organic silver salt, to be diffused to the image forming layer in the coating step. The compound may be added before or after addition of a sensitizing dye. Each compound is contained in the image forming layer preferably in an amount of $1\times10^{-9}$ mol to $5\times10^{-1}$ mol, more preferably $1\times10^{-8}$ mol to $5\times10^{-2}$ mol, per 1 mol of silver halide.

10) Compound Having Adsorptive Group and Reducible Group

The photothermographic material of the present invention preferably comprises a compound having an adsorptive group and a reducible group in a molecule. It is preferred that the compound having an adsorptive group and a reducible group used in the invention is represented by the following formula (I).

A-(W)n-B Formula (I)

In formula (I), A represents a group capable of adsorption to a silver halide (hereafter, it is called an adsorptive group), W represents a divalent linking group, n represents 0 or 1, and B represents a reducible group.

In formula (I), the adsorptive group represented by A is a group to adsorb directly to a silver halide or a group to promote adsorption to a silver halide. As typical examples, a mercapto group (or a salt thereof), a thione group (—C(═S)—), a nitrogen atom, a heterocyclic group containing at least one atom selected from a nitrogen atom, a sulfur atom, a selenium atom and a tellurium atom, a sulfide group, a disulfide group, a cationic group, an ethynyl group and the like are described.

The mercapto group as an adsorptive group means a mercapto group (and a salt thereof) itself and simultaneously more preferably represents a heterocyclic group or an aryl group or an alkyl group substituted by at least one mercapto group (or a salt thereof). Herein, as the heterocyclic group, a monocyclic or a condensed aromatic or nonaromatic heterocyclic group having at least a 5 to 7-membered ring, e.g., an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group, and the like are described. A heterocyclic group having a quaternary nitrogen atom may also be adopted, wherein a mercapto group as a substituent may dissociate to form a mesoion. As a counter ion, whereby a mercapto group forms a salt thereof, a cation such as an alkali metal, an alkali earth metal, a heavy metal and the like ($Li^+$, $Na^+$, $K^+$, $Mg^{2+}$, $Ag^+$, $Zn^{2+}$ and the like), an ammonium ion, a heterocyclic group comprising a quaternary nitrogen atom, a phosphonium ion, and the like are described.

Further, the mercapto group as an adsorptive group may become a thione group by a tautomerization.

The thione group as an adsorptive group may also contain a chain or a cyclic thioamide group, a thioureido group, a thiouretane group or a dithiocarbamate ester group.

The heterocyclic group containing at least one atom selected from a nitrogen atom, a sulfur atom, a selenium atom and a tellurium atom represents a nitrogen atom containing heterocyclic group having —NH— group, as a partial structure of heterocycle, capable to form a silver iminate (>NAg) or a heterocyclic group, having an —S— group, a —Se— group, a —Te— group or an ═N— group as a partial structure of heterocycle, and capable to coordinate to a silver ion by a chelate bonding. As the former examples, a benzotriazole group, a triazole group, an indazole group, a pyrazole group, a tetrazole group, a benzimidazole group, an imidazole group, a purine group, and the like are described. As the latter examples, a thiophene group, a thiazole group, an oxazole group, a benzothiophene group, a benzothiazole group, a benzoxazole group, a thiadiazole group, an oxadiazole group, a triazine group, a selenoazole group, a benzoselenazole group, a tellurazole group, a benzotellurazole group and the like are described.

The sulfide group or disulfide group as an adsorptive group contains all groups having "—S—" or "—S—S—" as a partial structure.

The cationic group as an adsorptive group means the group containing a quaternary nitrogen atom, such as an ammonio group or nitrogen-containing heterocyclic group including a quaternary nitrogen atom. As examples of the heterocyclic group containing a quaternary nitrogen atom, a pyridinio group, a quinolinio group, an isoquinolinio group, an imidazolio group, and the like are described.

The ethynyl group as an adsorptive group means —C≡CH group and the said hydrogen atom may be substituted.

The adsorptive group described above may have any substituent.

Further, as typical examples of an adsorptive group, the compounds described in pages 4 to 7 in the specification of JP-A No. 11-95355 are described.

As an adsorptive group represented by A in formula (I), a heterocyclic group substituted by a mercapto group (e.g., a 2-mercaptothiadiazole group, a 2-mercapto-5-aminothiadiazole group, a 3-mercapto-1,2,4-triazole group, a 5-mercaptotetrazole group, a 2-mercapto-1,3,4-oxadiazole group, a 2-mercaptobenzimidazole group, a 1,5-dimethyl-1,2,4-triazorium-3-thiolate group, a 2,4-dimercaptopyrimidine group, a 2,4- dimercaptotriazine group, a 3,5-dimercapto-1,2,4-triazole group, a 2,5-dimercapto-1,3-thiazole group, or the like). or a nitrogen atom containing heterocyclic group having a —NH— group capable to form an imino-silver (>NAg) as a partial structure of heterocycle (e.g., a benzotriazole group, a benzimidazole group, an indazole group, or the like) is preferable, and more preferable as an adsorptive group is a 2-mercaptobenzimidazole group or a 3,5-dimercapto-1,2,4-triazole group.

In formula (I), W represents a divalent linking group. The said linking group may be any divalent linking group, as far as it does not give a bad effect toward photographic properties. For example, a divalent linking group which includes a carbon atom, a hydrogen atom, an oxygen atom, a nitrogen atom, or a sulfur atom can be used. As typical examples, an alkylene group having 1 to 20 carbon atoms (e.g., a methylene group, an ethylene group, a trimethylene group, a tetramethylene group, a hexamethylene group, or the like), an alkenylene group having 2 to 20 carbon atoms, an alkynylene group having 2 to 20 carbon atoms, an arylene group having 6 to 20 carbon atoms (e.g., a phenylene group, a naphthylene group, or the like), —CO—, —$SO_2$—, —O—, —S—, —$NR_1$—, and the combination of these linking groups are described. Herein, $R_1$ represents a hydrogen atom, an alkyl group, a heterocyclic group, or an aryl group.

The linking group represented by W may have any substituent.

In formula (I), a reducible group represented by B represents the group capable to reduce a silver ion. As the examples, a formyl group, an amino group, a triple bond group such as an acetylene group, a propargyl group and the like, a mercapto group, residues which are obtained by removing one hydrogen atom from hydroxylamines, hydroxamic acids, hydroxyureas, hydroxyurethanes, hydroxysemicarbazides, reductones (reductone derivatives are contained), anilines, phenols (chroman-6-ols, 2,3-dihydrobenzofuran-5-ols, aminophenols, sulfonamidophenols and polyphenols such as hydroquinones, catechols, resorcinols, benzenetriols, bisphenols are contained), acylhydrazines, carbamoylhydrazines, 3-pyrazolidones, and the like can be described. They may have any substituent.

The oxidation potential of a reducible group represented by B in formula (I) can be measured by using the measuring method described in Akira Fujishima, "DENKIKAGAKU SOKUTEIHO" (pages 150 to 208, GIHODO SHUPPAN), and The Chemical Society of Japan, "ZIKKEN KAGAKUKOZA", 4th ed. (vol. 9, pages 282 to 344, MARUZEN). For example, the method of rotating disc voltammetry can be used; namely the sample is dissolved in the solution (methanol:pH 6.5 Britton-Robinson buffer=10%:90% (% by volume)) and after bubbling with nitrogen gas during 10 minutes the voltamograph can be measured under the condition of 1000 rotations/minute, the sweep rate 20 mV/second, at 25° C. by using a rotating disc electrode (RDE) made by glassy carbon as a working electrode, a platinum electrode as a counter electrode and a saturated calomel electrode as a reference electrode. The half wave potential (E1/2) can be calculated by that obtained voltamograph.

When a reducible group represented by B in the present invention is measured by the method described above, an oxidation potential is preferably in a range of about −0.3 V to about 1.0 V, more preferably about −0.1 V to about 0.8 V, and particularly preferably about 0 V to about 0.7 V.

In formula (I), a reducible group represented by B is preferably a residue which is obtained by removing one hydrogen atom from hydroxylamines, hydroxamic acids, hydroxyureas, hydroxysemicarbazides, reductones, phenols, acylhydrazines, carbamoylhydrazines, 3-pyrazolidones, or the like.

The compound of formula (I) in the present invention may have the ballasted group or polymer chain in it generally used in the non-moving photographic additives as a coupler. And as a polymer, for example, the polymer described in JP-A No. 1-100530 can be selected.

The compound of formula (I) in the present invention may be bis or tris type of compound. The molecular weight of the compound represented by formula (I) in the present invention is preferably 100 to 10,000 and more preferably 120 to 1,000 and particularly preferably 150 to 500.

The examples of the compound represented by formula (I) in the present invention are shown below, but the present invention is not limited in these.

(1)

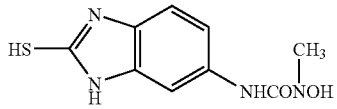

(2)

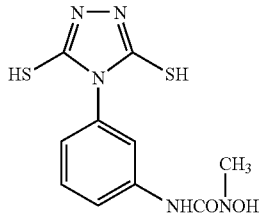

(3)

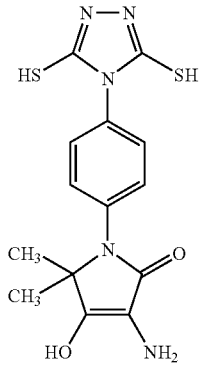

(4)

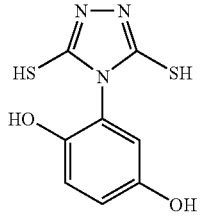

-continued (5)

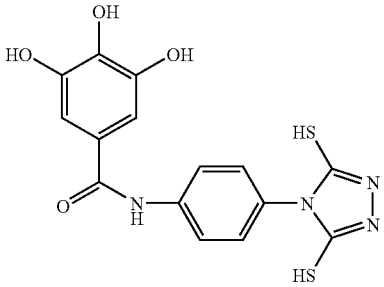

(6)

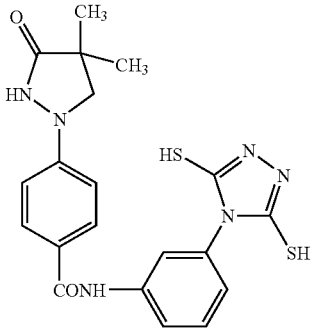

(7)

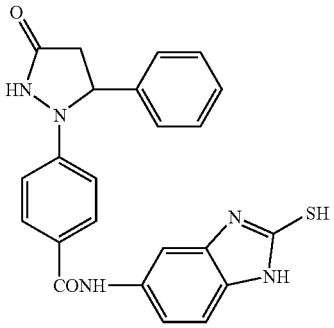

(8)

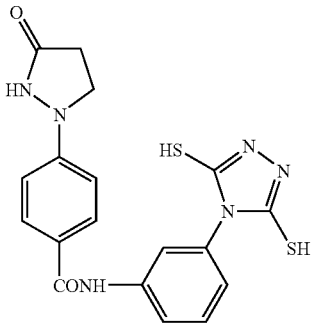

(9)

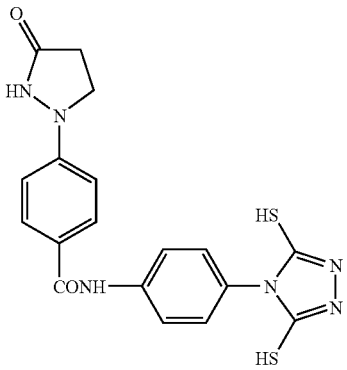

-continued (10)

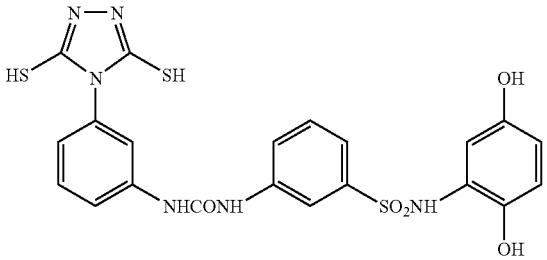

(11)

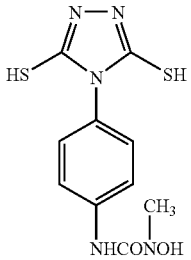

(12)

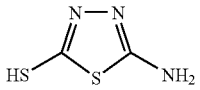

(13)

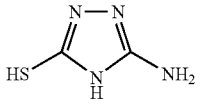

Further, example compounds 1 to 30 and 1"-1 to 1"-77 shown in EP No. 1308776A2, pages 73 to 87 are also described as preferable examples of the compound having an adsorptive group and a reducible group according to the invention.

These compounds can be easily synthesized by any known method. The compound of formula (I) in the present invention can be used alone, but it is preferred to use two or more kinds of the compounds in combination. When two or more kinds of the compounds are used in combination, those may be added to the same layer or the different layers, whereby adding methods may be different from each other.

The compound represented by formula (I) in the present invention preferably is added to an image forming layer and more preferably is to be added at an emulsion preparing process. In the case, where these compounds are added at an emulsion preparing process, these compounds may be added at any step in the process. For example, the compounds may be added during the silver halide grain forming step, the step before starting of desalting step, the desalting step, the step before starting of chemical ripening, the chemical ripening step, the step before preparing a final emulsion, or the like. Also, the addition can be performed in plural times during the process. It is preferred to be added in an image forming layer, but may be added in a surface protective layer or an intermediate layer adjacent to the image forming layer, as well as the image forming layer, to be diffused at the coating step.

The preferred addition amount is largely dependent on the adding method described above or the kind of the compound, but generally $1\times10^{-6}$ mol to 1 mol per 1 mol of photosensitive silver halide, preferably $1\times10^{-5}$ mol to $5\times10^{-1}$ mol, and more preferably $1\times10^{-4}$ mol to $1\times10^{-1}$ mol.

The compound represented by formula (I) in the present invention can be added by dissolving in water or water-soluble solvent such as methanol, ethanol and the like or a mixed solution thereof. At this time, pH may be arranged suitably by an acid or an alkaline and a surfactant can coexist. Further, these compounds may be added as an emulsified dispersion by dissolving them in an organic solvent having a high boiling point and also may be added as a solid dispersion.

11) Combined use of a Plurality of Silver Halides

The photosensitive silver halide emulsion in the photothermographic material used in the invention may be used alone, or two or more kinds of them (for example, those of different average particle sizes, different halogen compositions, of different crystal habits and of different conditions for chemical sensitization) may be used together. Gradation can be controlled by using plural kinds of photosensitive silver halides of different sensitivity. The relevant techniques can include those described, for example, in JP-A Nos. 57-119341, 53-106125, 47-3929, 48-55730, 46-5187, 50-73627, and 57-150841. It is preferred to provide a sensitivity difference of 0.2 or more in terms of log E between each of the emulsions.

12) Coating Amount

The addition amount of the photosensitive silver halide, when expressed by the amount of coated silver per 1 $m^2$ of the photothermographic material, is preferably from 0.03 $g/m^2$ to 0.6 $g/m^2$, more preferably, from 0.05 $g/m^2$ to 0.4 $g/m^2$ and, further preferably, from 0.07 $g/m^2$ to 0.3 $g/m^2$. The photosensitive silver halide is used in the range from 0.01 mol to 0.5 mol, preferably, from 0.02 mol to 0.3 mol, and further preferably from 0.03 mol to 0.2 mol, per 1 mol of the organic silver salt.

13) Mixing Silver Halide and Organic Silver Salt

The method of mixing the silver halide and the organic silver salt can include a method of mixing a separately prepared photosensitive silver halide and an organic silver salt by a high speed stirrer, ball mill, sand mill, colloid mill, vibration mill, or homogenizer, or a method of mixing a photosensitive silver halide completed for preparation at any timing in the preparation of an organic silver salt and preparing the organic silver salt. The effect of the invention can be obtained preferably by any of the methods described above. Further, a method of mixing two or more kinds of aqueous dispersions of organic silver salts and two or more kinds of aqueous dispersions of photosensitive silver salts upon mixing is used preferably for controlling the photographic properties.

14) Mixing Silver Halide into Coating Solution

In the invention, the time of adding silver halide to the coating solution for the image forming layer is preferably in the range from 180 minutes before to just prior to the coating, more preferably, 60 minutes before to 10 seconds before coating. But there is no restriction for mixing method and mixing condition as long as the effect of the invention is sufficient. As an embodiment of a mixing method, there is a method of mixing in a tank and controlling an average residence time. The average residence time herein is calculated from addition flux and the amount of solution transferred to the coater. And another embodiment of mixing method is a method using a static mixer, which is described in 8th edition of "Ekitai Kongo Gijutu" by N. Harnby and M. F. Edwards, translated by Koji Takahashi (Nikkan Kogyo Shinbunsha, 1989).

(Development Accelerator)

In the photothermographic material of the invention, sulfonamide phenolic compounds described in the specification of JP-A No. 2000-267222, and represented by formula (A) described in the specification of JP-A No. 2000-330234; hindered phenolic compounds represented by formula (II) described in JP-A No. 2001-92075; hydrazine compounds described in the specification of JP-A No. 10-62895, represented by formula (I) described in the specification of JP-A No. 11-15116, represented by formula (D) described in the specification of JP-A No. 2002-156727, and represented by formula (1) described in the specification of JP-A No. 2002-278017; and phenolic or naphthalic compounds represented by formula (2) described in the specification of JP-A No. 2001-264929 are used preferably as a development accelerator. The development accelerator described above is used in a range from 0.1 mol % to 20 mol %, preferably, in a range from 0.5 mol % to 10 mol % and, more preferably, in a range from 1 mol % to 5 mol % with respect to the reducing agent. The introducing methods to the photothermographic material can include similar methods as those for the reducing agent and, it is particularly preferred to add as a solid dispersion or an emulsion dispersion. In the case of adding as an emulsion dispersion, it is preferred to add as an emulsion dispersion dispersed by using a high boiling solvent which is solid at a normal temperature and an auxiliary solvent at a low boiling point, or to add as a so-called oilless emulsion dispersion not using the high boiling solvent.

In the present invention, it is more preferred to use as a development accelerator, hydrazine compounds represented by formula (D) described in the specification of JP-A No. 2002-156727, and phenolic or naphtholic compounds represented by formula (2) described in the specification of JP-A No. 2001-264929.

Particularly preferred development accelerators of the invention are compounds represented by the following formulae (A-1) and (A-2).

$Q_1$-NHNH-$Q_2$ Formula (A-1)

(wherein, $Q_1$ represents an aromatic group or a heterocyclic group which bonds to —NHNH-$Q_2$ at a carbon atom, and $Q_2$ represents one selected from a carbamoyl group, an acyl group, an alkoxycarbonyl group, an aryloxycarbonyl group, a sulfonyl group, and a sulfamoyl group).

In formula (A-1), the aromatic group or the heterocyclic group represented by $Q_1$ is preferably a 5 to 7-membered unsaturated ring. Preferred examples include a benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isooxazole ring, a thiophene ring, and the like. Condensed rings in which the rings described above are condensed to each other are also preferred.

The rings described above may have substituents and in a case where they have two or more substituents, the substituents may be identical or different from each other. Examples of the substituents can include a halogen atom, an alkyl group, an aryl group, a carbonamide group, an alkylsulfonamide group, an arylsulfonamide group, an alkoxy group, an aryloxy group, an alkylthio group, an arylthio group, a carbamoyl group, a sulfamoyl group, a cyano group, an alkylsulfonyl group, an arylsulfonyl group, an alkoxycarbonyl group, an aryloxycarbonyl group, and an acyl group. In the case where the substituents are groups capable of substitution, they may have further substituents and examples of preferred substituents can include a halogen atom, an alkyl group, an aryl group, a carbonamide group, an alkylsulfonamide group, an arylsulfonamide group, an alkoxy group, an aryloxy group, an alkylthio group, an arylthio group, an acyl group, an alkoxycarbonyl group, an aryloxycarbonyl group, a carbamoyl group, a cyano group, a sulfamoyl group, an alkylsulfonyl group, an arylsulfonyl group, and an acyloxy group.

The carbamoyl group represented by $Q_2$ is a carbamoyl group preferably having 1 to 50 carbon atoms and, more preferably having 6 to 40 carbon atoms, and examples can include unsubstituted carbamoyl, methyl carbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl) carbamoyl, N-octadecylcarbamoyl, N-{3-(2,4-tert-pentylphenoxy)propyl} carbamoyl, N-(2-hexyldecyl) carbamoyl, N-phenylcarbamoyl, N-(4-dodecyloxyphenyl) carbamoyl, N-(2-chloro-5-dodecyloxycarbonylphenyl) carbamoyl, N-naphthylcarbamoyl, N-3-pyridylcarbamoyl, and N-benzylcarbamoyl.

The acyl group represented by $Q_2$ is an acyl group, preferably having 1 to 50 carbon atoms and, more preferably having 6 to 40 carbon atoms, and can include, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl. The alkoxycarbonyl group represented by $Q_2$ is an alkoxycarbonyl group, preferably having 2 to 50 carbon atoms and, more preferably having 6 to 40 carbon atoms, and can include, for example, methoxycarbonyl, ethoxycarbonyl, isobutyloxycarbonyl, cyclohexyloxycarbonyl, dodecyloxycarbonyl, and benzyloxycarbonyl.

The aryloxy carbonyl group represented by $Q_2$ is an aryloxycarbonyl group, preferably having 7 to 50 carbon atoms and, more preferably having 7 to 40 carbon atoms, and can include, for example, phenoxycarbonyl, 4-octyloxyphenoxycarbonyl, 2-hydroxymethylphenoxycarbonyl, and 4-dodecyloxyphenoxycarbonyl. The sulfonyl group represented by $Q_2$ is a sulfonyl group, preferably having 1 to 50 carbon atoms and, more preferably, having 6 to 40 carbon atoms and can include, for example, methylsulfonyl, butylsulfonyl, octylsulfonyl, 2-hexadecylsulfonyl, 3-dodecyloxypropylsulfonyl, 2-octyloxy-5-tert-octylphenyl sulfonyl, and 4-dodecyloxyphenyl sulfonyl.

The sulfamoyl group represented by $Q_2$ is a sulfamoyl group, preferably having 0 to 50 carbon atoms, more preferably having 6 to 40 carbon atoms, and can include, for example, unsubstituted sulfamoyl, N-ethylsulfamoyl group, N-(2-ethylhexyl)sulfamoyl, N-decylsulfamoyl, N-hexadecylsulfamoyl, N-{3-(2-ethylhexyloxy)propyl} sulfamoyl, N-(2-chloro-5-dodecyloxycarbonylphenyl)sulfamoyl and N-(2-tetradecyloxyphenyl)sulfamoyl. The group represented by $Q_2$ may further have a group mentioned as the example of the substituent of 5 to 7-membered unsaturated ring represented by $Q_1$ at the position capable of substitution. In a case where the group has two or more substituents, such substituents may be identical or different from each other.

Then, preferred range for the compound represented by formula (A-1) is to be described. A 5 or 6-membered unsaturated ring is preferred for $Q_1$, and a benzene ring, a pyrimidine ring, a 1,2,3-triazole ring, a 1,2,4-triazole ring, a tetrazole ring, a 1,3,4-thiadiazole ring, a 1,2,4-thiadiazole ring, a 1,3,4-oxadiazole ring, a 1,2,4-oxadiazole ring, a thioazole ring, an oxazole ring, an isothiazole ring, an isooxazole ring, and a ring in which the ring described above is condensed with a benzene ring or unsaturated hetero ring are further preferred. Further, $Q_2$ is preferably a carbamoyl group and, particularly, a carbamoyl group having a hydrogen atom on the nitrogen atom is particularly preferred.

Formula (A-2)

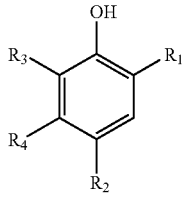

In formula (A-2), $R_1$ represents one selected from an alkyl group, an acyl group, an acylamino group, a sulfonamide group, an alkoxycarbonyl group, and a carbamoyl group. $R_2$ represents one selected from a hydrogen atom, a halogen atom, an alkyl group, an alkoxy group, an aryloxy group, an alkylthio group, an arylthio group, an acyloxy group, and a carbonate ester group. $R_3$ and $R_4$ each independently represent a group capable of substituting for a hydrpgen atom on a benzene ring which is mentioned as the example of the substituent for formula (A-1). $R_3$ and $R_4$ may link together to form a condensed ring.

$R_1$ is preferably an alkyl group having 1 to 20 carbon atoms (for example, a methyl group, an ethyl group, an isopropyl group, a butyl group, a tert-octyl group, a cyclohexyl group, or the like), an acylamino group (for example, an acetylamino group, a benzoylamino group, a methylureido group, a 4-cyanophenylureido group, or the like), or a carbamoyl group (for example, a n-butylcarbamoyl group, an N,N-diethylcarbamoyl group, a phenylcarbamoyl group, a 2-chlorophenylcarbamoyl group, a 2,4-dichlorophenylcarbamoyl group, or the like). An acylamino group (including an ureido group and an urethane group) is more preferred. $R_2$ is preferably a halogen atom (more preferably, a chlorine atom or a bromine atom), an alkoxy group (for example, a methoxy group, a butoxy group, an n-hexyloxy group, an n-decyloxy group, a cyclohexyloxy group, a benzyloxy group, or the like), or an aryloxy group (for example, a phenoxy group, a naphthoxy group, or the like).

$R_3$ is preferably a hydrogen atom, a halogen atom, or an alkyl group having 1 to 20 carbon atoms, and most preferably a halogen atom. $R_4$ is preferably a hydrogen atom, an alkyl group, or an acylamino group, and more preferably an alkyl group or an acylamino group. Examples of the preferred substituent thereof are similar to those for $R_1$. In the case where $R_4$ is an acylamino group, $R_4$ may preferably link with $R_3$ to form a carbostyryl ring.

In the case where $R_3$ and $R_4$ in formula (A-2) link together to form a condensed ring, a naphthalene ring is particularly preferred as the condensed ring. The same substituent as the example of the substituent referred to for formula (A-1) may bond to the naphthalene ring. In the case where formula (A-2) is a naphtholic compound, $R_1$ is preferably a carbamoyl group. Among them, benzoyl group is particularly preferred. $R_2$ is preferably an alkoxy group or an aryloxy group and, particularly preferably an alkoxy group.

Preferred specific examples for the development accelerator of the invention are to be described below. The invention is not restricted to them.

A-1

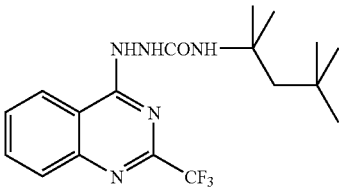

A-2

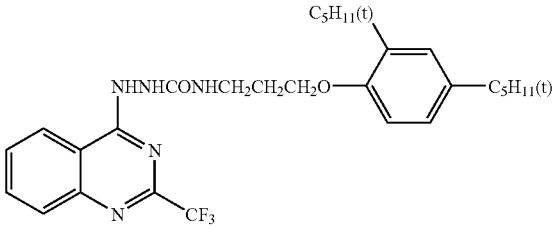

A-3

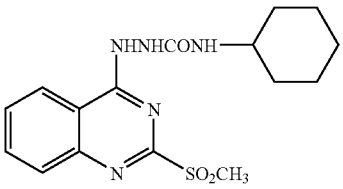

A-4

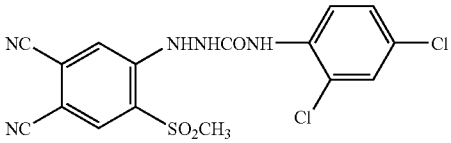

A-5

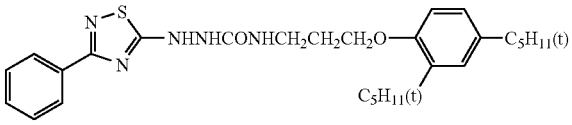

A-6

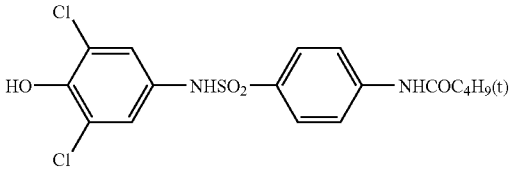

A-7

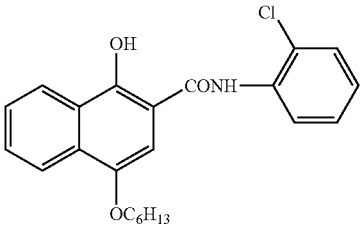

A-8

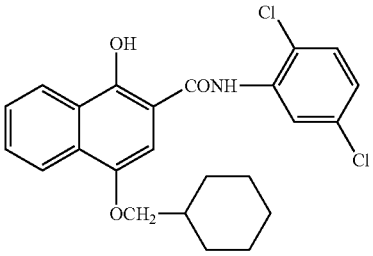

-continued

A-9

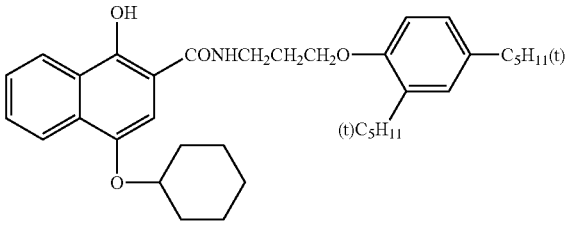

A-10

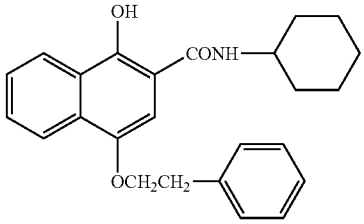

A-11

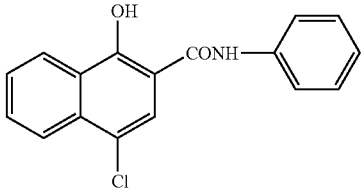

A-12

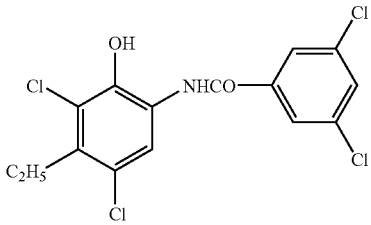

(Hydrogen Bonding Compound)

In the invention, in the case where the reducing agent has an aromatic hydroxy group (—OH) or an amino group (—NHR, R represents a hydrogen atom or an alkyl group), particularly in the case where the reducing agent is a bisphenol described above, it is preferred to use in combination, a non-reducing compound having a group capable of reacting with these groups of the reducing agent, and that is also capable of forming a hydrogen bond therewith.

As a group forming a hydrogen bond with a hydroxyl group or an amino group, there can be mentioned a phosphoryl group, a sulfoxide group, a sulfonyl group, a carbonyl group, an amide group, an ester group, an urethane group, an ureido group, a tertiary amino group, a nitrogen-containing aromatic group, and the like. Particularly preferred among them is a phosphoryl group, a sulfoxide group, an amide group (not having >N—H moiety but being blocked in the form of >N—Ra (where, Ra represents a substituent other than H)), an urethane group (not having >N—H moiety but being blocked in the form of >N—Ra (where, Ra represents a substituent other than H)), and an ureido group (not having >N—H moiety but being blocked in the form of >N—Ra (where, Ra represents a substituent other than H)).

In the invention, particularly preferable as the hydrogen bonding compound is the compound expressed by formula (D) shown below.

Formula (D)

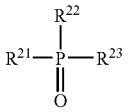

In formula (D), $R^{21}$ to $R^{23}$ each independently represent one selected from an alkyl group, an aryl group, an alkoxy group, an aryloxy group, an amino group, and a heterocyclic group, which may be substituted or unsubstituted.

In the case where $R^{21}$ to $R^{23}$ contain a substituent, examples of the substituent include a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., a methyl group, an ethyl group, an isopropyl group, a t-butyl group, a t-octyl group, a phenyl group, a 4-alkoxyphenyl group, a 4-acyloxyphenyl group, and the like.

Specific examples of an alkyl group expressed by $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenetyl group, a 2-phenoxypropyl group, and the like.

As an aryl group, there can be mentioned a phenyl group, a cresyl group, a xylyl group, a naphthyl group, a 4-t-butylphenyl group, a 4-t-octylphenyl group, a 4-anisidyl group, a 3,5-dichlorophenyl group, and the like.

As an alkoxyl group, there can be mentioned a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group, a benzyloxy group, and the like.

As an aryloxy group, there can be mentioned a phenoxy group, a cresyloxy group, an isopropylphenoxy group, a 4-t-butylphenoxy group, a naphthoxy group, a biphenyloxy group, and the like.

As an amino group, there can be mentioned are a dimethylamino group, a diethylamino group, a dibutylamino group, a dioctylamino group, an N-methyl-N-hexylamino group, a dicyclohexylamino group, a diphenylamino group, an N-methyl-N-phenylamino group, and the like.

Preferred as $R^{21}$ to $R^{23}$ is an alkyl group, an aryl group, an alkoxy group, or an aryloxy group. Concerning the effect of the invention, it is preferred that at least one or more of $R^{21}$ to $R^{23}$ are an alkyl group or an aryl group, and more preferably, two or more of them are an alkyl group or an aryl group. From the viewpoint of low cost availability, it is preferred that $R^{21}$ to $R^{23}$ are of the same group.

Specific examples of hydrogen bonding compounds represented by formula (D) of the invention and others are shown below, but it should be understood that the invention is not limited thereto.

D-1

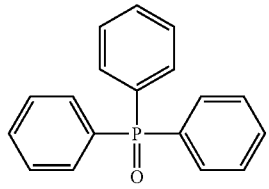

D-2

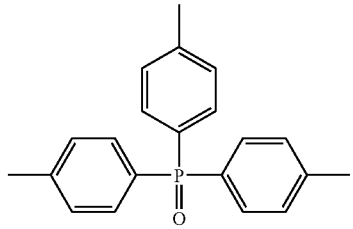

D-3

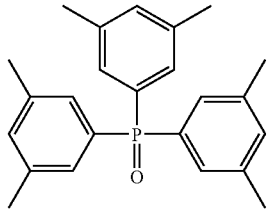

D-4

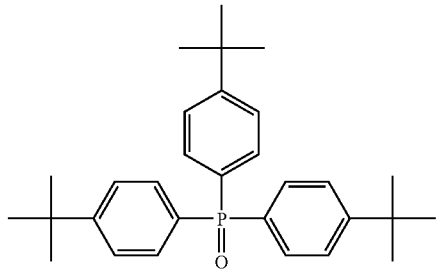

D-5

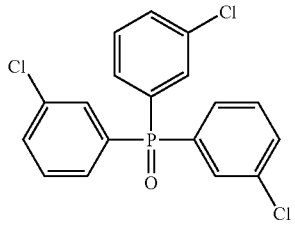

D-6

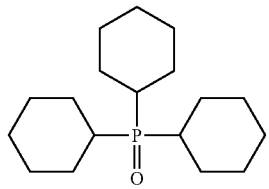

D-7

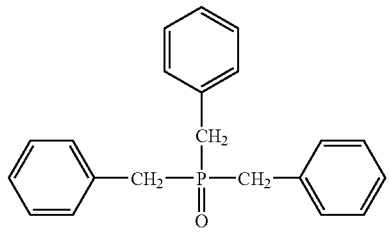

-continued

D-8

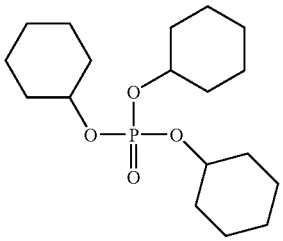

D-9

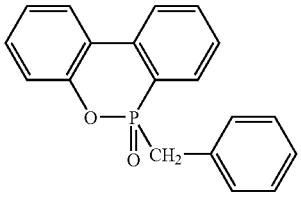

D-10

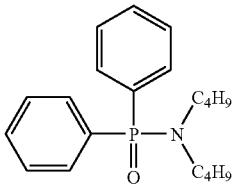

D-11

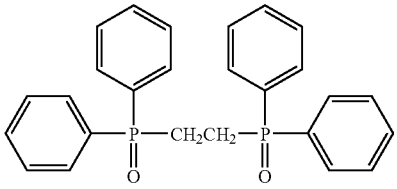

D-12

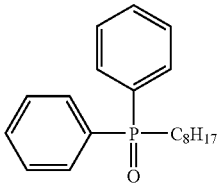

D-13

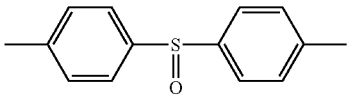

D-14

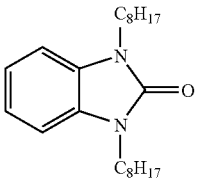

D-15

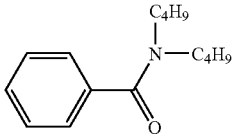

Specific examples of hydrogen bonding compounds other than those enumerated above can be found in those described in EP No. 1096310 and in JP-A Nos. 2002-156727 and 2002-318431.

The compound expressed by formula (D) used in the invention can be used in the photothermographic material by being incorporated into the coating solution in the form of solution, emulsion dispersion, or solid fine particle dispersion, similar to the case of reducing agent. However, it is preferred to be used in the form of solid dispersion. In the solution, the compound expressed by formula (D) forms a hydrogen-bonded complex with a compound having a phenolic hydroxyl group or an amino group, and can be isolated as a complex in crystalline state depending on the combination of the reducing agent and the compound expressed by formula (D).

It is particularly preferred to use the crystal powder thus isolated in the form of solid fine particle dispersion, because it provides stable performance. Further, it is also preferred to use a method of leading to form complex during dispersion by mixing the reducing agent and the compound expressed by formula (D) in the form of powders and dispersing them with a proper dispersion agent using sand grinder mill or the like.

The compound expressed by formula (D) is preferably used in a range from 1 mol % to 200 mol %, more preferably from 10 mol % to 150 mol %, and further preferably, from 20 mol % to 100 mol %, with respect to the reducing agent.

(Binder)

Any kind of hydrophobic polymer may be used as the hydrophobic binder for the image forming layer of the invention. Suitable as the binder are those that are transparent or translucent, and that are generally colorless, such as natural resin or polymer and their copolymers; synthetic resin or polymer and their copolymer; or media forming a film; for example, included are rubber, cellulose acetate, cellulose acetate butyrate, poly(vinyl chloride), poly(methacrylic acid), styrene-maleic anhydride copolymers, styrene-acrylonitrile copolymers, styrene-butadiene copolymers, poly(vinyl acetal) (e.g., poly(vinyl formal) and poly(vinyl butyral)), polyester, polyurethane, phenoxy resin, poly(vinylidene chloride), polyepoxide, polycarbonate, poly(vinyl acetate), polyolefin, cellulose esters, and polyamide. A binder may be used with water, an organic solvent or emulsion to form a coating solution.

In the invention, the glass transition temperature (Tg) of the binder which can be used in combination for the image forming layer is preferably in a range from 0° C. to 80° C., more preferably from 10° C. to 70° C. and, further preferably from 15° C. to 60° C.

In the specification, Tg is calculated according to the following equation.

$$1/Tg=\Sigma(Xi/Tgi)$$

where, the polymer is obtained by copolymerization of n monomer compounds (from i=1 to i=n); Xi represents the mass fraction of the ith monomer ($\Sigma Xi=1$), and Tgi is the glass transition temperature (absolute temperature) of the homopolymer obtained with the ith monomer. The symbol $\Sigma$ stands for the summation from i=1 to i=n. Values for the glass transition temperature (Tgi) of the homopolymers derived from each of the monomers were obtained from J. Brandrup and E. H. Immergut, Polymer Handbook (3rd Edition) (Wiley-Interscience, 1989).

The binder may be of two or more kinds of polymers, when necessary. And, the polymer having Tg of 20° C. or more and the polymer having Tg of less than 20° C. can be used in combination. In the case where two or more kinds of polymers differing in Tg may be blended for use, it is preferred that the weight-average Tg is in the range mentioned above.

In the invention, it is preferred that the image forming layer is formed by first applying a coating solution containing 30% by weight or more of water in the solvent and by then drying.

In the case where the image forming layer is formed by first applying a coating solution containing 30% by weight or more of water in the solvent and by then drying, furthermore, in the case where the binder of the image forming layer is soluble or dispersible in an aqueous solvent (water solvent), and particularly in the case where a polymer latex having an equilibrium water content of 2% by weight or lower under 25° C. and 60% RH is used, the performance can be enhanced. Most preferred embodiment is such prepared to yield an ion conductivity of 2.5 mS/cm or lower, and as such a preparing method, there can be mentioned a refining treatment using a separation function membrane after synthesizing the polymer.

The aqueous solvent in which the polymer is soluble or dispersible, as referred herein, signifies water or water containing mixed therein 70% by weight or less of a water-admixing organic solvent. As water-admixing organic solvents, there can be used, for example, alcohols such as methyl alcohol, ethyl alcohol, propyl alcohol, and the like; cellosolves such as methyl cellosolve, ethyl cellosolve, butyl cellosolve, and the like; ethyl acetate, dimethylformamide, and the like.

The term aqueous solvent is also used in the case the polymer is not thermodynamically dissolved, but is present in a so-called dispersed state.

The term "equilibrium water content under 25° C. and 60% RH" as referred herein can be expressed as follows:

Equilibrium water content under 25° C. and 60% RH $$=[(W1-W0)/W0]\times 100 \text{ (\% by weight)}$$

wherein, W1 is the weight of the polymer in moisture-controlled equilibrium under the atmosphere of 25° C. and 60% RH, and W0 is the absolutely dried weight at 25° C. of the polymer.

For the definition and the method of measurement for water content, reference can be made to Polymer Engineering Series 14, "Testing methods for polymeric materials" (The Society of Polymer Science, Japan, published by Chijin Shokan).

The equilibrium water content under 25° C. and 60% RH is preferably 2% by weight or lower, but is more preferably, 0.01% by weight to 1.5% by weight, and is most preferably, 0.02% by weight to 1% by weight.

The binders used in the invention are, particularly preferably, polymers capable of being dispersed in an aqueous solvent. Examples of dispersed states may include a latex, in which water-insoluble fine particles of hydrophobic polymer are dispersed, or such in which polymer molecules are dispersed in molecular states or by forming micelles, but preferred are latex-dispersed particles. The mean particle size of the dispersed particles is in a range from 1 nm to 50000 nm, preferably from 5 nm to 1000 nm, more preferably from 10 nm to 500 nm, and further preferably from 50 nm to 200 nm. There is no particular limitation concerning particle size distribution of the dispersed particles, and they may be widely distributed or may exhibit a monodisperse particle size distribution. From the viewpoint of controlling the physical properties of the coating solution, preferred mode of usage includes mixing two or more types of particles each having monodisperse particle distribution.

In the invention, preferred embodiment of the polymers capable of being dispersed in aqueous solvent includes hydrophobic polymers such as acrylic polymers, polyester, rubber (e.g., SBR resin), polyurethane, poly(vinyl chloride), poly(vinyl acetate), poly(vinylidene chloride), polyolefin, and the like. As the polymers above, usable are straight chain polymers, branched polymers, or crosslinked polymers; also usable are the so-called homopolymers in which one kind of monomer is polymerized, or copolymers in which two or more kinds of monomers are polymerized. In the case of a copolymer, it may be a random copolymer or a block copolymer. The molecular weight of these polymers is, in number average molecular weight, in a range from 5000 to 1000000, preferably from 10000 to 200000. Those having too a small molecular weight exhibit insufficient mechanical strength on forming the image forming layer, and those having too a large molecular weight are also not preferred because the resulting film-forming properties are poor. Further, a polymer latex having crosslinking property is particularly preferably used.

<Specific Examples of Latex>

Specific examples of preferred polymer latexes are given below, which are expressed by the starting monomers with % by weight given in parenthesis. The molecular weight is given in number average molecular weight. In the case polyfunctional monomer is used, the concept of molecular weight is not applicable because they build a crosslinked structure. Hence, they are denoted as "crosslinking", and the molecular weight is omitted. Tg represents glass transition temperature.

P-1; Latex of -MMA(70)-EA(27)-MAA(3)-(molecular weight 37000, Tg 61° C.)

P-2; Latex of -MMA(70)-2EHA(20)-St(5)-AA(5)- (molecular weight 40000, Tg 59° C.)

P-3; Latex of -St(50)-Bu(47)-MAA(3)- (crosslinking, Tg −17° C.)

P-4; Latex of -St(68)-Bu(29)-AA(3)- (crosslinking, Tg 17° C.)

P-5; Latex of -St(71)-Bu(26)-AA(3)- (crosslinking, Tg 24° C.)

P-6; Latex of -St(70)-Bu(27)-IA(3)- (crosslinking)

P-7; Latex of -St(75)-Bu(24)-AA(1)- (crosslinking, Tg 29° C.)

P-8; Latex of -St(60)-Bu(35)-DVB(3)-MAA(2)-(crosslinking)

P-9; Latex of -St(70)-Bu(25)-DVB(2)-AA(3)- (crosslinking)

P-10; Latex of -VC(50)-MMA(20)-EA(20)-AN(5)-AA(5)- (molecular weight 80000)

P-11; Latex of -VDC(85)-MMA(5)-EA(5)-MAA(5)-(molecular weight 67000)

P-12; Latex of -Et(90)-MAA(10)- (molecular weight 12000)

P-13; Latex of -St(70)-2EHA(27)-AA(3)- (molecular weight 130000, Tg 43° C.)

P-14; Latex of -MMA(63)-EA(35)-AA(2)- (molecular weight 33000, Tg 47° C.)

P-15; Latex of -St(70.5)-Bu(26.5)-AA(3)- (crosslinking, Tg 23° C.)

P-16; Latex of -St(69.5)-Bu(27.5)-AA(3)- (crosslinking, Tg 20.5° C.)

P-17; Latex of -St(61.3)-Isoprene(35.5)-AA(3)-(crosslinking, Tg 17°C.)

P-18; Latex of -St(67)-Isoprene(28)-Bu(2)-AA(3)-(crosslinking, Tg 27°C.)

In the structures above, abbreviations represent monomers as follows. MMA: methyl metacrylate, EA: ethyl acrylate, MAA: methacrylic acid, 2EHA: 2-ethylhexyl acrylate, St: styrene, Bu: butadiene, AA: acrylic acid, DVB:

divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of polyester, there can be mentioned FINETEX ES650, 611, 675, and 850 (all manufactured by Dainippon Ink and Chemicals, Inc.), WD-size and WMS (all manufactured by Eastman Chemical Co.), and the like; as examples of polyurethane, there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of polyolefin, there can be mentioned Chemipearl S120 and SA100 (all manufactured by Mitsui Petrochemical Industries, Ltd.), and the like.

The polymer latex above may be used alone, or may be used by blending two or more kinds depending on needs.

<Preferable Latex>

Particularly preferable as the polymer latex for use in the invention is that of styrene-butadiene copolymer or that of styrene-isoprene copolymer. The weight ratio of monomer unit for styrene to that of butadiene constituting the styrene-butadiene copolymer is preferably in the range of from 40:60 to 95:5. Further, the monomer unit of styrene and that of butadiene preferably account for 60% by weight to 99% by weight with respect to the copolymer. Further, the polymer latex of the invention preferably contains acrylic acid or methacrylic acid in a range from 1% by weight to 6% by weight with respect to the sum of styrene and butadiene, and more preferably from 2% by weight to 5% by weight. The polymer latex of the invention preferably contains acrylic acid. Preferable range of molecular weight is similar to that described above. Further, the ratio of copolymerization and the like in the styrene-isoprene copolymer are similar to those in the styrene-butadiene copolymer.

As the latex of styrene-butadiene copolymer preferably used in the invention, there can be mentioned P-3 to P-9 and P-15 described above, and commercially available LACSTAR-3307B, 7132C, Nipol Lx416, and the like. And as examples of the latex of styrene-isoprene copolymer, there can be mentioned P-17 and P-18 described above.

In the image forming layer of the photothermographic material according to the invention, if necessary, there can be added hydrophilic polymers such as gelatin, polyvinyl alcohol, methyl cellulose, hydroxypropyl cellulose, carboxymethyl cellulose, or the like. These hydrophilic polymers are added at an amount of 30% by weight or less, and preferably 20% by weight or less, with respect to the total weight of the binder incorporated in the image forming layer.

According to the invention, the layer containing organic silver salt (that is, the image forming layer) is preferably formed by using polymer latex for the binder. According to the amount of the binder for the layer containing organic silver salt, the weight ratio for total binder to organic silver salt (total binder/organic silver salt) is preferably in a range of from 1/10 to 10/1, more preferably from 1/3 to 5/1, and further preferably from 1/1 to 3/1.

The layer containing organic silver salt (the image forming layer) is, in general, a photosensitive layer containing the photosensitive silver halide, i.e., the photosensitive silver salt; in such a case, the weight ratio for total binder to silver halide (total binder/silver halide) is preferably in a range of from 400 to 5, and more preferably, from 200 to 10.

The total amount of binder in the image forming layer of the invention is preferably in a range from 0.2 $g/m^2$ to 30 $g/m^2$, more preferably from 1 $g/m^2$ to 15 $g/m^2$, and further preferably from 2 $g/m^2$ to 10 $g/m^2$. As for the image forming layer of the invention, there may be added a crosslinking agent for crosslinking, or a surfactant and the like to improve coating properties.

<Preferable Solvent of Coating Solution>

In the invention, a solvent of a coating solution for the image forming layer of the photothermographic material (wherein a solvent and water are collectively described as a solvent for simplicity) is preferably an aqueous solvent containing water at 30% by weight or more. Examples of solvents other than water may include any of water-miscible organic solvents such as methyl alcohol, ethyl alcohol, isopropyl alcohol, methyl cellosolve, ethyl cellosolve, dimethylformamide and ethyl acetate. The water content in a solvent is more preferably 50% by weight or more, and still more preferably 70% by weight or more. Concrete examples of a preferable solvent composition, in addition to water=100, are compositions in which methyl alcohol is contained at ratios of water/methyl alcohol =90/10 and 70/30, in which dimethylformamide is further contained at a ratio of water/methyl alcohol/dimethylformamide =80/15/5, in which ethyl cellosolve is further contained at a ratio of water/methyl alcohol/ethyl cellosolve =85/10/5, and in which isopropyl alcohol is further contained at a ratio of water/methyl alcohol/isopropyl alcohol =85/10/5 (wherein the numerals presented above are values in % by weight).

(Antifoggant)

1) Organic Polyhalogen Compound

Preferable organic polyhalogen compound that can be used in the invention is explained specifically below. In the invention, preferred organic polyhalogen compounds are the compounds expressed by the following formula (H).

$$Q\text{-}(Y)n\text{-}C(Z_1)(Z_2)X \qquad \text{Formula (H)}$$

In formula (H), Q represents one selected from an alkyl group, an aryl group, and a heterocyclic group; Y represents a divalent linking group; n represents 0 or 1; Z, and $Z_2$ each represent a halogen atom; and X represents a hydrogen atom or an electron-attracting group.

In formula (H), Q is preferably an alkyl group having 1 to 6 carbon atoms, an aryl group having 6 to 12 carbon atoms, or a heterocyclic group comprising at least one nitrogen atom (pyridine, quinoline, or the like).

In the case where Q is an aryl group in formula (H), Q preferably is a phenyl group substituted by an electron-attracting group whose Hammett substituent constant σp yields a positive value. For the details of Hammett substituent constant, reference can be made to Journal of Medicinal Chemistry, vol. 16, No. 11 (1973), pp. 1207 to 1216, and the like. As such electron-attracting groups, examples include, halogen atoms, an alkyl group substituted by an electron-attracting group, an aryl group substituted by an electron-attracting group, a heterocyclic group, an alkylsulfonyl group, an arylsulfonyl group, an acyl group, an alkoxycarbonyl group, a carbamoyl group, sulfamoyl group and the like. Preferable as the electron-attracting group is a halogen atom, a carbamoyl group, or an arylsulfonyl group, and particularly preferred among them is a carbamoyl group.

X is preferably an electron-attracting group. As the electron-attracting group, preferable are a halogen atom, an aliphatic arylsulfonyl group, a heterocyclic sulfonyl group, an aliphatic arylacyl group, a heterocyclic acyl group, an aliphatic aryloxycarbonyl group, a heterocyclic oxycarbonyl group, a carbamoyl group, and a sulfamoyl group; more preferable are a halogen atom and a carbamoyl group; and particularly preferable is a bromine atom.

$Z_1$ and $Z_2$ each are preferably a bromine atom or an iodine atom, and more preferably, a bromine atom.

Y preferably represents —C(═O)—, —SO—, —$SO_2$—, —C(═O)N(R)—, or —$SO_2$N(R)—; more preferably, —C(═O)—, —$SO_2$—, or —C(═O)N(R)—; and particularly preferably, —$SO_2$— or —C(═O)N(R)—. Herein, R represents a hydrogen atom, an aryl group, or an alkyl group, preferably a hydrogen atom or an alkyl group, and particularly preferably a hydrogen atom.

n represents 0 or 1, and preferably represents 1.

In formula (H), in the case where Q is an alkyl group, Y is preferably —C(═O)N(R)—. And, in the case where Q is an aryl group or a heterocyclic group, Y is preferably —$SO_2$—.

In formula (H), the form where the residues, which are obtained by removing a hydrogen atom from the compound, bind each other (generally called as bis type, tris type, or tetrakis type) is also preferably used.

In formula (H), the form having a substituent of a dissociative group (for example, a COOH group or a salt thereof, an $SO_3H$ group or a salt thereof, a $PO_3H$ group or a salt thereof, or the like), a group containing a quaternary nitrogen cation (for example, an ammonium group, a pyridinium group, or the like), a polyethyleneoxy group, a hydroxy group, or the like is also preferable.

Specific examples of the compound expressed by formula (H) of the invention are shown below.

H-1

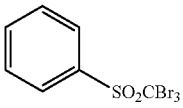

H-2

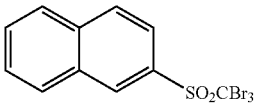

H-3

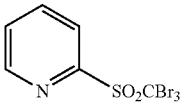

H-4

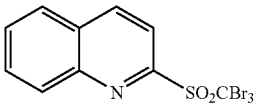

H-5

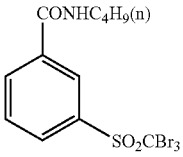

-continued

H-6

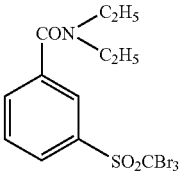

H-7

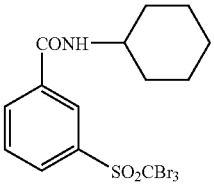

H-8

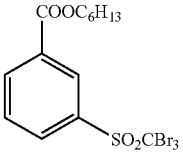

H-9

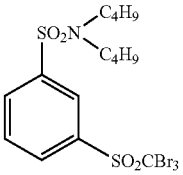

H-10

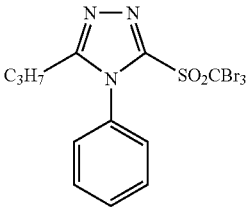

H-11

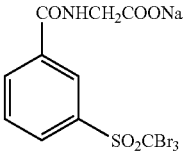

H-12

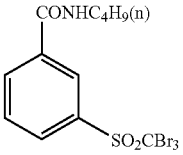

H-13

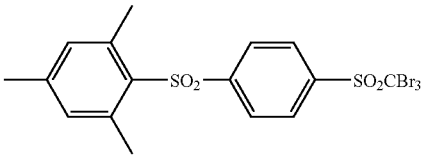

H-14

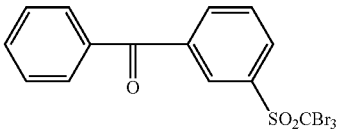

-continued

H-15

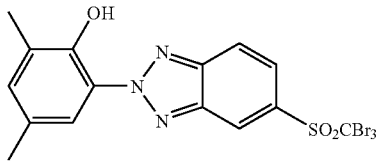

H-16

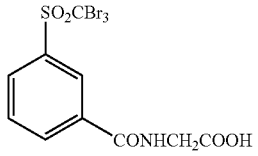

H-17

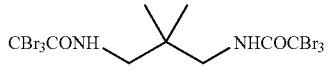

H-18

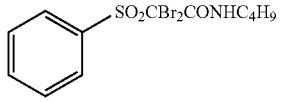

H-19

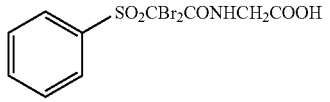

As preferred organic polyhalogen compounds of the invention other than those above, there can be mentioned compounds disclosed in U.S. Pat. Nos. 3,874,946, 4,756,999, 5,340,712, 5,369,000, 5,464,737, and 6,506,548, JP-A Nos. 50-137126, 50-89020, 50-119624, 59-57234, 7-2781, 7-5621, 9-160164, 9-244177, 9-244178, 9-160167, 9-319022, 9-258367, 9-265150, 9-319022, 10-197988, 10-197989, 11-242304, 2000-2963, 2000-112070, 2000-284410, 2000-284412, 2001-33911, 2001-31644, 2001-312027, and 2003-50441. Particularly, compounds disclosed in JP-A Nos. 7-2781, 2001-33911 and 20001-312027 are preferable.

The compounds expressed by formula (H) of the invention are preferably used in an amount from $10^{-4}$ mol to 1 mol, more preferably, $10^{-3}$ mol to 0.5 mol, and further preferably, $1\times10^{-2}$ mol to 0.2 mol, per 1 mol of non-photosensitive organic silver salt incorporated in the image forming layer.

In the invention, usable methods for incorporating the antifoggant into the photothermographic material are those described above in the method for incorporating the reducing agent, and also for the organic polyhalogen compound, it is preferably added in the form of a solid fine particle dispersion.

2) Other Antifoggants

As other antifoggants, there can be mentioned a mercury (II) salt described in paragraph number 0113 of JP-A No. 11-65021, benzoic acids described in paragraph number 0114 of the same literature, a salicylic acid derivative described in JP-A No. 2000-206642, a formaline scavenger compound expressed by formula (S) in JP-A No. 2000-221634, a triazine compound related to claim 9 of JP-A No. 11-352624, a compound expressed by formula (III), 4-hydroxy-6-methyl-1,3,3a,7-tetrazaindene and the like, described in JP-A No. 6-11791.

The photothermographic material of the invention may further contain an azolium salt in order to prevent fogging. Azolium salts useful in the present invention include a compound expressed by formula (XI) described in JP-A No. 59-193447, a compound described in Japanese Patent Application Publication (JP-B) No. 55-12581, and a compound expressed by formula (II) in JP-A No. 60-153039. The azolium salt may be added to any part of the photothermographic material, but as an additional layer, it is preferred to select a layer on the side having thereon the image forming layer, and more preferred is to select the image forming layer itself. The azolium salt may be added at any time of the process of preparing the coating solution; in the case where the azolium salt is added into the image forming layer, any time of the process may be selected, from the preparation of the organic silver salt to the preparation of the coating solution, but preferred is to add the salt after preparing the organic silver salt and just before coating. As the method for adding the azolium salt, any method using a powder, a solution, a fine-particle dispersion, and the like, may be used. Furthermore, it may be added as a solution having mixed therein other additives such as sensitizing agents, reducing agents, toners, and the like.

In the invention, the azolium salt may be added at any amount, but preferably, it is added in a range from $1\times10^{-6}$ mol to 2 mol, and more preferably, from $1\times10^{-3}$ mol to 0.5 mol, per 1 mol of silver.

(Other Additives)

1) Mercapto Compounds, Disulfides and Thiones

In the invention, mercapto compounds, disulfide compounds, and thione compounds can be added in order to control the development by suppressing or enhancing development, to improve spectral sensitizing efficiency, and to improve storage properties before and after development. Descriptions can be found in paragraph Nos. 0067 to 0069 of JP-A No. 10-62899, a compound expressed by formula (I) of JP-A No. 10-186572 and specific examples thereof shown in paragraph Nos. 0033 to 0052, in lines 36 to 56 in page 20 of EP No. 0803764A1. Among them, mercapto-substituted heterocyclic aromatic compounds, which are described in JP-A Nos. 9-297367, 9-304875, 2001-100358, 2002-303954, 2002-303951 and the like, are particularly preferred.

2) Toner

In the photothermographic material of the present invention, the addition of a toner is preferred. The description of the toner can be found in JP-A No. 10-62899 (paragraph Nos. 0054 to 0055), EP No. 0803764A1 (page 21, lines 23 to 48), and JP-A Nos. 2000-356317 and 2000-187298. Preferred are phthalazinones (phthalazinone, phthalazinone derivatives and metal salts thereof, e.g., 4-(1-naphthyl) phthalazinone, 6-chlorophthalazinone, 5,7-dimethoxyphthalazinone and 2,3-dihydro-1,4-phthalazinedione); combinations of phthalazinones and phthalic acids (e.g., phthalic acid, 4-methylphthalic acid, 4-nitrophthalic acid, diammonium phthalate, sodium phthalate, potassium phthalate, and tetrachlorophthalic anhydride); phthalazines (phthalazine, phthalazine derivatives and metal salts thereof, e.g., 4-(1-naphthyl)phthalazine, 6-isopropylphthalazine, 6-tert-butylphthalazine, 6-chlorophthalazine, 5,7-dimethoxyphthalazine, and 2,3-dihydrophthalazine); combinations of phthalazines and phthalic acids. Particularly preferred is a combination of phthalazines and phthalic acids. Among them, particularly preferable are the combination of 6-isopropylphthalazine and phthalic acid, and the combination of 6-isopropylphthalazine and 4-methylphthalic acid.

3) Plasticizer and Lubricant

Plasticizers and lubricants usable in the image forming layer of the invention are described in paragraph No. 0117 of JP-A No. 11-65021. Lubricants are described in paragraph Nos. 0061 to 0064 of JP-A No. 11-84573.

4) Dyes and Pigments

From the viewpoint of improving color tone, of preventing the generation of interference fringes and of preventing irradiation on laser exposure, various types of dyes and pigments (for instance, C.I. Pigment Blue 60, C.I. Pigment Blue 64, and C.I. Pigment Blue 15:6) can be used in combination with the aforementioned phthalocyanine compound in the image forming layer of the invention. Detailed description can be found in WO No. 98/36322, JP-A Nos. 10-268465 and 11-338098, and the like.

5) Nucleator

As for the photothermographic material of the invention, it is preferred to add a nucleator into the image forming layer. Details on the nucleators, method for their addition and addition amount can be found in paragraph No. 0118, paragraph Nos. 0136 to 0193 of JP-A No. 11-223898, as compounds expressed by formulae (H), (1) to (3), (A), and (B) in JP-A No. 2000-284399; as for a nucleation accelerator, description can be found in paragraph No. 0102 of JP-A No. 11-65021, and in paragraph Nos. 0194 to 0195 of JP-A No. 11-223898.

In the case of using formic acid or formates as a strong fogging agent, it is preferably incorporated into the side having thereon the image forming layer containing photosensitive silver halide, at an amount of 5 mmol or less, and preferably 1 mmol or less, per 1 mol of silver.

In the case of using a nucleator in the photothermographic material of the invention, it is preferred to use an acid resulting from hydration of diphosphorus pentaoxide, or a salt thereof in combination. Acids resulting from the hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like. Particularly preferred acids obtainable by the hydration of diphosphorus pentaoxide or salts thereof include orthophosphoric acid (salt) and hexametaphosphoric acid (salt). Specifically mentioned as the salts are sodium orthophosphate, sodium dihydrogen orthophosphate, sodium hexametaphosphate, ammonium hexametaphosphate, and the like.

The addition amount of the acid obtained by hydration of diphoshorus pentaoxide or the salt thereof (i.e., the coating amount per 1 $m^2$ of the photothermographic material) may be set as desired depending on sensitivity and fogging, but preferred is an amount of from 0.1 $mg/m^2$ to 500 $mg/m^2$, and more preferably, from 0.5 $mg/m^2$ to 100 $mg/m^2$.

(Preparation of Coating Solution and Coating)

The temperature for preparing the coating solution for the image forming layer of the invention is preferably from 30° C. to 65° C., more preferably, from 35° C. or more to less than 60° C., and further preferably, from 35° C. to 55° C. Furthermore, the temperature of the coating solution for the image forming layer immediately after adding the polymer latex is preferably maintained in the temperature range from 30° C. to 65° C.

(Layer Constitution and Other Constituting Components)

The image forming layer of the invention is constructed on a support by one or more layers. In the case of constituting the layer by a single layer, it comprises an organic silver salt, a photosensitive silver halide, a reducing agent, and a binder, which may further comprise additional materials as desired if necessary, such as a toner, a film-forming promoting agent, and other auxiliary agents. In the case of constituting the image forming layer from two or more layers, the first image forming layer (in general, a layer placed nearer to the support) contains an organic silver salt and a photosensitive silver halide, and some of the other components are incorporated in the second image forming layer or in both of the layers. The constitution of a multicolor photothermographic material may include combinations of two layers for those for each of the colors, or may contain all the components in a single layer as described in U.S. Pat. No. 4,708,928.

In the case of multicolor photothermographic material, each of the image forming layers is maintained distinguished from each other by incorporating functional or non-functional barrier layer between each of the image forming layers as described in U.S. Pat. No. 4,460,681.

The photothermographic material according to the invention can have a non-photosensitive layer in addition to the image forming layer. The non-photosensitive layers can be classified depending on the layer arrangement into (a) a surface protective layer provided on the image forming layer (on the side farther from the support), (b) an intermediate layer provided among plural image forming layers or between the image forming layer and the protective layer, (c) an undercoat layer provided between the image forming layer and the support, and (d) a back layer which is provided to the side opposite to the image forming layer.

Furthermore, a layer that functions as an optical filter may be provided as (a) or (b) above. An antihalation layer may be provided as (c) or (d) to the photothermographic material.

1) Surface Protective Layer

The photothermographic material of the invention may further comprise a surface protective layer with an object to prevent adhesion of the image forming layer. The surface protective layer may be a single layer, or plural layers.

Description on the surface protective layer may be found in paragraph Nos. 0119 to 0120 of JP-A No. 11-65021 and in JP-A No. 2000-171936.

Preferred as the binder of the surface protective layer of the invention is gelatin, but polyvinyl alcohol (PVA) may be used preferably instead, or in combination. As gelatin, there can be used an inert gelatin (e.g., Nitta gelatin 750), a phthalated gelatin (e.g., Nitta gelatin 801), and the like. Usable as PVA are those described in paragraph Nos. 0009 to 0020 of JP-A No. 2000-171936, and preferred are the completely saponified product PVA-105, the partially saponified PVA-205, and PVA-335, as well as modified polyvinyl alcohol MP-203 (all trade name of products from Kuraray Ltd.). The amount of coated polyvinyl alcohol (per 1 $m^2$ of support) in the surface protective layer (per one layer) is preferably in the range from 0.3 $g/m^2$ to 4.0 $g/m^2$, and more preferably, from 0.3 $g/m^2$ to 2.0 $g/m^2$.

The total amount of the coated binder (including water-soluble polymer and latex polymer) (per 1 $m^2$ of support) in the surface protective layer (per one layer) is preferably in a range from 0.3 $g/m^2$ to 5.0 $g/m^2$, and more preferably, from 0.3 $g/m^2$ to 2.0 $g/m^2$.

2) Antihalation Layer

The photothermographic material of the present invention can comprise an antihalation layer provided to the side farther from the light source with respect to the image forming layer. It is preferred that the antihalation layer is provided as a back layer, or between the image forming layer and the support.

Descriptions on the antihalation layer can be found in paragraph Nos. 0123 to 0124 of JP-A No. 11-65021, in JP-A Nos. 11-223898, 9-230531, 10-36695, 10-104779, 11-231457, 11-352625, 11-352626, and the like.

The antihalation layer contains an antihalation dye having its absorption at the wavelength of the exposure light. In the case where the exposure wavelength is in the infrared region, an infrared-absorbing dye may be used, and in such a case, preferred are dyes having no absorption in the visible region.

In the photothermographic material of the invention, it is preferred to use the aforementioned phthalocyanine compound as the antihalation dye.

In general, the dye is used at an amount as such that the optical density (absorbance) exceeds 0.1 when measured at the desired wavelength. The optical density is preferably in a range from 0.15 to 2, and more preferably from 0.2 to 1. The addition amount of dyes to obtain optical density in the above range is generally from about 0.001 $g/m^2$ to 1 $g/m^2$.

3) Back Layer

Back layers usable in the invention are described in paragraph Nos. 0128 to 0130 of JP-A No. 11-65021.

In the invention, coloring matters having maximum absorption in the wavelength range from 300 nm to 450 nm can be added in order to improve color tone of developed silver images and a deterioration of the images during aging. Such coloring matters are described in, for example, JP-A Nos. 62-210458, 63-104046, 63-103235, 63-208846, 63-306436, 63-314535, 01-61745, 2001-100363, and the like.

Such coloring matters are generally added in the range from 0.1 $mg/m^2$ to 1 $g/m^2$, preferably to the back layer which is provided to the side opposite to the image forming layer.

According to the present invention, magenta dyes are preferably used in order to adjust the color tone of the non-image part after thermal development. Especially, it is preferred that the aforementioned hue angle difference $\Delta h_{ab}$ between the photothermographic material containing cyan dyes only and the photothermographic material containing magenta dyes only preferably come to be in a range of $70° < \Delta h_{ab} < 110°$. Wherein $h_{ab}$ represents a psychological hue angle as defined by CIELAB color space. The CIELAB color space, also called as CIE 1976 L*a*b* color space, is measured according to the measuring method described in JIS Z8722 : 2000. As for a light source for observation, various colorimetric lights may be properly used according to the actual conditions for viewing images. Generally, an illumination light such as type F5 is used. L*, a*, and b* are calculated from the non-luminous color by the calculation method as described in JIS Z9829: 1944. $h_{ab}$ can be provided from the formula $h_{ab}$=tan-1 (b*/a*). $\Delta h_{ab}$ is defined as $\Delta h_{ab} = h_{ab}(M) - h_{ab}(C)$. Wherein $h_{ab}(C)$ represents a hue angle in non-image part after thermal development of the photothermographic material containing cyan dyes only, and similarly $h_{ab}(M)$ represents a hue angle in non-image part after thermal development of the photothermographic material containing magenta dyes only.

In the case where the color tone is controlled to a definite tone, when $\Delta h_{ab}$ is small, the addition amount of the cyan dyes may be reduced, and thereby the effect of antihalation may be depressed. Inversely, when $\Delta h_{ab}$ is large, the color tone by cyan dyes and magenta dyes may be offset each other, and then the gray tone may increase, and as a result, fog may be increased.

As specific examples of the magenta dye used for this purpose, there can be mentioned an azo dye, an azomethyine dye, quinone dyes (for example, an anthraquinone dye, a naphthoquinone dye or the like), a quinoline dye (for example, a quinophthalone dye or the like), a methine dye (for example, a cyanine dye, a melocyanine dye, an arylidene dye, a stylyl dye, an oxonole dye, or the like), a carbonium dye (for example, a cationic dye such as a diphenylmethane dye, a triphenylmethane dye, a xanthene dye, an acridine dye, or the like), an indoaniline dye, an azine dye (for example, a cationic dye such as a thiazine dye, an oxadine dye, a phenazine dye, or the like), an aza [18] □electron dye (for example, a porphine dye, a tetra-azaporphine dye, a phthalocyanine dye, or the like), an indigoid dye (for example, indigo, a thioindigo dye, or the like), a squarylium dye, a chroconium dye, a pyromethene dye (which may form a metal complex), and a nitro/nitroso dye, and the like. As for adding method of these dyes, any methods such as in the form of a solution, an emulsion, a solid fine particle dispersion, a mordant in a polymer mordant, and the like may be used.

Among these dyes, preferable magenta dyes are an azo dye, an azomethine dye, a carbonium dye, and a polymethine dye and the like, and more preferable is an azomethine dye.

The azomethine dye is preferably the compound represented by the following formula (I). The compounds represented by formula (I) are set forth below.

Formula (I)

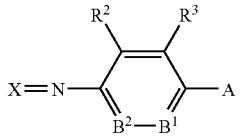

<Description of Substituents>

In formula (I), X represents a residual of a color photographic coupler, A represents —$NR^4R^5$ or a hydroxy group, $R^4$ and $R^5$ each independently represent one selected from a hydrogen group, an aliphatic group, an aromatic group, and a heterocyclic group. A is preferably —$NR^4R^5$. The above mentioned $R^4$ and $R^5$ are each independently, preferably, a hydrogen atom or an aliphatic group, more preferably a hydrogen atom, an alkyl group, or a substituted alkyl group, and still more preferably a hydrogen atom, an alkyl group having 1 to 18 carbon atoms, or a substituted alkyl group having 1 to 18 carbon atoms. In more detail, most preferably, both of $R^4$ and $R^5$ are a methyl group or an ethyl group, or $R^4$ is an ethyl group and $R^5$ is a hydroxylethyl group, or $R^4$ is an ethyl group and $R^5$ is a (2-methanesulfonyl amino)ethyl group.

In the aforementioned formula (I), $B^1$ represents =$C(R^6)$— or =N—, and $B^2$ represents —$C(R^7)$= or —N=. It is preferred that $B^1$ and $B^2$ are not —N= at the same time, and it is more preferred that $B^1$ is =$C(R^6)$— and $B^2$ is —$C(R^7)$=. In this case, in formula (I), $R^2$, $R^3$, $R^6$, and $R^7$ are each independently a halogen atom, an aliphatic group, an aromatic group, a heterocyclic group, cyano, —$OR^{51}$, —$SR^{52}$, —$CO_2R^{53}$, —$OCOR^{54}$, —$NR^{55}R^{56}$—$CONR^{57}R^{58}$, —$SO_2R^{59}$, —$SO_2NR^{60}R^{61}$, —$NR^{62}CONR^{63}R^{64}$, —$NR^{65}CO_2R^{66}$, —$COR^{67}$, —$NR^{68}COR^{69}$, or —$NR^{51}$, $R^{52}$, $R^{53}$, $R^{54}$, $R^{55}$, $R^{56}$, $R^{57}$, $R^{58}$, $R^{59}$, $R^{60}$, $R^{61}$, $R^{62}$, $R^{63}$, $R^{64}$, $R^{65}$, $R^{66}$, $R^{67}$, $R^{68}$, $R^{69}$, $R^{70}$, and $R^{71}$ are each independently a halogen atom, an aliphatic group, or an aromatic group.

The aforementioned $R^2$ and $R^7$ are each independently, preferably, a hydrogen atom, a halogen atom, an aliphatic group, —$OR^{51}$, —$NR^{62}CONR^{63}R^{64}$, —$NR^{65}CO_2R^{66}$ fluorine atom, a chlorine atom, an alkyl group, a substituted alkyl group, —$NR^{62}CONR^{63}R^{64}$, or —$NR^{68}COR^{69}$, still more preferably a hydrogen atom, a chlorine atom, an alkyl group having 1 to 10 carbon atoms, or a substituted alkyl group having 1 to 10 carbon atoms, and most preferably a hydrogen atom, an alkyl group having 1 to 4 carbon atoms, or a substituted alkyl group having 1 to 4 carbon atoms. In more detail, most preferably, $R^2$ is a hydrogen atom or a methyl group and $R^7$ is a hydrogen atom.

$R^3$ and $R^6$ are each independently, preferably, a hydrogen atom, a halogen atom, an aliphatic group, more preferably a hydrogen atom, a fluorine atom, a chlorine atom, an alkyl group, or a substituted alkyl group, further preferably a hydrogen atom, a chlorine atom, an alkyl group having 1 to 10 carbon atoms, or a substituted alkyl group having 1 to 10 carbon atoms, and most preferably a hydrogen atom, an alkyl group having 1 to 4 carbon atoms, or a substituted alkyl group having 1 to 4 carbon atoms. In more detail, most preferably, both of $R^3$ and $R^6$ are a hydrogen atom.

In the aforementioned formula (I), $R^2$ and $R^3$, $R^3$ and $R^4$, $R^4$ and $R^5$, $R^5$ and $R^6$, and $R^6$ and $R^7$ may bind each other to form a ring. The preferable combination to form a ring is $R^3$ and $R^4$, $R^4$ and $R^5$, or $R^5$ and $R^6$. The ring which is formed by bonding the aforementioned $R^2$ and $R^3$, or $R^6$ and $R^7$, is preferably a 5 or 6-membered ring. The ring is preferably an aromatic ring (for example, a benzene ring) or unsaturated heterocycle (for example, a pyridine ring, an imidazole ring, a thiazole ring, a pyrimidine ring, a pyrole ring, or a furan ring). The ring, which is formed by bonding the aforementioned $R^3$ and $R^4$, or $R^5$ and $R^6$, is preferably a 5 or 6-membered ring. Examples of the ring include a tetrahydroquinoline ring and a dihydroindole ring. The ring, which is formed by bonding the aforementioned $R^4$ and $R^5$, is preferably a 5 or 6-membered ring. Examples of the ring include a pyrrolidine ring, a piperidine ring, and a morpholine ring.

In the present description, the aliphatic group means an alkyl group, a substituted alkyl group, an alkenyl group, a substituted alkenyl group, an alkynyl group, a substituted alkynyl group, an aralkyl group, and an substituted aralkyl group. The aforementioned alkyl group may be branched or may form a ring. The alkyl group preferably has 1 to 20 carbon atoms, and more preferably 1 to 18 carbon atoms. The alkyl moiety in the aforementioned substituted alkyl group is similar to the above mentioned alkyl group. The aforementioned alkenyl group may be branched or form a ring. The alkenyl group has preferably 2 to 20 carbon atoms, and more preferably 2 to 18 carbon atoms. The alkenyl moiety in the aforementioned substituted alkenyl group is similar to the above mentioned alkenyl group. The aforementioned alkynyl group may be branched or form a ring. The alkynyl group has preferably 2 to 20 carbon atoms, and more preferably 2 to 18 carbon atoms. The alkynyl moiety in the aforementioned substituted alkynyl group is similar to the above mentioned alkynyl group.

The alkyl moieties in the aforementioned aralkyl group and substituted aralkyl group are similar to the above mentioned alkyl group. The aryl moieties in the aforementioned aralkyl group and substituted aralkyl group are similar to the aryl group mentioned below. Examples of the substituent of the alkyl moieties in the aforementioned substituted alkyl group, substituted alkenyl group, substituted alkynyl group, and substituted aralkyl group include a halogen atom, cyano, nitro, a heterocyclic group, $—OR^{141}$, $—SR^{142}$, $—CO_2R^{143}$, $—NR^{144}R^{145}$, $—CONR^{146146}R^{147}$, $—SO_2R^{148}$, $—SO_3R^{149}$, and $—SO_2NR^{150}R^{151}$. $R^{141}$, $R^{142}$, $R^{143}$, $R^{144}$, $R^{145}$, $R^{146}$, $R^{147}$, $R^{148}$, $R^{149}$, $R^{150}$, and $R^{151}$ are each independently a hydrogen atom, an aliphatic group, or an aromatic group. In addition to the above mentioned groups, $R^{143}$ and $R^{149}$ may be a metal atom selected from Li, Na, K, Mg, and Ca. In this case, Li, Na, and K are preferable, and Na is more preferable. Examples of the substituent of the aryl moiety in the aforementioned substituted aralkyl group are similar to the following examples of the substituent of the substituted aryl group.

In the present description, an aromatic group means an aryl group and a substituted aryl group. The aryl group is preferably phenyl or naphthyl, and particularly preferably phenyl. The aryl moiety in the aforementioned substituted aryl group is similar to the abovementioned aryl group. Examples of the substituent of the aforementioned substituted aryl group include a halogen atom, cyano, nitro, an aliphatic group, a heterocyclic group, $—OR^{161}$, $—SR^{162}$, $—CO_2R^{163}$, $—NR^{164}R^{165}$, $—CONR^{166}R^{167}$, $—SO_2R^{168}$, $—SO_3R^{169}$, and $SO_2NR^{170}R^{171}$. $R^{161}$, $R^{162}$, $R^{163}$, $R^{164}$, $R^{165}$, $R^{166}$, $R^{167}$, $R^{168}$, $R^{169}$, $R^{170}$, and $R^{171}$ are each independently a hydrogen atom, an aliphatic group, or an aromatic group. In addition to the above mentioned groups, $R^{163}$ and $R^{169}$ may be a metal atom selected from Li, Na, K, Mg, and Ca. In this case, Li, Na, and K are preferable, and Na is more preferable.

In the present description, a heterocyclic group preferably contains a 5 or 6-membered saturated or unsaturated heterocycle. The heterocycle may be condensed with an aliphatic ring, aromatic ring or other heterocycle. Examples of the heteroatom in the heterocycle include B, N, O, S, Se, and Te. N, O, and S are preferable as a heteroatom. In the heterocycle, a carbon atom preferably has a free single valence (a heterocyclic group binds at a carbon atom). Examples of the saturated heterocycle include pyrrolidine ring, a morpholine ring, 2-bora-1,3-dioxorane ring and 1,3-thiazoline ring. Examples of the unsaturated heterocycle include an imidazole ring, a thiazole ring, a benzothiazole ring, a benzoxazole ring, a benzotriazole ring, a benzoselenazole ring, a pyridine ring, a pyrimidine ring, and a quinoline ring. The heterocyclic group may have a substituent. Examples of the substituent include a halogen atom, cyano, nitro, an aliphatic group, an aromatic group, a heterocyclic group, $—OR^{171}$, $—SR^{172}$, $—CO_2R^{173}$, $—NR^{174}R^{175}$, $—CONR^{176}R^{177}$, $—SO_2R^{178}$, and $—SO_2NR^{179}R^{180}$. $R^{171}$, $R^{172}$, $R^{173}$,$R^{174}$, $R^{175}$, $R^{176}$, $R^{177}$, $R^{178}$, $R^{179}$, and $R^{180}$ are each independently a hydrogen atom, an aliphatic group, or an aromatic group.

In the aforementioned formula (I), a coupler represented by X is preferably the coupler mentioned in the documents below. U.S. Pat. Nos. 4,310,619 and 4,351,897, EP No. 73636, U.S. Pat. Nos. 3,061,432 and 3,725,067, Research Disclosure Nos. 24220 (1984, June), and 24230 (1984, June), JP-A Nos. 60-33552, 60-43659, 61-72238, 60-35730, 55-118034, and 60-185951, U.S. Pat. Nos. 4,500,630, 4,540,654, and 4,556,630, WO No. 88/04795, JP-A No. 3-39737 {L-57 (page 11, lower right), L-68 (page 12, lower right), L-77 (page 13, lower right)}, EP No. 456257 {[A-4]-63 (page 134), [A-4]-73, -75 (page 139)}, EP No. 486965 {M-4, -6 (page 26), M-7 (page 27)}, EP No. 571959A {M-45 (page 19)}, JP-A No. 5-204106 {(M-1) (page 6)}, and 4-362631 {M-22 (paragraph No. 0237)}, U.S. Pat. Nos. 3,061,432 and 3,725,067.

Specific examples of the compound of magenta dye are listed below, however, the present invention is not limited thereto.

(1)
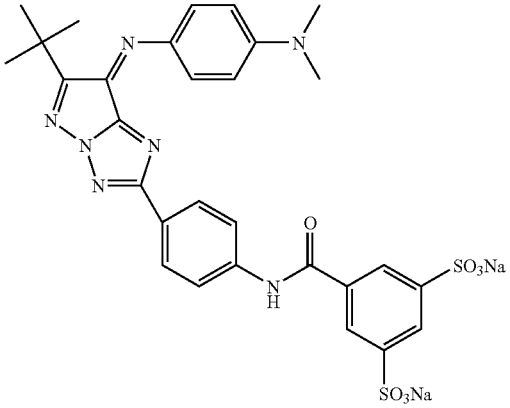
(2)
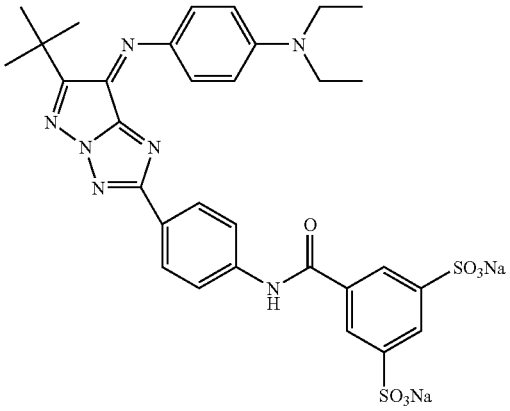
(3)
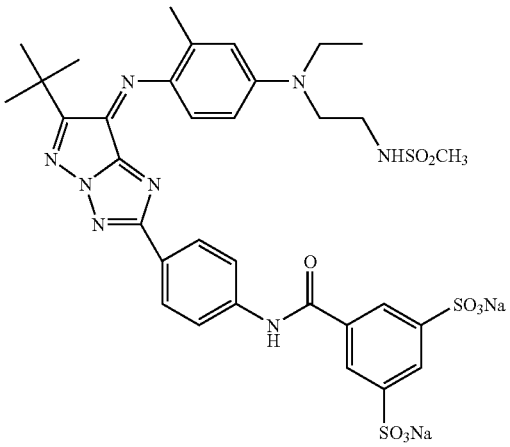
-continued
(4)
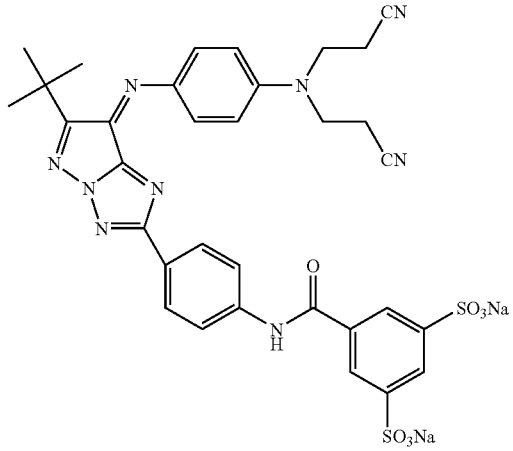
(5)
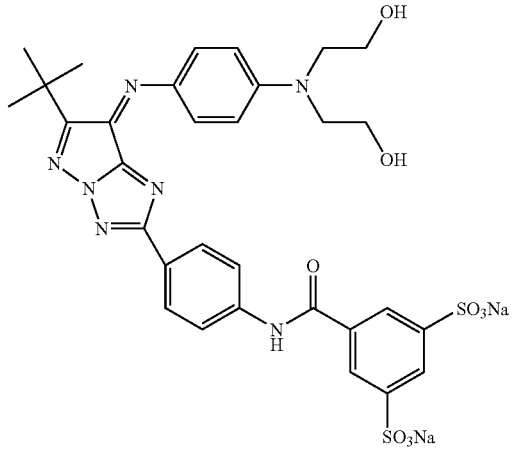
(6)
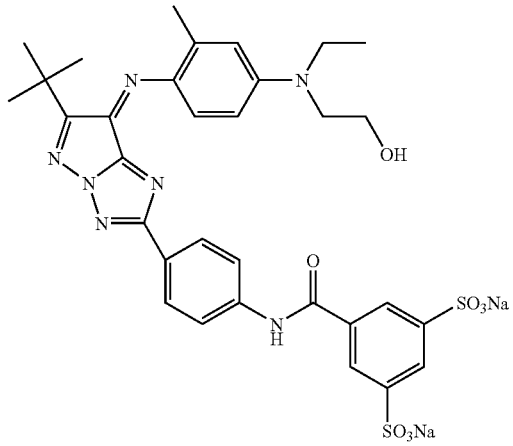

-continued
(7)
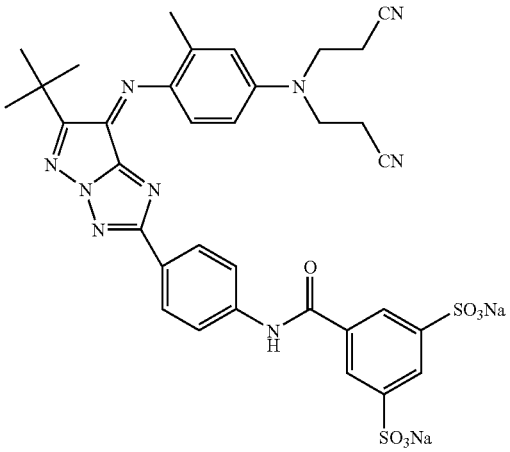
(8)
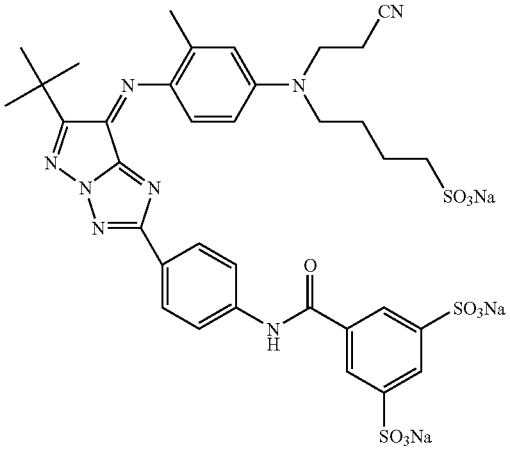
(9)
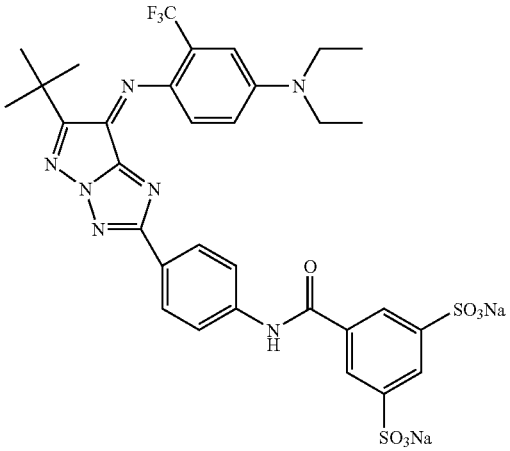
-continued
(10)
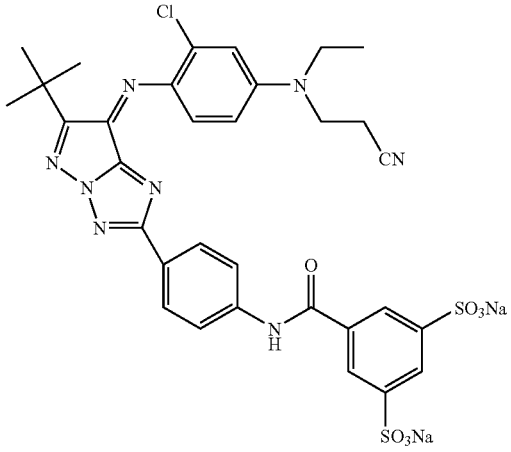
(11)
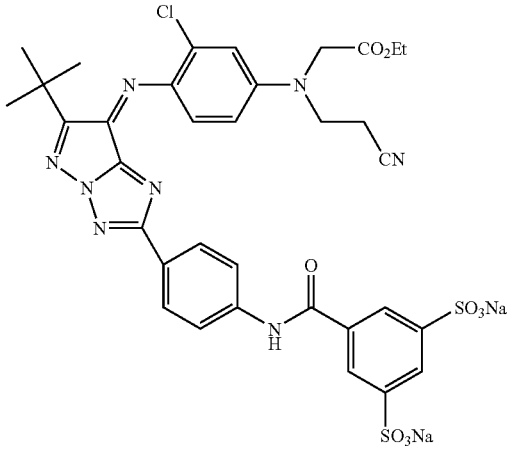
(12)
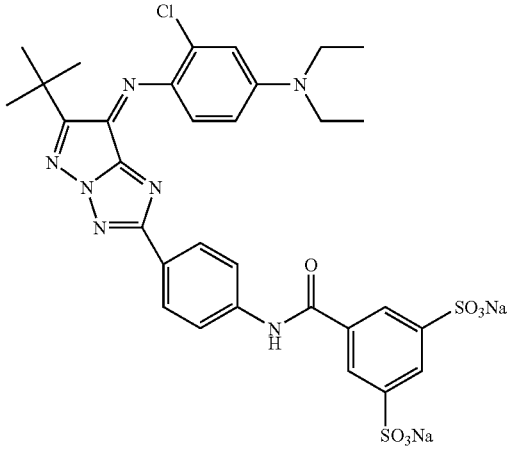

-continued
(13)
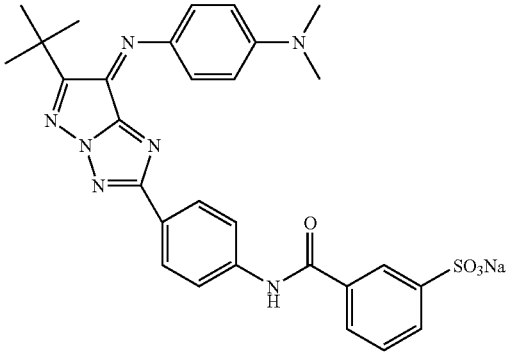
(14)
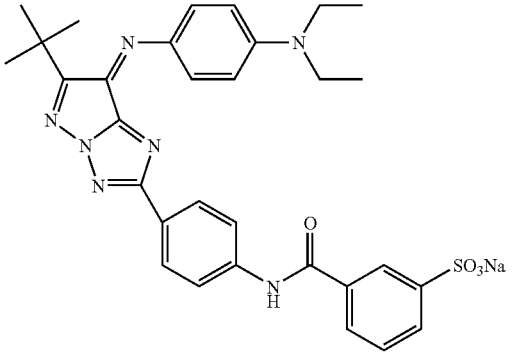
(15)
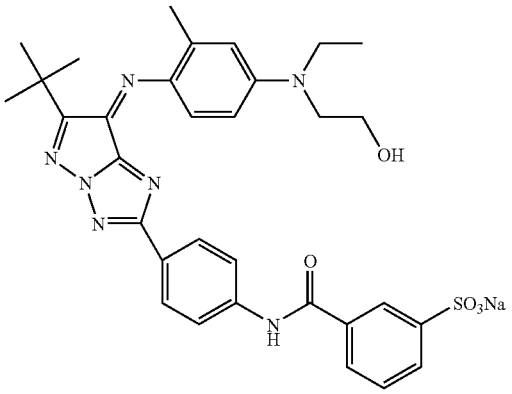
(16)
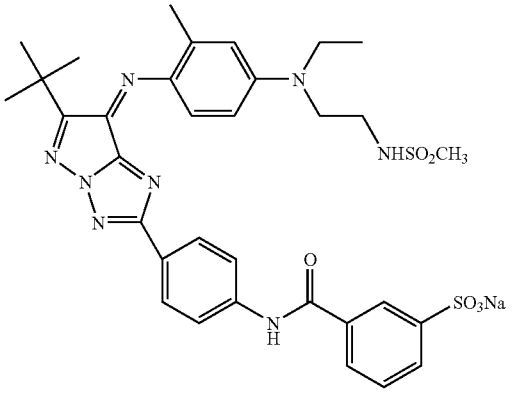
-continued
(17)
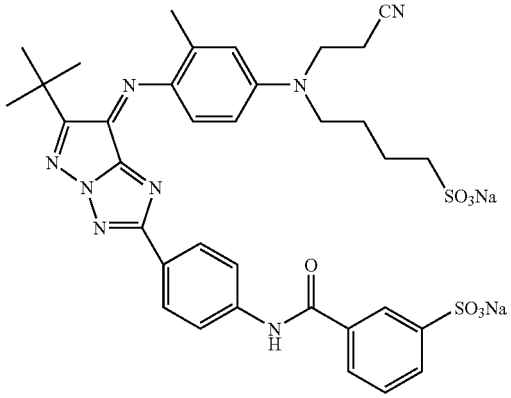
(18)
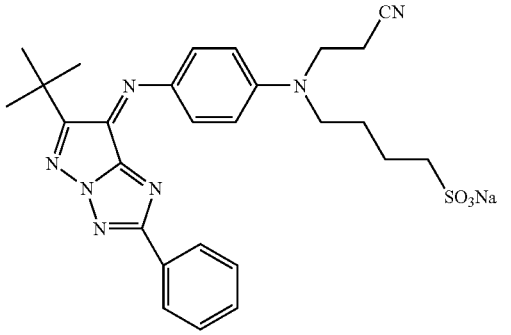
(19)
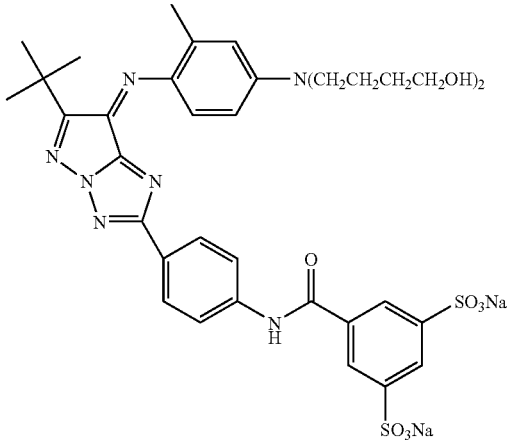

-continued
(20)
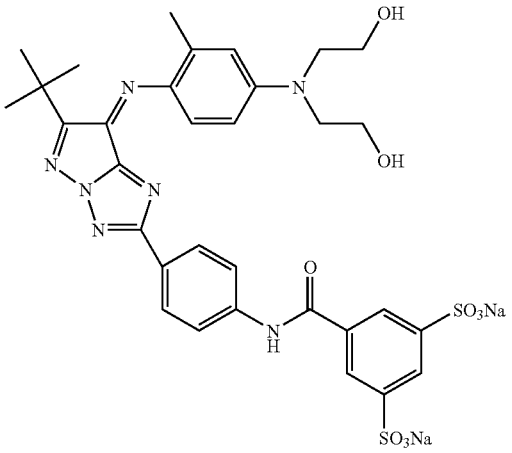
(21)
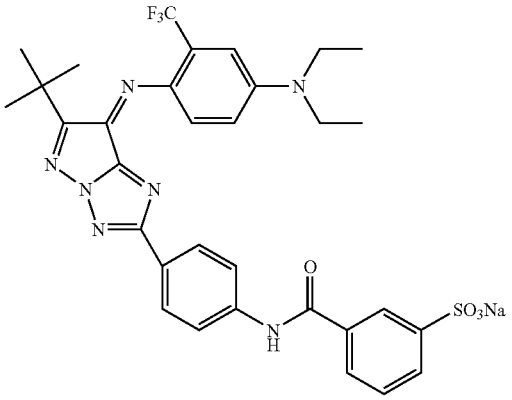
(22)
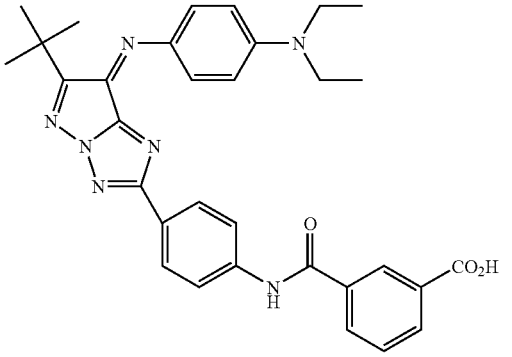
-continued
(23)
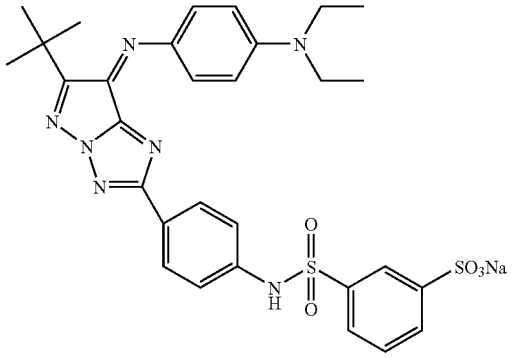
(24)
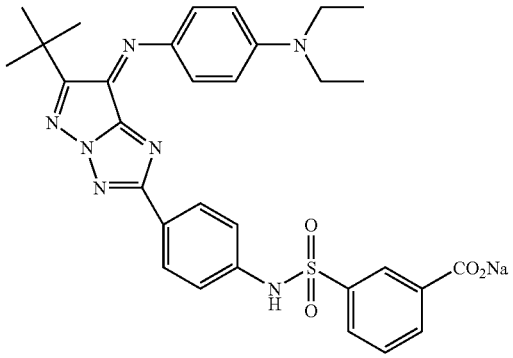
(25)
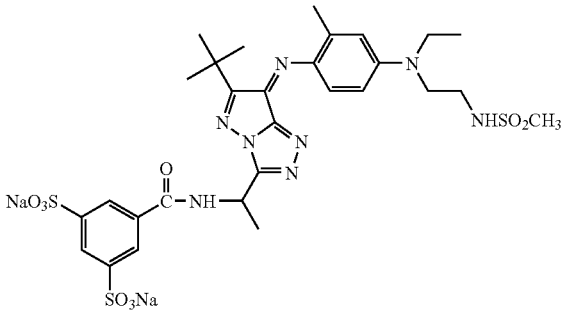
(26)
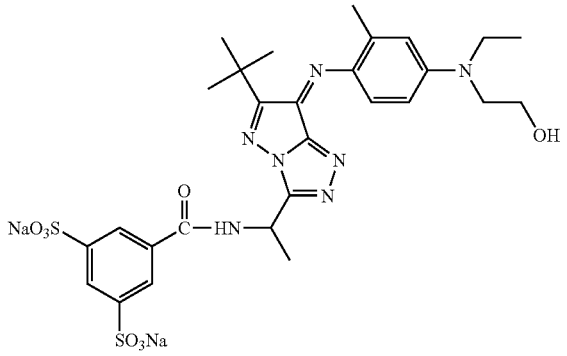

-continued
(27)
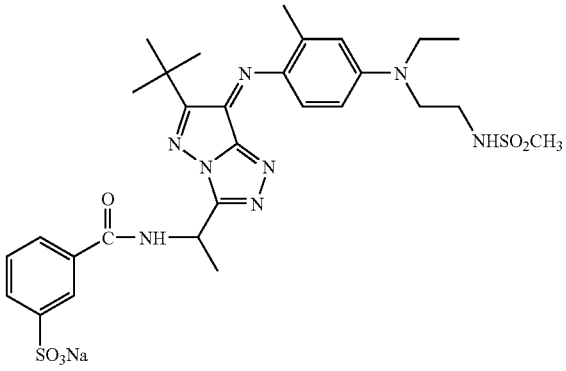
(28)
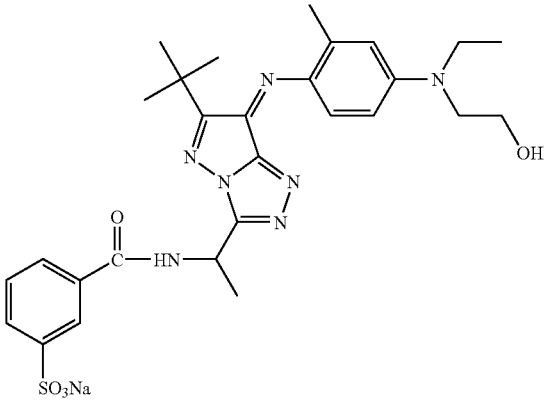
(29)
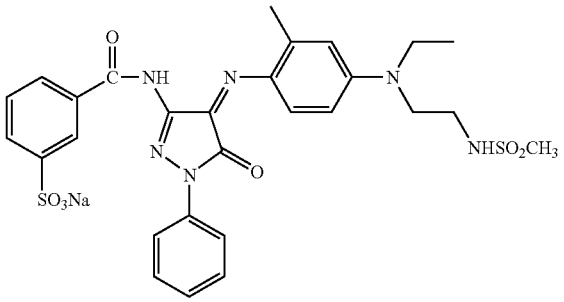
(30)
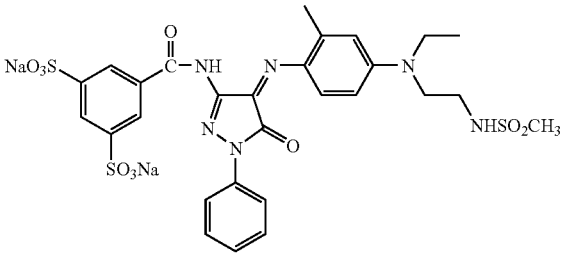
-continued
(31)
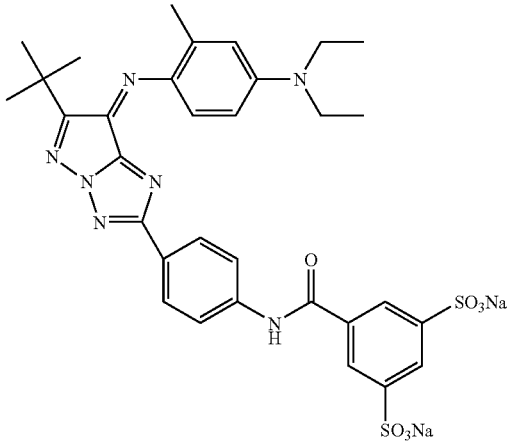
(32)
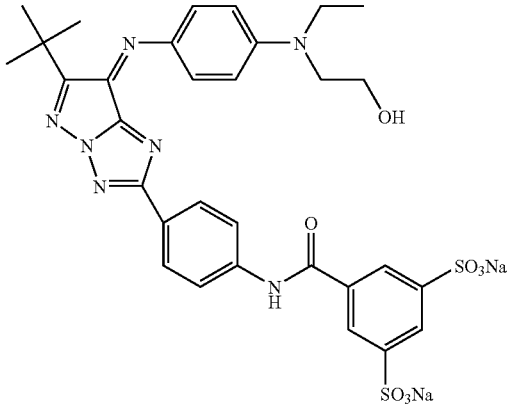
(33)
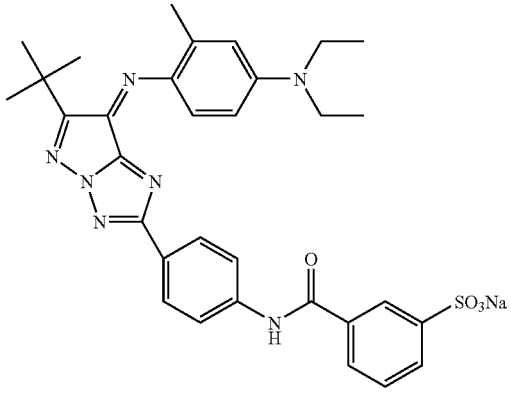

-continued
(34)
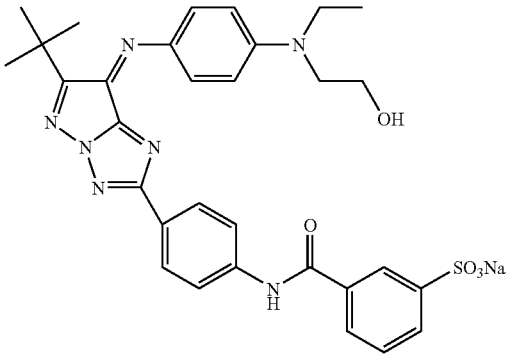
(35)
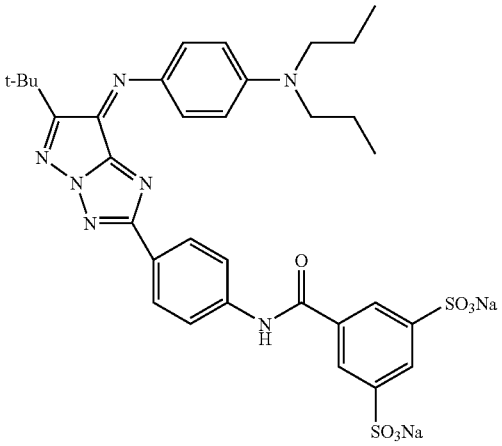
(36)
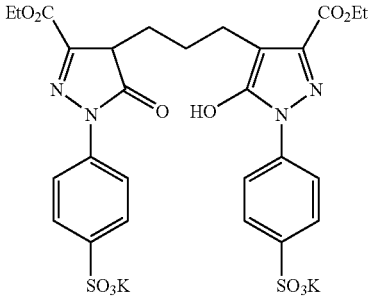
Further the following Dye Nos. 1 to 65 are also described as preferred examples.
Dye 1
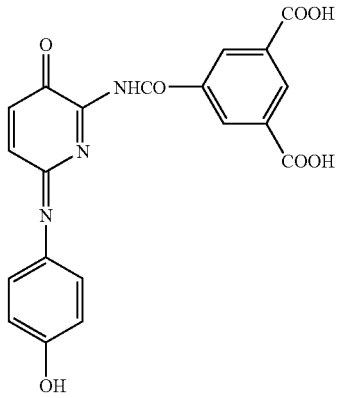
Dye 2
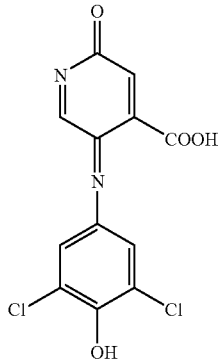
Dye 3
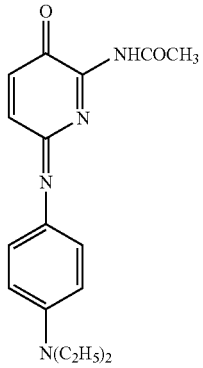
Dye 4
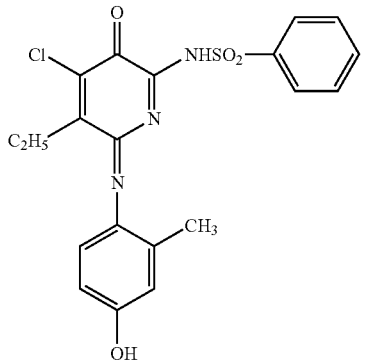

-continued
Dye 5
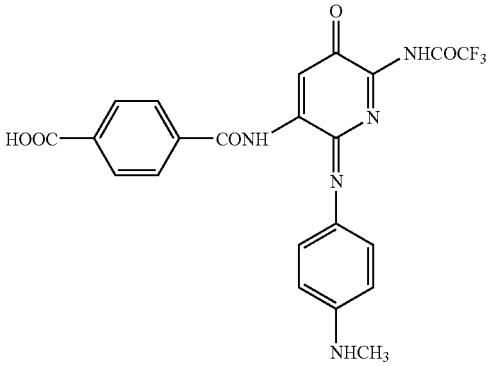
Dye 6
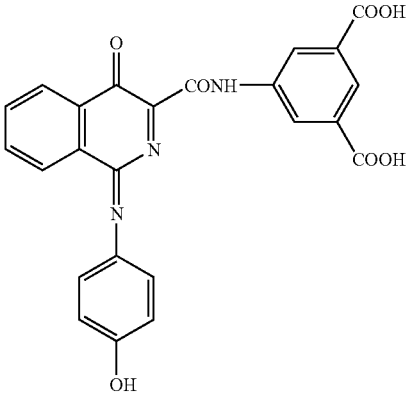
Dye 7
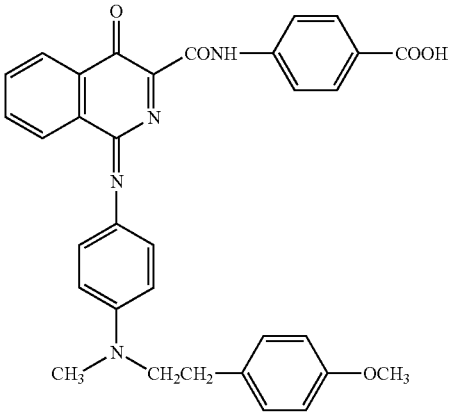
Dye 8
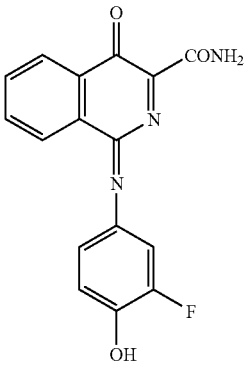
-continued
Dye 9
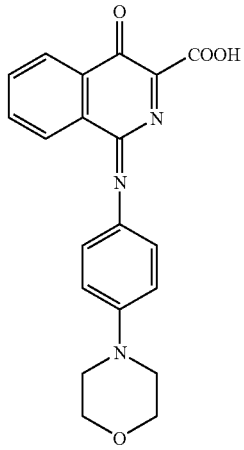
Dye 10
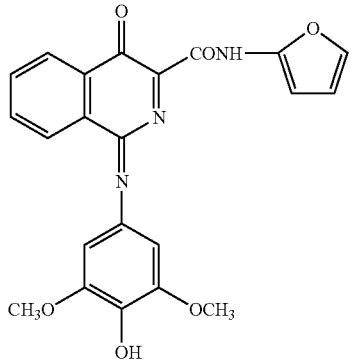
Dye 11
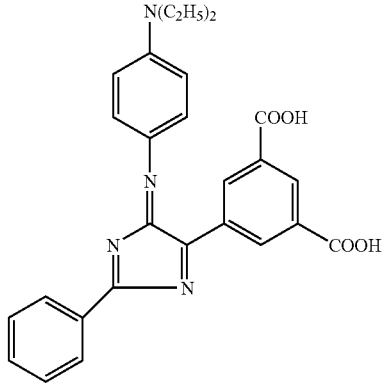
Dye 12
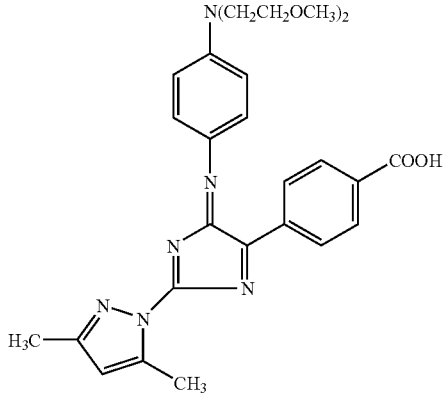

-continued
Dye 13
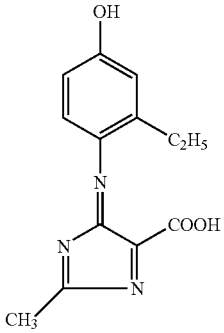
Dye 14
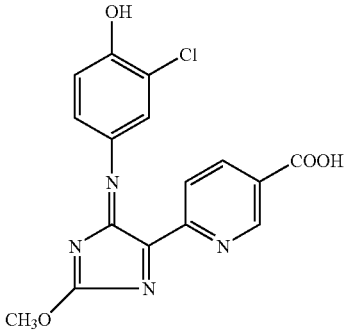
Dye 15
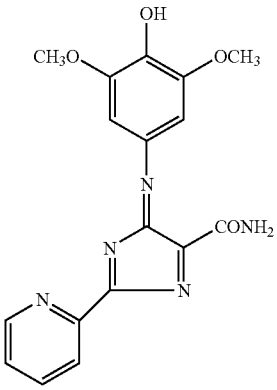
Dye 16
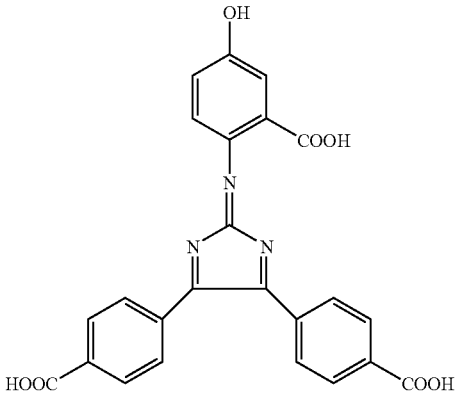
-continued
Dye 17
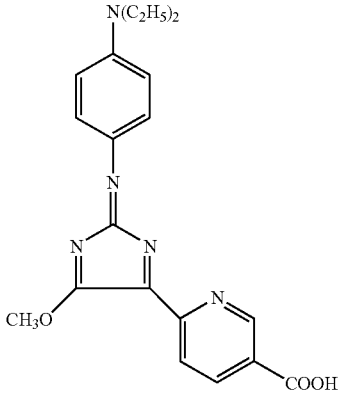
Dye 18
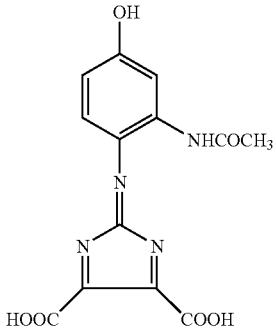
Dye 19
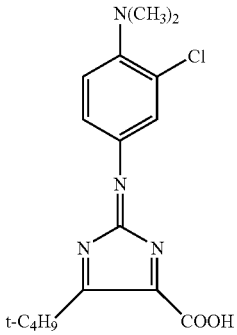
Dye 20
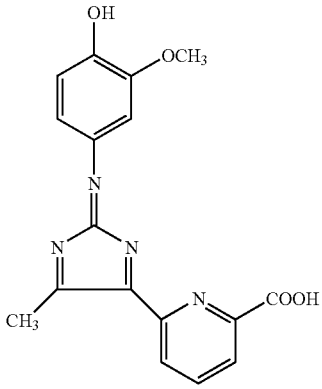

-continued
Dye 21
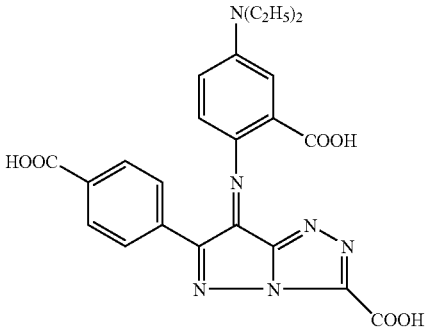
Dye 22
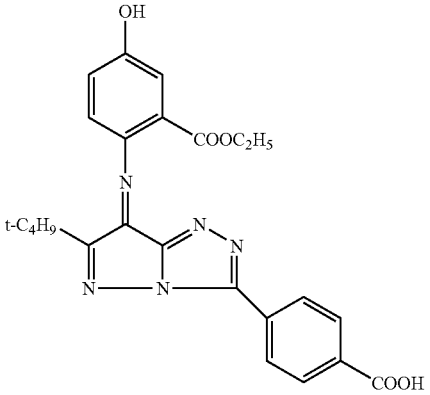
Dye 23
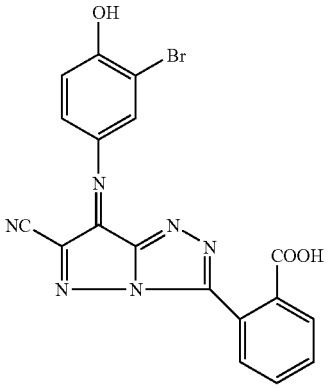
Dye 24
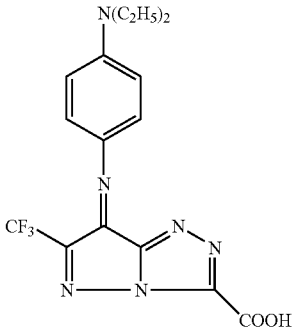
-continued
Dye 25
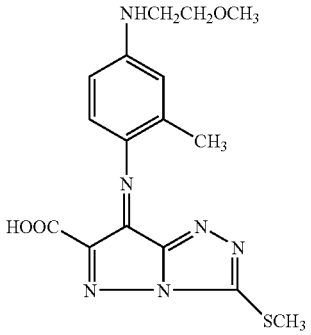
Dye 26
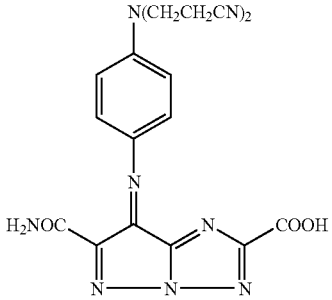
Dye 27
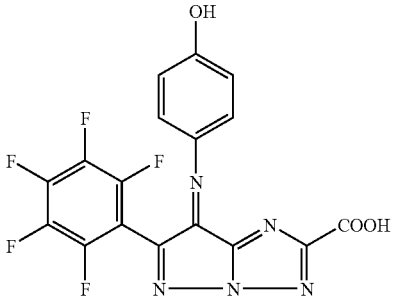
Dye 28
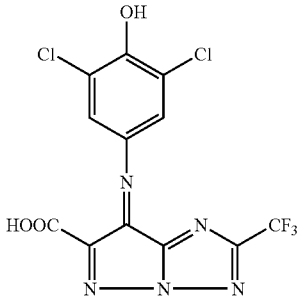
Dye 29
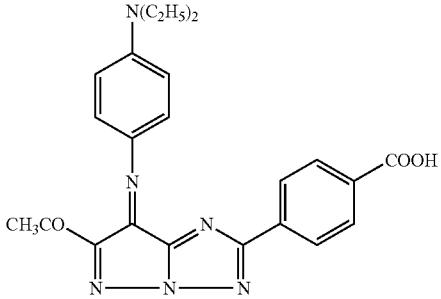

-continued
Dye 30
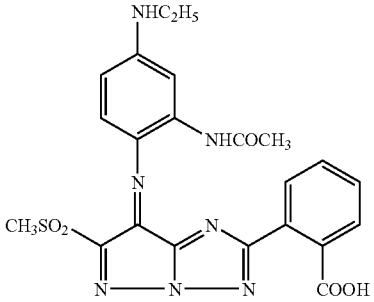
Dye 31
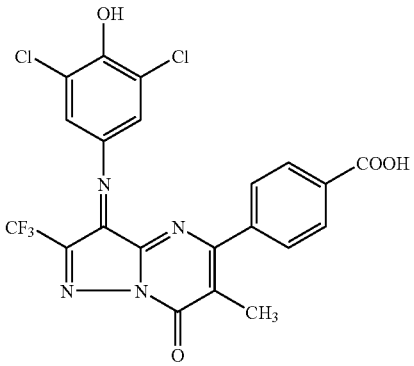
Dye 32
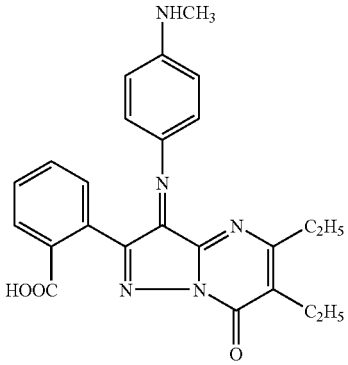
Dye 33
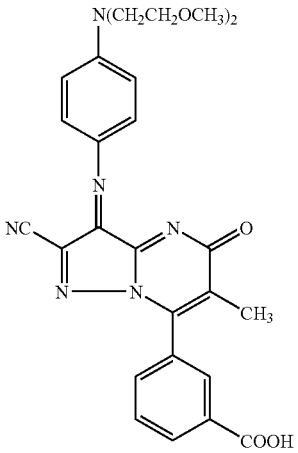
-continued
Dye 34
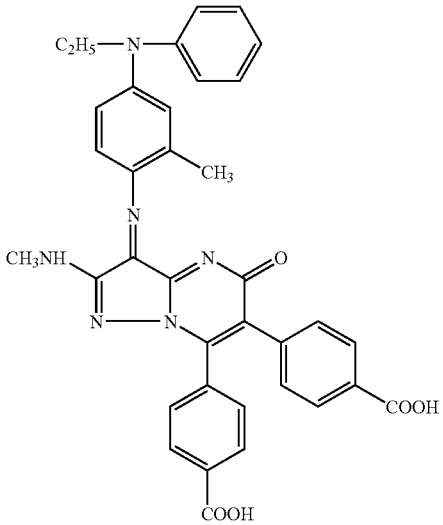
Dye 35
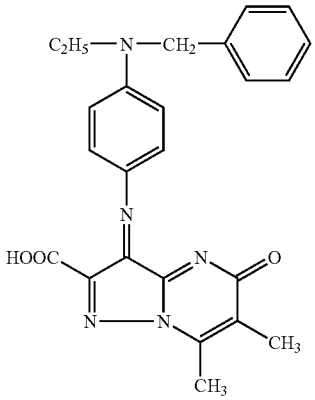
Dye 36
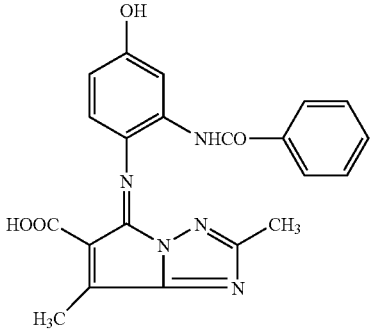

-continued
Dye 37
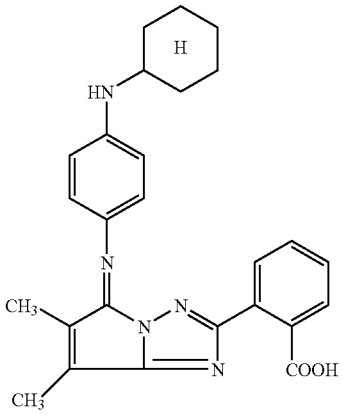
Dye 38
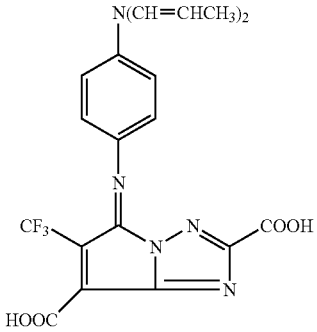
Dye 39
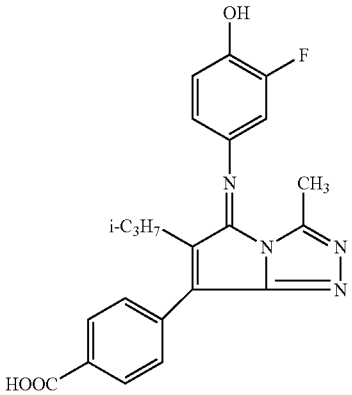
Dye 40
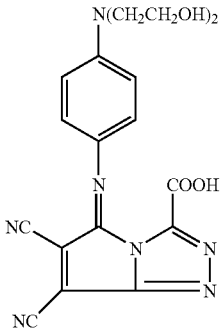
-continued
Dye 41
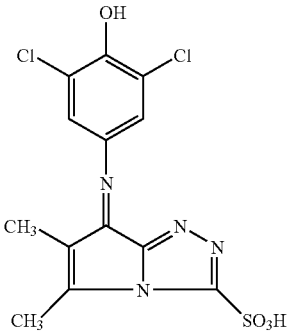
Dye 42
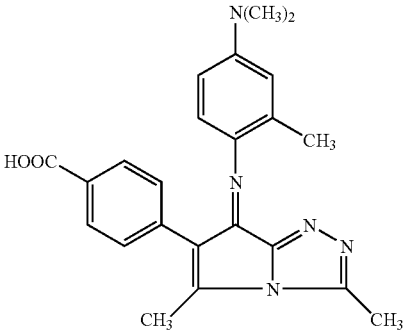
Dye 43
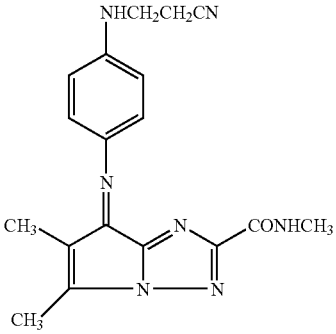
Dye 44
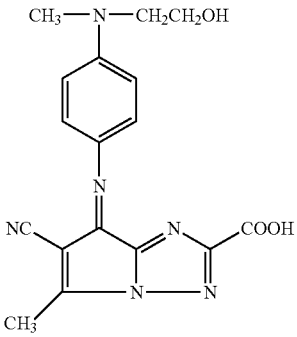

-continued
Dye 45
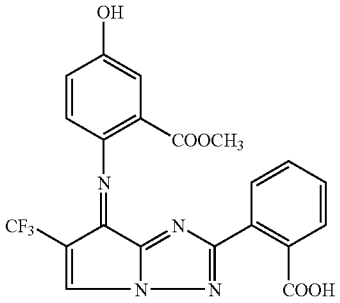
Dye 46
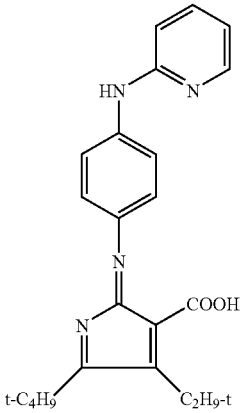
Dye 47
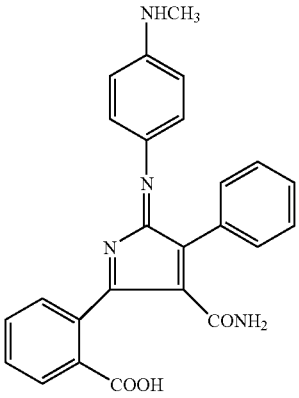
Dye 48
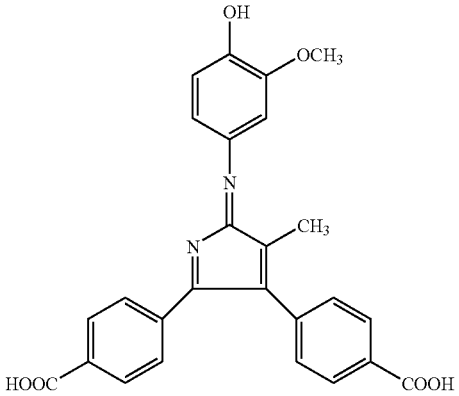
-continued
Dye 49
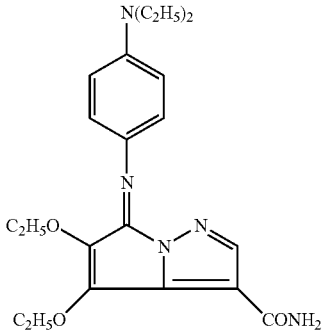
Dye 50
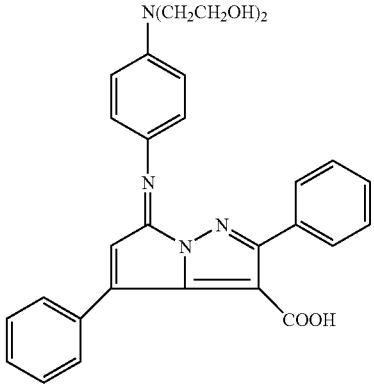
Dye 51
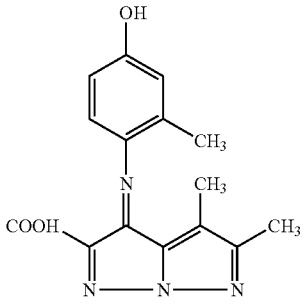
Dye 52
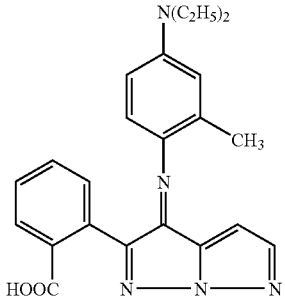

-continued
Dye 53
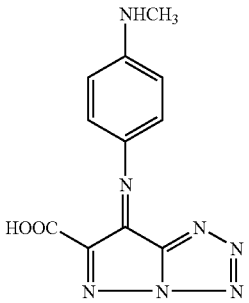
Dye 54
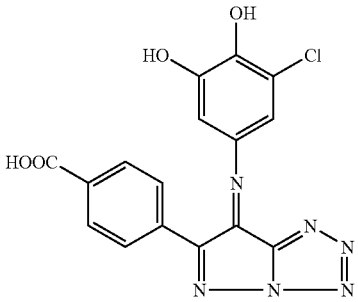
Dye 55
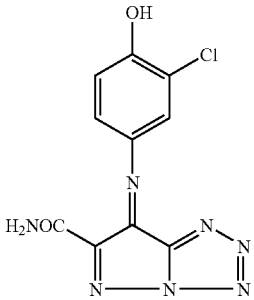
Dye 56
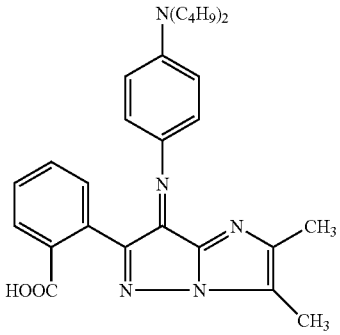
Dye 57
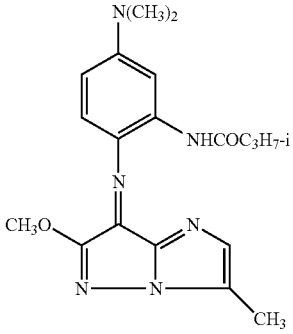
-continued
Dye 58
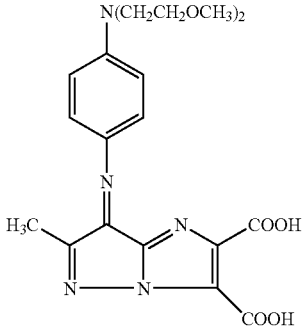
Dye 59
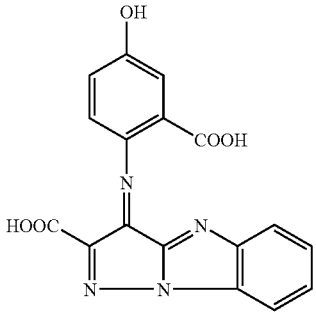
Dye 60
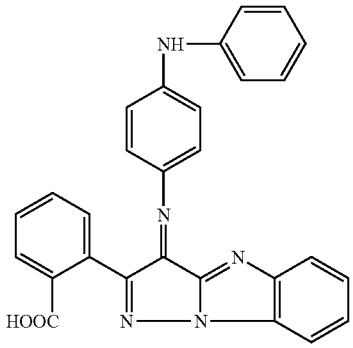
Dye 61
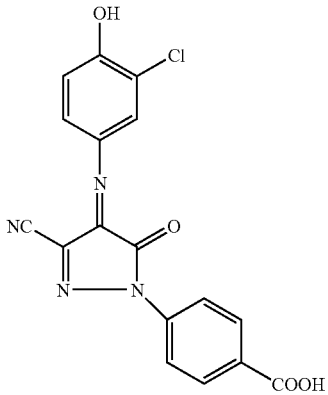

-continued

Dye 62

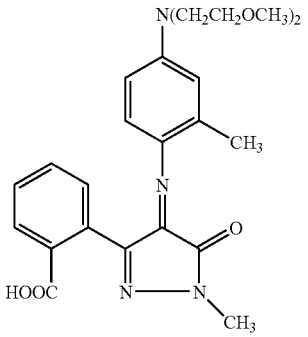

Dye 63

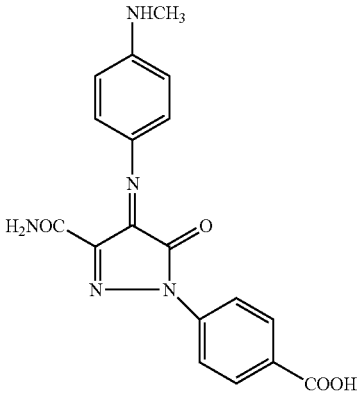

Dye 64

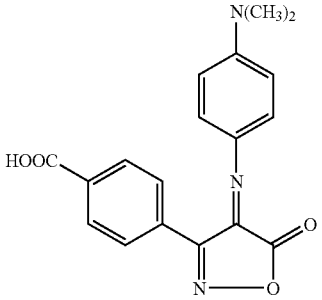

Dye 65

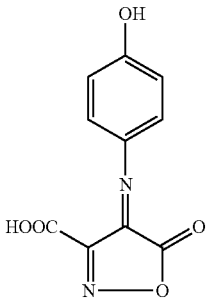

The dyes represented by the aforementioned formula (I) can be synthesized based on the methods described in, for example, JP-A No. 4-126772, and JP-B No. 7-94180.

In addition, as azomethine dyes which can be used in the present invention, there can be mentioned the compounds of formula (I) described in JP-A No. 4-247449, formula (I) described in JP-A No. 63-145281, formula (1) described in JP-A No. 2002-256164, formula (I) described in JP-A No. 3-244593, formula (I) described in JP-A No. 3-7386, formulae (II), (III), and (IV) described in JP-A No. 2-252578, formulae (I), and (II) described in JP-A No. 4-359967, formulae (I), and (II) described in JP-A No. 4-359968 and the like. Dyes described in these patents can be also included as specific compounds.

The dyes for this purpose may be added to any of the layers, but more preferred is to add them in the non-photosensitive layer on the image forming layer side, or in the back side.

The photothermographic material of the invention is preferably a so-called one-side photosensitive material, which comprises at least one layer of a image forming layer containing silver halide emulsion on one side of the support, and a back layer on the other side.

4) Matting Agent

A matting agent may be preferably added to the photothermographic material of the invention in order to improve transportability. Description on the matting agent can be found in paragraphs Nos. 0126 to 0127 of JP-A No. 11-65021. The addition amount of the matting agent is preferably in a range from 1 mg/m$^2$ to 400 mg/m$^2$, and more preferably, from 5 mg/m$^2$ to 300 mg/m$^2$, with respect to the coating amount per 1 m$^2$ of the photothermographic material.

There is no particular restriction on the shape of the matting agent usable in the invention and it may fixed form or non-fixed form. Preferred is to use those having fixed form and globular shape. Mean particle size is preferably in a range of from 0.5 μm to 10 μm, more preferably, from 1.0 μm to 8.0 μm, and further preferably, from 2.0 μm to 6.0 μm. Furthermore, the particle size distribution of the matting agent is preferably set as such that the variation coefficient may become 50% or lower, more preferably, 40% or lower, and further preferably, 30% or lower. The variation coefficient, herein, is defined by (the standard deviation of particle diameter)/(mean diameter of the particle)×100. Furthermore, it is preferred to use by blending two types of matting agents having low variation coefficient and the ratio of their mean particle sizes is more than 3.

The matt degree on the image forming layer side is not restricted as far as star-dust trouble occurs, but the matt degree of 30 seconds to 2000 seconds is preferred, particularly preferred, 40 seconds to 1500 seconds as Beck's smoothness. Beck's smoothness can be calculated easily, using Japan Industrial Standared (JIS) P8119 "The method of testing Beck's smoothness for papers and sheets using Beck's test apparatus", or TAPPI standard method T479.

The matt degree of the back layer in the invention is preferably in a range of 1200 seconds or less and 10 seconds or more; more preferably, 800 seconds or less and 20 seconds or more; and further preferably, 500 seconds or less and 40 seconds or more when expressed by Beck's smoothness.

In the present invention, a matting agent is preferably contained in an outermost layer, in a layer which can function as an outermost layer, or in a layer nearer to outer surface, and also preferably is contained in a layer which can function as a so-called protective layer.

5) Polymer Latex

A polymer latex is preferably used in the surface protective layer and the back layer of the photothermographic material in the present invention. As such polymer latex, descriptions can be found in "Gosei Jushi Emulsion (Synthetic resin emulsion)" (Taira Okuda and Hiroshi Inagaki, Eds., published by Kobunshi Kankokai (1978)), "Gosei Latex no Oyo (Application of synthetic latex)" (Takaaki Sugimura, Yasuo Kataoka, Soichi Suzuki, and Keiji Kasahara, Eds., published by Kobunshi Kankokai (1993)), and "Gosei Latex no Kagaku (Chemistry of synthetic latex)" (Soichi Muroi, published by Kobunshi Kankokai (1970)). More specifically, there can be mentioned a latex of methyl methacrylate (33.5% by weight)/ethyl acrylate (50% by weight)/methacrylic acid (16.5% by weight) copolymer, a latex of methyl methacrylate (47.5% by weight)/butadiene (47.5% by weight)/itaconic acid (5% by weight) copolymer, a latex of ethyl acrylate/methacrylic acid copolymer, a latex of methyl methacrylate (58.9% by weight)/2-ethylhexyl acrylate (25.4% by weight)/styrene (8.6% by weight)/2-hydroethyl methacrylate (5.1% by weight)/acrylic acid (2.0% by weight) copolymer, a latex of methyl methacrylate (64.0% by weight)/styrene (9.0% by weight)/butyl acrylate (20.0% by weight)/2-hydroxyethyl methacrylate (5.0% by weight)/acrylic acid (2.0% by weight) copolymer, and the like.

Furthermore, as the binder for the surface protective layer, there can be applied the technology described in paragraph Nos. 0021 to 0025 of the specification of JP-A No. 2000-267226, and the technology described in paragraph Nos. 0023 to 0041 of the specification of JP-A No. 2000-19678. The polymer latex in the surface protective layer preferably is contained in an amount of 10% by weight to 90% by weight, particularly preferably, of 20% by weight to 80% by weight of the total weight of binder.

6) Surface pH

The surface pH of the photothermographic material according to the invention preferably yields a pH of 7.0 or lower, and more preferably, 6.6 or lower, before thermal developing process. Although there is no particular restriction concerning the lower limit, the lower limit of pH value is about 3, and the most preferred surface pH range is from 4 to 6.2. From the viewpoint of reducing the surface pH, it is preferred to use an organic acid such as phthalic acid derivative or a non-volatile acid such as sulfuric acid, or a volatile base such as ammonia for the adjustment of the surface pH. In particular, ammonia can be used favorably for the achievement of low surface pH, because it can easily vaporize to remove it before the coating step or before applying thermal development.

It is also preferred to use a non-volatile base such as sodium hydroxide, potassium hydroxide, lithium hydroxide, and the like, in combination with ammonia. The method of measuring surface pH value is described in paragraph No. 0123 of the specification of JP-A No. 2000-284399.

7) Hardener

A hardener may be used in each of image forming layer, protective layer, back layer, and the like. As examples of the hardener, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salt of 2,4-dichloro-6-hydroxy-s-triazine, N,N-ethylene bis(vinylsulfonacetamide), and N,N-propylene bis(vinylsulfonacetamide), polyvalent metal ions described in page 78 of the above literature and the like, polyisocyanates described in U.S. Pat. No. 4,281,060, JP-A No. 6-208193 and the like, epoxy compounds of U.S. Pat. No. 4,791,042 and the like, and vinyl sulfone compounds of JP-A No. 62-89048 and the like.

The hardener is added as a solution, and the solution is added to the coating solution for protective layer 180 minutes before coating to just before coating, and preferably 60 minutes before to 10 seconds before coating. However, so long as the effect of the invention is sufficiently exhibited, there is no particular restriction concerning the mixing method and the conditions of mixing. As specific mixing methods, there can be mentioned a method of mixing in the tank, in which the average stay time calculated from the flow rate of addition and the feed rate to the coater is controlled to yield a desired time, or a method using static mixer as described in Chapter 8 of N. Harnby, M. F. Edwards, A. W. Nienow (translated by Koji Takahashi) "Ekitai Kongo Gijutu (Liquid Mixing Technology)" (Nikkan Kogyo Shinbunsha, 1989), and the like.

8) Surfactant

As for the surfactant, the solvent, the support, antistatic agent and the electrically conductive layer, and the method for obtaining color images applicable in the invention, there can be used those disclosed in paragraph Nos. 0132, 0133, 0134, 0135, and 0136, respectively, of JP-A No. 11-65021.

In the invention, it is preferred to use a fluorocarbon surfacant. Specific examples of fluorocarbon surfacants can be found in those described in JP-A Nos. 10-197985, 2000-19680, and 2000-214554. Polymer fluorocarbon surfacants described in JP-A 9-281636 can be also used preferably. For the photothermographic material in the invention, the fluorocarbon surfacants described in JP-A Nos. 2002-82411, 2003-57780, and 2001-264110 are preferably used. Especially, the usage of the fluorocarbon surfacants described in JP-A Nos. 2003-57780 and 2001-264110 in an aqueous coating solution is preferred viewed from the standpoint of capacity in static control, stability of the coating side state and sliding facility. The fluorocarbon surfactant described in JP-A No. 2001-264110 is mostly preferred because of high capacity in static control and that it needs small amount to use.

According to the invention, the fluorocarbon surfactant can be used on either side of image forming layer side or back layer side, but is preferred to use on the both sides. Further, it is particularly preferred to use in combination with electrically conductive layer including metal oxides described below. In this case the amount of the fluorocarbon surfactant on the side of the electrically conductive layer can be reduced or removed.

The addition amount of the fluorocarbon surfactant is preferably in a range of from 0.1 mg/m$^2$ to 100 mg/m$^2$ on each side of image forming layer and back layer, more preferably from 0.3 mg/m$^2$ to 30 mg/m$^2$, and further preferably from 1 mg/m$^2$ to 10 mg/m$^2$. Especially, the fluorocarbon surfactant described in JP-A No. 2001-264110 is effective, and used preferably in a range of from 0.01 mg/M$^2$ to 10 mg/M$^2$, and more preferably from 0.1 mg/M$^2$ to 5 mg/m$^2$.

9) Antistatic Agent

The photothermographic material of the invention preferably contains an electrically conductive layer including metal oxides or electrically conductive polymers. The antistatic layer may serve as an undercoat layer, or a back surface protective layer, and the like, but can also be placed specially. As an electrically conductive material of the antistatic layer, metal oxides having enhanced electric conductivity by the method of introducing oxygen defects or different types of metallic atoms into the metal oxides are preferably for use. Examples of metal oxides are preferably selected from ZnO, $TiO_2$ and $SnO_2$. As the combination of different types of atoms, preferred are ZnO combined with Al, or In; $SnO_2$ with Sb, Nb, P, halogen atoms, or the like; $TiO_2$ with Nb, Ta, or the like.

Particularly preferred for use is $SnO_2$ combined with Sb. The addition amount of different types of atoms is preferably in a range of from 0.01 mol % to 30 mol %, and more preferably, in a range of from 0.1 mol % to 10 mol %. The shape of the metal oxides can include, for example, spherical, needle-like, or tabular. The needle-like particles, with the rate of (the major axis)/(the minor axis) is 2.0 or more, and more preferably, 3.0 to 50, is preferred viewed from the standpoint of the electric conductivity effect. The metal oxides is used preferably in a range from 1 mg/$M^2$ to 1000 mg/$M^2$, more preferably from 10 mg/$M^2$ to 500 mg/$M^2$, and further preferably from 20 mg/$m^2$ to 200 mg/$M^2$.

The antistatic layer can be laid on either side of the image forming layer surface side or the back layer surface side, it is preferred to set between the support and the back layer.

Specific examples of the antistatic layer in the invention include described in paragraph Nos. 0135 of JP-A No. 11-65021, in JP-A Nos. 56-143430, 56-143431, 58-62646, and 56-120519, and in paragraph Nos. 0040 to 0051 of JP-A No. 11-84573, in U.S. Pat. No. 5,575,957, and in paragraph Nos. 0078 to 0084 of JP-A No. 11-223898.

10) Support

As the transparent support, preferably used is polyester, particularly, polyethylene terephthalate, which is subjected to heat treatment in the temperature range of from 130° C. to 185° C. in order to relax the internal strain caused by biaxial stretching and remaining inside the film, and to remove strain ascribed to heat shrinkage generated during thermal development. In the case of a photothermographic material for medical use, the transparent support may be colored with a blue dye (for instance, dye-1 described in the Example of JP-A No. 8-240877), or may be uncolored. As to the support, it is preferred to apply undercoating technology, such as water-soluble polyester described in JP-A No. 11-84574, a styrene-butadiene copolymer described in JP-A No. 10-186565, a vinylidene chloride copolymer described in JP-A No. 2000-39684, and the like. The moisture content of the support is preferably 0.5% by weight or less when coating for image forming layer and back layer is conducted on the support.

11) Other Additives

Furthermore, antioxidant, stabilizing agent, plasticizer, UV absorbent, or a film-forming promoting agent may be added to the photothermographic material. Each of the additives is added to either of the image forming layer or the non-photosensitive layer. Reference can be made to WO No. 98/36322, EP No. 803764A1, JP-A Nos. 10-186567 and 10-18568, and the like.

12) Coating Method

The photothermographic material of the invention may be coated by any method. More specifically, various types of coating operations including extrusion coating, slide coating, curtain coating, immersion coating, knife coating, flow coating, or an extrusion coating using the type of hopper described in U.S. Pat. No. 2,681,294 are used. Preferably used is extrusion coating or slide coating described in pages 399 to 536 of Stephen F. Kistler and Petert M. Shweizer, "LIQUID FILM COATING" (Chapman & Hall, 1997), and most preferably used is slide coating. Example of the shape of the slide coater for use in slide coating is shown in FIG. 11*b*. 1, page 427, of the same literature. If desired, two or more layers can be coated simultaneously by the method described in pages 399 to 536 of the same literature, or by the method described in U.S. Pat. No. 2,761,791 and British Patent No. 837095. Particularly preferred in the invention is the method described in JP-A Nos. 2001-194748, 2002-153808, 2002-153803, and 2002-182333.

The coating solution for the image forming layer in the invention is preferably a so-called thixotropic fluid. For the details of this technology, reference can be made to JP-A No. 11-52509. Viscosity of the coating solution for the image forming layer in the invention at a shear velocity of $0.1S^{-1}$ is preferably from 400 mPa·s to 100,000 mPa·s, and more preferably, from 500 mPa·s to 20,000 mPa·s. At a shear velocity of $1000S^{-1}$, the viscosity is preferably from 1 mPa·s to 200 mPa·s, and more preferably, from 5 mPa·s to 80 mPa·s.

In the case of mixing two types of liquids on preparing the coating solution of the invention, known in-line mixer and in-plant mixer can be used favorably. Preferred in-line mixer of the invention is described in JP-A No. 2002-85948, and the in-plant mixer is described in JP-A No. 2002-90940.

The coating solution of the invention is preferably subjected to defoaming treatment to maintain the coated surface in a fine state. Preferred defoaming treatment method in the invention is described in JP-A No. 2002-66431.

In the case of applying the coating solution of the invention to the support, it is preferred to perform diselectrification in order to prevent the adhesion of dust, particulates, and the like due to charge up. Preferred example of the method of diselectrification for use in the invention is described in JP-A No. 2002-143747.

Since a non-setting coating solution is used for the image forming layer in the invention, it is important to precisely control the drying wind and the drying temperature. Preferred drying method for use in the invention is described in detail in JP-A Nos. 2001-194749 and 2002-139814.

In order to improve the film-forming properties in the photothermographic material of the invention, it is preferred to apply a heat treatment immediately after coating and drying. The temperature of the heat treatment is preferably in a range of from 60° C. to 100° C. at the film surface, and time period for heating is preferably in a range of from 1 second to 60 seconds. More preferably, heating is performed in a temperature range of from 70° C. to 90° C. at the film surface, and the time period for heating is from 2 seconds to 10 seconds. A preferred method of heat treatment for the invention is described in JP-A No. 2002-107872.

Furthermore, the producing methods described in JP-A Nos. 2002-156728 and 2002-182333 are favorably used in the invention in order to stably and continuously produce the photothermographic material of the invention.

The photothermographic material is preferably of monosheet type (i.e., a type which can form image on the photothermographic material without using other sheets such as an image-receiving material).

13) Wrapping Material

In order to suppress fluctuation from occurring on the photographic property during a preservation of the photothermographic material of the invention before thermal development, or in order to improve curling or winding tendencies when the photothermographic material is manufactured in a roll state, it is preferred that a wrapping material having low oxygen transmittance and/or vapor transmittance is used. Preferably, oxygen transmittance is 50 $mL \cdot atm^{-1} m^{-2} day^{-1}$ or lower at 25° C., more preferably, 10 $mL \cdot atm^{-1} m^{-2} day^{-1}$ or lower, and further preferably, 1.0 $mL \cdot atm^{-1} m^{-2} day^{-1}$ or lower. Preferably, vapor transmittance is 10 $g \cdot atm^{-1} m^{-2} day^{-1}$ or lower, more preferably, 5 $g \cdot atm^{-1} m^{-2} day^{-1}$ or lower, and further preferably, 1 $g \cdot atm^{-1} m^{-2} day^{-1}$ or lower.

As specific examples of a wrapping material having low oxygen transmittance and/or vapor transmittance, reference can be made to, for instance, the wrapping material described in JP-A Nos. 8-254793 and 2000-206653.

14) Other Applicable Techniques

Techniques which can be used for the photothermographic material of the invention also include those in EP No. 803764A1, EP No. 883022A1, WO No. 98/36322, JP-A Nos. 56-62648, 58-62644, JP-A Nos. 9-43766, 9-281637, 9-297367, 9-304869, 9-311405, 9-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, JP-A Nos. 2000-187298, 2000-10229, 2000-47345, 2000-206642, 2000-98530, 2000-98531, 2000-112059, 2000-112060, 2000-112104, 2000-112064, and 2000-171936.

(Image Forming Method)

1) Exposure

As laser beam according to the invention, He—Ne laser of red through infrared emission, red laser diode, or $Ar^+$, He—Ne, He—Cd laser of blue through green emission, or blue laser diode is used. Preferred laser is red to infrared laser diode and the peak wavelength of laser beam is 600 nm to 900 nm, preferably 620 nm to 850 nm. In recent years, development has been made particularly on a light source module with an SHG (a second harmonic generator) and a laser diode integrated into a single piece whereby a laser output apparatus in a short wavelength region has become popular. A blue laser diode enables high definition image recording and makes it possible to obtain an increase in recording density and a stable output over a long lifetime, which results in expectation of an expanded demand in the future. The peak wavelength of blue laser beam is preferably 300 nm to 500 nm, particularly preferably 400 nm to 500 nm.

A laser beam which oscillates in a longitudinal multiple modulation by a method such as high frequency superposition is also preferably employed.

2) Thermal development

Although any method may be used for this thermal development process, development of the photothermographic material of the invention is usually performed by elevating the temperature of the photothermographic material exposed imagewise. The temperature for development is preferably 80° C. to 250° C., more preferably 100° C. to 140° C., and further preferably 110° C. to 130° C. Time period for development is preferably 1 second to 60 seconds, more preferably 3 seconds to 30 seconds, and further preferably 5 seconds to 25 seconds.

As for the process for thermal development, either a drum type heater or a plate type heater may be used. However, a plate type heater process is preferred. A preferable process for thermal development by a plate type heater is a process described in JP-A No. 11-133572, which discloses a thermal developing device in which a visible image is obtained by bringing a photothermographic material with a formed latent image into contact with a heating means at a thermal developing portion, wherein the heating means comprises a plate heater, and a plurality of pressing rollers are oppositely provided along one surface of the plate heater, the thermal developing device is characterized in that thermal development is performed by passing the photothermographic material between the pressing rollers and the plate heater. It is preferred that the plate heater is divided into 2 to 6 portions, with the leading end having a lower temperature by 1° C. to 10° C. For example, 4 sets of plate heaters which can be independently subjected to the temperature control are used, and are controlled so that they respectively become 112° C., 119° C., 121° C., and 120° C. Such a process is also described in JP-A NO. 54-30032, which allows for passage of moisture and organic solvents included in the photothermographic material out of the system, and also allows for suppressing the change of shapes of the support of the photothermographic material upon rapid heating the photothermographic material.

It is preferable that the heater is more stably controlled, and a top part of one sheet of the photothermographic material is exposed and thermal development of the exposed portion is started before exposure of the end part of the sheet has completed, for downsizing the thermal developing apparatus and for shortening the time period for thermal development.

Preferred imager capable of rapid processing for use in the invention is described in, for example, JP-A Nos. 2002-289804 and 2002-287668.

3)System

Examples of a medical laser imager equipped with a light exposing portion and a thermal developing portion include Fuji Medical Dry Laser Imager FM-DP L and DRYPIX 7000. In connection with FM-DP L, description is found in Fuji Medical Review No. 8, pages 39 to 55. The described techniques may be applied as the laser imager for the photothermographic material of the invention. In addition, the present photothermographic material can be also applied as a photothermographic material for the laser imager used in "AD network" which was proposed by Fuji Film Medical Co., Ltd. as a network system accommodated to DICOM standard.

(Application of the Invention)

The photothermographic material of the invention is preferably used for photothermographic materials for use in medical imaging, photothermographic materials for use in industrial photographs, photothermographic materials for use in graphic arts, as well as for COM, through forming black and white images by silver imaging.

As described above, the compounds of the present invention can be preferably used for the photothermographic materials, and also applied for conventional, wet-processed silver halide photographic materials. These photographic materials contain various kinds of additives described above, but other additives besides those described above also can be used. Such additives are described in more detail in Research Disclosure, December 1978, Item 17643, Research Disclosure, November 1979, Item 18716, and Research Disclosure, December 1989, Item 308119. The corresponding portions are listed in the following Table.

| Item of Additives | RD Item 17643 | RD Item 18716 | RD Item 308119 |
|---|---|---|---|
| 1. Chemical Sensitizers | Page 23 | Page 648, right column | Page 996 |
| 2. Sensitivity Increasing Agents | The same as above | | |
| 3. Spectral Sensitizers and Supersensitzers | Pages 23 to 24 | Page 648, right column to page 649, right column | Page 996, right column to page 998, right column |
| 4. Brighteners | Page 24 | | Page 998, right column |
| 5. Antifoggants and Stabilizers | Pages 24 to 25 | Page 649, right column | Page 998, right column to page 1000, right column |

-continued

| Item of Additives | RD Item 17643 | RD Item 18716 | RD Item 308119 |
|---|---|---|---|
| 6. Light Absorbents, Filter Dyes, and Ultraviolet Absorbers | Pages 25 to 26 | Page 649, right column to page 650, left column | Page 1003, left column to page 1003, right column |
| 7. Anti-stain Agents | Page 25, right column | Page 650, left column to right column | Page 1002, right column |
| 8. Color Image Stabilizers | Page 25 | | Page 1002, right column |
| 9. Hardeners | Page 26 | Page 651, left column | Page 1004, right column to page 1005, left column |
| 10. Binders | Page 26 | The same as above | Page 1003, right column to page 1004, right column |
| 11. Plasticizers and Lubricants | Page 27 | Page 650, right column | Page 1006, left column to page 1006, right column |
| 12. Coating Aids and Surfactants | Pages 26 to 27 | The same as above | Page 1005, left column to page 1006, left column |
| 13. Antistatic Agents | Page 27 | The same as above | Page 1006, right column to page 1007, left column |
| 14. Matting Agents | | | Page 1008, left column to page 1009, left column |

Many technical means which are applicable for the emulsion and the photographic materials using the emulsion of the present invention, such as layer constitutions, silver halide emulsions, dye-forming couplers, functional couplers such as DIR (development inhibitor-releasing) couplers and the like, various kinds of additives and the like, and developing processes are described in EP No. 0565096A1 (issued Oct. 13, 1993) and its cited patents. The items and the corresponding portions are listed below.

1. Layer constitutions: page 61, lines 23 to 35, page 61, line 41 to page 62, line 14.
2. Intermediate layers: page 61, lines 36 to 40.
3. Interimage effect given layers: page 62, lines 15 to 18.
4. Silver halide and its halogen compositions: page 62, lines 21 to 25.
5. Silver halide grains and its crystal structures: page 62, lines 26 to 30.
6. Silver halide grain size: page 62, lines 31 to 34.
7. Emulsion preparing methods: page 62, lines 35 to 40.
8. Silver halide grain size distribution: page 62, lines 41 to 42.
9. Tabular silver halide grains: page 62, lines 43 to 46.
10. Inner structure of silver halide grains: page 62, lines 47 to 53.
11. Latent image formation types of emulsion: page 62, line 54 to page 63, line 5.
12. Emulsion physical ripening and chemical ripening: page 63, lines 6 to 9.
13. Mixed use of emulsion: page 63, lines 10 to 13.
14. Fogged emulsion: page 63, lines 14 to 31.
15. Non-photosensitive emulsion: page 63, lines 32 to 43.
16. Amounts of coated silver: page 63, lines 49 to 50.
17. Formaldehyde scavengers: page 64, lines 54 to 57.
18. Antifoggants containing mercapto group: page 65, lines 1 to 2.
19. Releasing agents for fogging agent and others: page 65, lines 3 to 7.
20. Dyes: page 65, lines 7 to 10.
21. Color couplers, general: page 65, lines 11 to 13.
22. Yellow, magenta, and cyan couplers: page 65, lines 14 to 25.
23. Polymeric couplers: page 65, lines 26 to 28.
24. Diffusible dye-forming couplers: page 65, lines 29 to 31.
25. Colored couplers: page 65, lines 32 to 38.
26. Functional couplers, general: page 65, lines 39 to 44.
27. Bleach accelerator-releasing couplers: page 65, lines 45 to 48.
28. Development accelerator-releasing couplers: page 65, lines 49 to 53.
29. Other development inhibitor-releasing (DIR) couplers: page 65, line 54 to page 66, line 4.
30. Coupler dispersing methods: page 66, lines 5 to 28.
31. Antiseptics and fungicides: page 66, lines 29 to 33.
32. Kinds of photosensitive material: page 66, lines 34 to 36.
33. Layer thickness of photosensitive layer and swelling rate: page 66, line 40 to page 67, line 1.
34. Back layers: page 67, lines 3 to 8.
35. Developing processes, general: page 67, lines 9 to 11.
36. Developing solutions and developing agents: page 67, lines 12 to 30.
37. Additives to developing solution: page 67, lines 31 to 44.
38. Reversal processing: page 67, lines 45 to 56.
39. Aperture ratio of processing solution: page 67, line 57 to page 68, line 12.
40. Time period for development: page 68, lines 13 to 15.
41. Bleach-fix, bleaching, and fixing: page 68, line 16 to page 69, line 31.
42. Automatic processors: page 69, lines 32 to 40.
43. Water-washing, rinse and stabilization: page 69, line 41 to page 70, line 18.
44. Replenishment of processing solution, and reuse: page 70, lines 19 to 23.
45. Developing agent incorporated materials: page 70, lines 24 to 33.
46. Development temperatures: page 70, lines 34 to 38.
47. Application for lens-combined film units: page 70, lines 39 to 41.

EXAMPLES

The present invention is specifically explained by way of Examples below, which should not be construed as limiting the invention thereto.

Example 1

(Preparation of PET Support)

(1) Film Manufacturing

PET having IV (intrinsic viscosity) of 0.66 (measured in phenol/tetrachloroethane=6/4 (weight ratio) at 25° C.) was obtained according to a conventional manner using terephthalic acid and ethylene glycol. The product was pelletized, dried at 130° C. for 4 hours, melted at 300° C. Thereafter, the mixture was extruded from a T-die and rapidly cooled to form a non-tentered film.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part was slit off, and both edges of the film were knurled. Then the film was rolled up at the tension of 4 kg/cm$^2$ to obtain a roll having the thickness of 175 μm.

(2) Surface Corona Discharge Treatment

Both surfaces of the support were treated at room temperature at 20 m/minute using Solid State Corona Discharge Treatment Machine Model 6KVA manufactured by Piller GmbH. It was proven that treatment of 0.375 kV A·minute/m$^2$ was executed, judging from the readings of current and voltage on that occasion. The frequency upon this treatment was 9.6 kHz, and the gap clearance between the electrode and dielectric roll was 1.6 mm.

(3) Undercoating

Preparation of Coating Solution for Undercoat Layer

| | |
|---|---|
| Formula (1) (for undercoat layer on the image forming layer side) | |
| Pesresin A-520 manufactured by Takamatsu Oil & Fat Co., Ltd. (30% by weight solution) | 59 g |
| Polyethyleneglycol monononylphenylether (average ethylene oxide number = 8.5) 10% by weight solution | 5.4 g |
| MP-1000 manufactured by Soken Chemical & Engineering Co., Ltd. (polymer fine particle, mean particle diameter of 0.4 μm) | 0.91 g |
| Distilled water | 935 mL |
| Formula (2) (for first layer on the backside) | |
| Styrene-butadiene copolymer latex (solid content of 40% by weight, styrene/butadiene weight ratio = 68/32) | 158 g |
| Sodium salt of 2,4-dichloro-6-hydroxy-S-triazine (8% by weight aqueous solution) | 20 g |
| 1% by weight aqueous solution of sodium laurylbenzenesulfonate | 10 mL |
| Distilled water | 854 mL |
| Formula (3) (for second layer on the backside) | |
| $SnO_2$/SbO (9/1 weight ratio, mean particle diameter of 0.038 μm, 17% by weight dispersion) | 84 g |
| Gelatin (10% by weight aqueous solution) | 89.2 g |
| METOLOSE TC-5 manufactured by Shin-Etsu Chemical Co., Ltd. (2% by weight aqueous solution) | 8.6 g |
| MP-1000 manufactured by Soken Chemical & Engineering Co., Ltd. | 0.01 g |
| 1% by weight aqueous solution of sodium dodecylbenzenesulfonate | 10 mL |
| NaOH (1% by weight) | 6 mL |
| Proxel (manufactured by Imperial Chemical Industries PLC) | 1 mL |
| Distilled water | 805 mL |

2) Undercoating

Both surfaces of the biaxially tentered polyethylene terephthalate support having the thickness of 175 μm were subjected to the corona discharge treatment as described above. Thereafter, the aforementioned formula (1) of the coating solution for the undercoat was coated on one surface (image forming layer side) with a wire bar so that the amount of wet coating became 6.6 mL/m$^2$ (per one side), and dried at 180° C. for 5 minutes. Then, the aforementioned formula (2) of the coating solution for the undercoat was coated on the reverse side (backside) with a wire bar so that the amount of wet coating became 5.7 mL/m$^2$, and dried at 180° C. for 5 minutes. Furthermore, the aforementioned formula (3) of the coating solution for the undercoat was coated on the reverse side (backside) with a wire bar so that the amount of wet coating became 7.7 mL/m$^2$, and dried at 180° C. for 6 minutes. Thus, an undercoated support was produced.

(Back Layer)

(1) Preparation of Coating Solution for Back Layer-1 to -4

A vessel was kept at 40° C., and thereto were added 40 g of gelatin, 20 g of monodispersed polymethyl methacrylate fine particles (mean particle size of 8 μm, standard deviation of particle diameter of 0.4), 0.1 g of benzisothiazolinone and 570 mL of water to allow gelatin to be dissolved. Additionally, 2.3 mL of a 1 mol/L aqueous sodium hydroxide solution, the following phthalocyanine aqueous solution according to the invention or comparative phthalocyanine solution at an addition amount shown in Table 1, 12 mL of a 3% by weight aqueous solution of poly(sodium styrenesulfonate), and 180 g of a 10% by weight solution of SBR latex were admixed. Just prior to the coating, 80 mL of a 4% by weight aqueous solution of N,N-ethylenebis(vinylsulfone acetamide) was admixed to give a coating solution for the back layer.

Back layer-1: Compound No. 2 of the invention (5% by weight)

Back layer-2: Compound No. 28 of the invention (5% by weight)

Back layer-3: Compound No. 61 of the invention (5% by weight)

Back Layer-4: Camparative Compound-B (5% by weight)

Comparative Compound-B: β-Position Substitution Product of Compound No. 2 of Formula (PC-1)

(2) Preparation of Coating Solution for Back Surface Protective Layer

A vessel was kept at 40° C., and thereto were added 40 g of gelatin, 35 mg of benzisothiazolinone and 840 mL of water to allow gelatin to be dissolved. Additionally, 5.8 mL of a 1 mol/L aqueous sodium hydroxide solution, liquid paraffin emulsion at 1.5 g equivalent to liquid paraffin, 10 mL of a 5% by weight aqueous solution of di(2-ethylhexyl) sodium sulfosuccinate, 20 mL of a 3% by weight aqueous solution of poly(sodium styrenesulfonate), 2.4 mL of a 2% by weight solution of a fluorocarbon surfactant (F-1), 2.4 mL of a 2% by weight solution of another fluorocarbon surfactant (F-2), and 32 g of a 19% by weight solution of methyl methacrylate/styrene/butyl acrylate/hydroxyethyl methacrylate/acrylic acid copolymer (weight ratio of the copolymerization of 57/8/28/5/2) latex were admixed. Just prior to the coating, 25 mL of a 4% by weight aqueous solution of N,N-ethylenebis(vinylsulfone acetamide) was admixed to give a coating solution for the back surface protective layer.

(3) Coating of Back Layer-1 to -4

The backside of the undercoated support as described above was subjected to simultaneous double coating so that the coating solution for the back layer gives the coating amount of gelatin of 1.7 g/m$^2$, and so that the coating solution for the back surface protective layer gives the coating amount of gelatin of 0.52 g/m$^2$, followed by drying to produce a back layer.

(Image Forming Layer, Intermediate Layer, and Surface Protective Layer)

1. Preparation of Materials for Coating

1) Silver Halide Emulsion

<<Preparation of Silver Halide Emulsion-1>>

To 1421 mL of distilled water was added 3.1 mL of a 1% by weight potassium bromide solution. Further, a liquid added with 3.5 mL of 0.5 mol/L sulfuric acid and 31.7 g of phthalated gelatin was kept at 30° C. while stirring in a stainless steel reaction vessel, and thereto were added total amount of: solution A prepared through diluting 22.22 g of silver nitrate by adding distilled water to give the volume of 95.4 mL; and solution B prepared through diluting 15.3 g of potassium bromide and 0.8 g of potassium iodide with distilled water to give the volume of 97.4 mL, over 45 seconds at a constant flow rate. Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 317.5 mL and a solution D prepared through diluting 44.2 g of potassium bromide and 2.2 g of potassium iodide with distilled water to give the volume of 400 mL were added. A controlled double jet method was executed through adding total amount of the solution C at a constant flow rate over 20 minutes, accompanied by adding the solution D while maintaining the pAg at 8.1. Potassium hexachloroiridate (III) was added in its entirely to give $1\times10^{-4}$ mol per 1 mol of silver, at 10 minutes post initiation of the addition of the solution C and the solution D. Moreover, at 5 seconds after completing the addition of the solution C, a potassium hexacyanoferrate (II) in an aqueous solution was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 8.0.

The above-described silver halide dispersion was kept at 38° C. with stirring, and thereto was added 5 mL of a 0.34% by weight methanol solution of 1,2-benzisothiazoline-3-one, followed by elevating the temperature to 47° C. at 40 minutes thereafter. At 20 minutes after elevating the temperature, sodium benzene thiosulfonate in a methanol solution was added at $7.6\times10^{-5}$ mol per 1 mol of silver. At additional 5 minutes later, a tellurium sensitizer C in a methanol solution was added at 2.9×10−4 mol per 1 mol of silver and subjected to ripening for 91 minutes. Thereafter, a methanol solution of a spectral sensitizing dye A and a spectral sensitizing dye B with a molar ratio of 3:1 was added thereto at $1.2\times10^{-3}$ mol in total of the spectral sensitizing dye A and B per 1 mol of silver. At 1 minute later, 1.3 mL of a 0.8% by weight methanol solution of N,N'-dihydroxy-N",N"-diethylmelamine was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureidophenyl)-5-mercaptotetrazole in an aqueous solution at $8.5\times10^{-3}$ mol per 1 mol of silver were added to produce a silver halide emulsion-1.

Grains in thus prepared silver halide emulsion were silver iodobromide grains having a mean equivalent spherical diameter of 0.042 μm, a variation coefficient of an equivalent spherical diameter distribution of 20%, which uniformly include iodine at 3.5 mol %. Grain size and the like were determined from the average of 1000 grains using an electron microscope. The [100] face ratio of these grains was found to be 80% using a Kubelka-Munk method.

<<Preparation of Silver Halide Emulsion-2>>

Preparation of silver halide emulsion-2 was conducted in a similar manner to the process in the preparation of the silver halide emulsion-1 except that: the temperature of the liquid upon the grain forming process was altered from 30° C. to 47° C.; the solution B was changed to that prepared through diluting 15.9 g of potassium bromide with distilled water to give the volume of 97.4 mL; the solution D was changed to that prepared through diluting 45.8 g of potassium bromide with distilled water to give the volume of 400 mL; time period for adding the solution C was changed to 30 minutes; and potassium hexacyanoferrate (II) was deleted. The precipitation/ desalting/water washing/dispersion were carried out similarly to the silver halide emulsion-i. Furthermore, the spectral sensitization, chemical sensitization, and addition of 5-methyl-2-mercaptobenzimidazole and 1-phenyl-2-heptyl-5-mercapto-1,3,4-triazole was executed similarly to the emulsion-1 except that: the amount of the tellurium sensitizer C to be added was changed to $1.1\times10^{-4}$ mol per 1 mol of silver; the amount of the methanol solution of the spectral sensitizing dye A and a spectral sensitizing dye B with a molar ratio of 3:1 to be added was changed to $7.0\times10^{-4}$ mol in total of the spectral sensitizing dye A and the spectral sensitizing dye B per 1 mol of silver; the addition of 1-phenyl-2-heptyl-5-mercapto-1,3,4-triazole was changed to give $3.3\times10^{-3}$ mol per 1 mol of silver; and the addition of 1-(3-methylureidophenyl)-5-mercaptotetrazole was changed to give $4.7\times10^{-3}$ mol per 1 mol of silver, to produce silver halide emulsion-2. The grains in the silver halide emulsion-2 were pure cubic silver bromide grains having a mean equivalent spherical diameter of 0.080 μm and a variation coefficient of an equivalent spherical diameter distribution of 20%.

<<Preparation of Silver Halide Emulsion-3>>

Preparation of silver halide emulsion-3 was conducted in a similar manner to the process in the preparation of the silver halide emulsion-1 except that the temperature of the liquid upon the grain forming process was altered from 30° C. to 27° C. In addition, the precipitation/desalting/water washing/dispersion were carried out similarly to the silver halide emulsion-1. Silver halide emulsion-3 was obtained similarly to the emulsion-1 except that: the addition of the methanol solution of the spectral sensitizing dye A and the spectral sensitizing dye B was changed to the solid dispersion (aqueous gelatin solution) at a molar ratio of 1:1 with the amount to be added being $6\times10^{-3}$ mol in total of the spectral sensitizing dye A and spectral sensitizing dye B per 1 mol of silver; the amount of the tellurium sensitizer C to be added was changed to $5.2\times10^{-4}$ mol per 1 mol of silver; and bromoauric acid at $5\times10^{-4}$ mol per 1 mol of silver and potassium thiocyanate at $2\times10^{-3}$ mol per 1 mol of silver were added at 3 minutes following the addition of the tellurium sensitizer. The grains in the silver halide emulsion-3 were silver iodobromide grains having a mean equivalent spherical diameter of 0.034 μm and a variation coefficient of an equivalent spherical diameter distribution of 20%, which uniformly include iodine at 3.5 mol %.

<<Preparation of Mixed Emulsion A for Coating Solution>>

The silver halide emulsion-1 at 70% by weight, the silver halide emulsion-2 at 15% by weight, and the silver halide emulsion-3 at 15% by weight were dissolved, and thereto was added benzothiazolium iodide in a 1% by weight aqueous solution to give $7\times10^{-3}$ mol per 1 mol of silver. Further, water was added thereto to give the content of silver of 38.2 g per 1 kg of the mixed emulsion for a coating solution, and 1-(3-methylureidophenyl)-5-mercaptotetrazole was added to give 0.34 g per 1 kg of the mixed emulsion for a coating solution.

Further, as "a compound that can be one-electron-oxidized to provide a one-electron oxidation product, which releases one or more electrons", the compounds Nos. 1, 20, and 26 were added respectively in an amount of $2\times10^{-3}$ mol per 1 mol of silver contained in silver halide.

2) Preparations of Dispersion of Silver Salt of Fatty Acid

<Preparation of Recrystallized Behenic Acid>

Behenic acid manufactured by Henkel Co. (trade name: Edenor C22-85R) in an amount of 100 kg was admixed with 1200 kg of isopropyl alcohol, and dissolved at 50° C. The mixture was filtrated through a 10 μm filter, and cooled to 30° C. to allow recrystallization. Cooling speed for the recrystallization was controlled to be 3° C./hour. The resulting crystal was subjected to centrifugal filtration, and washing was performed with 100 kg of isopropyl alcohol. Thereafter, the crystal was dried. The resulting crystal was esterified, and subjected to GC-FID analysis to give the results of the content of behenic acid being 96 mol %, lignoceric acid 2 mol %, and arachidic acid 2 mol %. In addition, erucic acid was included at 0.001 mol %.

<Preparation of Dispersion of Silver Salt of Fatty Acid>

88 kg of the recrystallized behenic acid, 422 L of distilled water, 49.2 L of 5 mol/L sodium hydroxide aqueous solution, 120 L of t-butyl alcohol were admixed, and subjected to a reaction with stirring at 75° C. for one hour to give a solution of sodium behenate. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution of sodium behenate and the total amount of the aqueous silver nitrate solution with sufficient stirring at a constant flow rate over 93 minutes and 15 seconds, and 90 minutes, respectively. Upon this operation, during first 11 minutes following the initiation of adding the aqueous silver nitrate solution, the added material was restricted to the aqueous silver nitrate solution alone. The addition of the solution of sodium behenate was thereafter started, and during 14 minutes and 15 seconds following the completion of adding the aqueous silver nitrate solution, the added material was restricted to the solution of sodium behenate alone. The temperature inside of the reaction vessel was then set to be 30° C., and the temperature outside was controlled so that the liquid temperature could be kept constant. In addition, the temperature of a pipeline for the addition system of the solution of sodium behenate was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution of sodium behenate was added and the position, at which the aqueous silver nitrate solution was added, was arranged symmetrically with a shaft for stirring located at a center. Moreover, both of the positions were adjusted to avoid contact with the reaction liquid.

After completing the addition of the solution of sodium behenate, the mixture was left to stand at the temperature as it was for 20 minutes. The temperature of the mixture was then elevated to 35° C. over 30 minutes followed by ripening for 210 minutes. Immediately after completing the ripening, solid matters were filtered out with centrifugal filtration. The solid matters were washed with water until the electric conductivity of the filtrated water became 30 μS/cm. A silver salt of fatty acid was thus obtained. The resulting solid matters were stored as a wet cake without drying.

When the shape of the resulting particles of the silver behenate was evaluated by an electron micrography, a crystal was revealed having a=0.21 μm, b=0.4 μm and c=0.4 μm on the average value, with a mean aspect ratio of 2.1, and a variation coefficient of an equivalent spherical diameter distribution of 11% (a, b and c are as defined aforementioned.).

To the wet cake corresponding to 260 kg of a dry solid matter content, were added 19.3 kg of polyvinyl alcohol (trade name: PVA-217) and water to give the total amount of 1000 kg. Then, a slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1150 kg/cm$^2$ to give a dispersion of the silver behenate. For the cooling manipulation, coiled heat exchangers were equipped in front of and behind the interaction chamber respectively, and accordingly, the temperature for the dispersion was set to be 18° C. by regulating the temperature of the cooling medium.

3) Preparations of Reducing Agent Dispersion

<Reducing Agent-1 Dispersion>>To 10 kg of reducing agent-i (2,2'-methylenebis-(4-ethyl-6-tert-butylphenol)) and 16 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours. Thereafter, 0.2 g of a benzisothiazolinone sodium salt and water were added thereto, thereby adjusting the concentration of the reducing agent to be 25% by weight. This dispersion was subjected to heat treatment at 60° C. for 5 hours to obtain reducing agent-1 dispersion. Particles of the reducing agent included in the resulting reducing agent dispersion had a median diameter of 0.40 μm, and a maximum particle diameter of 1.4 μm or less. The resultant reducing agent dispersion was subjected to filtration with a polypropylene filter having a pore size of 3.0 μm to remove foreign substances such as dust, and stored.

<<Reducing Agent-2 Dispersion>>

To 10 kg of reducing agent-2 (6,6'-di-t-butyl-4,4'-dimethyl-2,2'-butylidenediphenol)) and 16 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of a benzisothiazolinone sodium salt and water were added thereto, thereby adjusting the concentration of the reducing agent to be 25% by weight. This dispersion was warmed at 40° C. for one hour, followed by a subsequent heat treatment at 80° C. for one hour to obtain reducing agent-2 dispersion. Particles of the reducing agent included in the resulting reducing agent-2 dispersion had a median diameter of 0.50 μm, and a maximum particle diameter of 1.6 μm or less. The resultant reducing agent-2 dispersion was subjected to filtration with a polypropylene filter having a pore size of 3.0 μm to remove foreign substances such as dust, and stored.

4) Preparation of Hydrogen Bonding Compound-1 Dispersion

To 10 kg of hydrogen bonding compound-1 (tri(4-t-butylphenyl)phosphineoxide) and 16 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 4 hours. Thereafter, 0.2 g of a benzisothiazolinone sodium salt and water were added thereto, thereby adjusting the concentration of the hydrogen bonding compound to be 25% by weight. This dispersion was warmed at 40° C. for one hour, followed by a subsequent heat treatment at 80° C. for one hour to obtain hydrogen bonding compound-1 dispersion. Particles of the hydrogen bonding compound included in the resulting hydrogen bonding compound dispersion had a median diameter of 0.45 μm, and a maximum particle diameter of 1.3 μm or less. The resultant hydrogen bonding compound dispersion was subjected to filtration with a polypropylene filter having a pore size of 3.0 μm to remove foreign substances such as dust, and stored.

5) Preparations of Development Accelerator-1 Dispersion

To 10 kg of development accelerator-1 and 20 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minuets. Thereafter, 0.2 g of a benzisothiazolinone sodium salt and water were added thereto, thereby adjusting the concentration of the development accelerator to be 20% by weight. Accordingly, development accelerator-1 dispersion was obtained. Particles of the development accelerator included in the resulting development accelerator dispersion had a median diameter of 0.48 μm, and a maximum particle diameter of 1.4 μm or less. The resultant development accelerator dispersion was subjected to filtration with a polypropylene filter having a pore size of 3.0 μm to remove foreign substances such as dust, and stored.

6) Preparations of Development Accelerator-2 Dispersion

Also concerning solid dispersion of development accelerator-2, dispersion was executed in a similar manner to the development accelerator-1, and thus dispersion of 20% by weight was obtained.

7) Preparations of Organic Polyhalogen Compound Dispersion

<<Organic Polyhalogen Compound-1 Dispersion>>

10 kg of organic polyhalogen compound-1 (tribromomethane sulfonylbenzene), 10 kg of a 20% by weight aqueous solution of modified polyvinyl alcohol (manufactured by Kuraray Co., Ltd., Poval MP203), 0.4 kg of a 20% by weight aqueous solution of sodium triisopropylnaphthalenesulfonate and 14 kg of water were thoroughly admixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 26% by weight. Accordingly, organic polyhalogen compound-i dispersion was obtained.

Particles of the organic polyhalogen compound included in the resulting organic polyhalogen compound dispersion had a median diameter of 0.41 μm, and a maximum particle diameter of 2.0 μm or less. The resultant organic polyhalogen compound dispersion was subjected to filtration with a polypropylene filter having a pore size of 10.0 μm to remove foreign substances such as dust, and stored.

<<Organic Polyhalogen Compound-2 Dispersion>>

10 kg of organic polyhalogen compound-2 (N-butyl-3-tribromomethane sulfonylbenzamide), 20 kg of a 10% by weight aqueous solution of modified polyvinyl alcohol (manufactured by Kuraray Co., Ltd., Poval MP203) and 0.4 kg of a 20% by weight aqueous solution of sodium triisopropylnaphthalenesulfonate were thoroughly admixed to give a slurry.

This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 30% by weight. This fluid dispersion was heated at 40° C. for 5 hours to obtain organic polyhalogen compound-2 dispersion. Particles of the organic polyhalogen compound included in the resulting organic polyhalogen compound dispersion had a median diameter of 0.40 μm, and a maximum particle diameter of 1.3 μm or less. The resultant organic polyhalogen compound dispersion was subjected to filtration with a polypropylene filter having a pore size of 3.0 μm to remove foreign substances such as dust, and stored.

8) Preparation of Phthalazine Compound-1 Solution

Modified polyvinyl alcohol MP203 in an amount of 8 kg was dissolved in 174.57 kg of water, and then thereto were added 3.15 kg of a 20% by weight aqueous solution of sodium triisopropylnaphthalenesulfonate and 14.28 kg of a 70% by weight aqueous solution of phthalazine compound-1 (6-isopropyl phthalazine) to prepare a 5% by weight phthalazine compound-1 solution.

9) Preparations of Aqueous Solution of Mercapto Compound

<<Aqueous Solution of Mercapto Compound-1>>

Mercapto compound-1 (1-(3-sulfophenyl)-5-mercaptotetrazole sodium salt) in an amount of 7 g was dissolved in 993 g of water to give a 0.7% by weight aqueous solution.

<<Aqueous Solution of Mercapto Compound-2>>

Mercapto compound-2 (1-(3-methylureidophenyl)-5-mercaptotetrazole) in an amount of 20 g was dissolved in 980 g of water to give a 2.0% by weight aqueous solution.

10) Preparation of Pigment-1 Dispersion

C.I. Pigment Blue 60 in an amount of 64 g and 6.4 g of DEMOL N manufactured by Kao Corporation were added to 250 g of water and thoroughly mixed to give a slurry. Zirconia beads having the mean particle diameter of 0.5 mm were provided in an amount of 800 g, and charged in a vessel with the slurry. Dispersion was performed with a dispersing machine (1/4G sand grinder mill: manufactured by AIMEX Co., Ltd.) for 25 hours. Thereto was added water to adjust so that the concentration of the pigment became 5% by weight to obtain a pigment-1 dispersion. Particles of the pigment included in the resulting pigment dispersion had a mean particle diameter of 0.21 μm.

11) Preparation of SBR Latex Solution

To a polymerization tank of a gas monomer reaction apparatus (manufactured by Taiatsu Techno Corporation, TAS-2J type), were charged 287 g of distilled water, 7.73 g of a surfactant (Pionin A-43-S (manufactured by TAKEMOTO OIL & FAT CO., LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Thereto was injected 108.75 g of 1,3-butadiene, and the inner temperature is elevated to 60° C. Thereto was added a solution of 1.875 g of ammonium persulfate dissolved in 50 mL of water, and the mixture was stirred for 5 hours as it stands. The temperature was further elevated to 90° C., followed by stirring for 3 hours. After completing the reaction, the inner temperature was lowered to reach to the room temperature, and thereafter the mixture was treated by adding 1 mol/L sodium hydroxide and ammonium hydroxide to give the molar ratio of $Na^+$ ion : $NH_4^+$ ion=1:5.3, and thus, the pH of the mixture was adjusted to 8.4. Thereafter, filtration with a polypropylene filter having the pore size of 1.0 μm was conducted to remove foreign substances such as dust followed by storage. Accordingly, SBR latex was obtained in an amount of 774.7 g. Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had a mean particle diameter of 90 nm, Tg of 17° C., solid matter concentration of 44% by weight, the equilibrium moisture content at 25° C. and 60% RH of 0.6% by weight, ionic conductance of 4.80 mS/cm (measurement of the ionic conductance performed using a conductivity meter CM-30S manufactured by Toa Electronics Ltd. for the latex stock solution (44% by weight) at 25° C.).

2. Preparations of Coating Solution

1) Preparation of Coating Solution for Image Forming Layer

The dispersion of the silver salt of fatty acid obtained as described above in an amount of 1000 g, 135 mL of water, 35 g of the pigment-1 dispersion, 19 g of the organic polyhalogen compound-1 dispersion, 58 g of the organic polyhalogen compound-2 dispersion, 162 g of the phthalazine compound-1 solution, 1060 g of the SBR latex (Tg: 17° C.) solution, 75 g of the reducing agent-1 dispersion, 75 g of the reducing agent-2 dispersion, 106 g of the hydrogen bonding compound-1 dispersion, 4.8 g of the development accelerator-1 dispersion, 9 mL of the mercapto compound-1 aqueous solution, and 27 mL of the mercapto compound-2 aqueous solution were serially added. The coating solution for the image forming layer prepared by adding 118 g of the mixed emulsion A for coating solution thereto followed by thorough mixing just prior to the coating was fed directly to a coating die.

2) Preparation of Coating Solution for Intermediate Layer-1

To 1000 g of polyvinyl alcohol PVA-205 (manufactured by Kuraray Co., Ltd.), 163 g of the pigment-1 dispersion, 33 g of a 18.5% by weight aqueous solution of comparative compound-A (manufactured by Nippon Kayaku Co. Ltd., trade name: Kayafekutotakoisu RN Liquid 150), 27 mL of a 5% by weight aqueous solution of di(2-ethylhexyl) sodium sulfosuccinate and 4200 mL of a 19% by weight solution of methyl methacrylate/styrene/butyl acrylate/hydroxyethyl methacrylate/acrylic acid copolymer (weight ratio of the copolymerization of 57/8/28/5/2) latex, 27 mL of a 5% by weight aqueous solution of aerosol OT (manufactured by American Cyanamid Co.), 135 mL of a 20% by weight aqueous solution of ammonium secondary phthalate was added water to give total amount of 10000 g. The mixture was adjusted with sodium hydroxide to give the pH of 7.5. Accordingly, the coating solution for the intermediate layer was prepared, and was fed to a coating die to provide 8.9 mL/$m^2$.

Viscosity of the coating solution was 58 [mpa·s] which was measured with a B type viscometer at 40° C. (No. 1 rotor, 60 rpm).

3) Preparation of Coating Solution for Intermediate Layer-2

Preparation of coating solution for intermediate layer-2 was conducted in a similar manner to the preparation of coating solution for intermediate layer-1, except that using phthalocyanine compound-1 instead of using comparative compound-A.

4) Coating Solution for First Layer of Surface Protective Layers

In 840 mL of water were dissolved 100 g of inert gelatin and 10 mg of benzisothiazolinone, and thereto were added 180 g of a 19% by weight solution of methyl methacrylate/styrene/butyl acrylate/hydroxyethyl methacrylate/acrylic acid copolymer (weight ratio of the copolymerization of 57/8/28/5/2) latex, 46 mL of a 15% by weight methanol solution of phthalic acid and 5.4 mL of a 5% by weight aqueous solution of di(2-ethylhexyl) sodium sulfosuccinate, and the solution were mixed. Immediately before coating, 40 mL of a 4% by weight chrome alum which had been mixed with a static mixer was fed to a coating die so that the amount of the coating solution became 26.1 mL/$m^2$.

Viscosity of the coating solution was 20 [mPa·s] which was measured with a B type viscometer at 40° C. (No. 1 rotor, 60 rpm).

5) Coating Solution for Second Layer of Surface Protective Layers

In 800 mL of water were dissolved 100 g of inert gelatin and 10 mg of benzisothiazolinone, and thereto were added liquid paraffin emulsion at 8.0 g equivalent to liquid paraffin, 180 g of a 19% by weight solution of methyl methacrylate/styrene/butyl acrylate/hydroxyethyl methacrylate/acrylic acid copolymer (weight ratio of the copolymerization of 57/8/28/5/2) latex, 40 mL of a 15% by weight methanol solution of phthalic acid, 5.5 mL of a 1% by weight solution of a fluorocarbon surfactant (F-1), 5.5 mL of a 1% by weight aqueous solution of another fluorocarbon surfactant (F-2), 28 mL of a 5% by weight aqueous solution of di(2-ethylhexyl) sodium sulfosuccinate, 4 g of polymethyl methacrylate fine particles (mean particle diameter of 0.7 μm) and 21 g of polymethyl methacrylate fine particles (mean particle diameter of 4.5 μm), and were mixed to give a coating solution for the surface protective layer, which was fed to a coating die so that 8.3 mL/$m^2$ could be provided.

Viscosity of the coating solution was 19 [mPa·s] which was measured with a B type viscometer at 40° C. (No. 1 rotor, 60 rpm).

3. Preparations of Photothermographic Material

1) Preparations of Photothermographic Material-101 to -110

Reverse surface of the back surface on which the back layer was coated was subjected to simultaneous overlaying coating by a slide bead coating method in order of the image forming layer, intermediate layer, first layer of the surface protective layers and second layer of the surface protective layers starting from the undercoated face, and thus sample of photothermographic material was produced. In this method, the temperature of the coating solution was adjusted to 31° C. for the image forming layer and intermediate layer, to 36° C. for the first layer of the surface protective layers, and to 37° C. for the second layer of the surface protective layers.

The combination of the back layer and the intermediate layer is shown in Table 1.

TABLE 1

| Sample No. | Back Layer No. | Back Layer Dye No. | Back Layer Addition Amount (mg/m$^2$) | Intermediate Layer No. | Intermediate Layer Dye No. | Intermediate Layer Addition Amount (mg/m$^2$) | Abs 610 | Abs 660 | Density Ratio | Photographic Properties Fog | Sensitivity | Sharpness | Residual Color | Note |
|---|---|---|---|---|---|---|---|---|---|---|---|---|---|---|
| 101 | 1 | 2 | 40 | 1 | A | 20 | 0.15 | 0.30 | 0.50 | 0.18 | 100 | 92 | 3 | Invention |
| 102 | 1 | 2 | 40 | 2 | 1 | 15 | 0.12 | 0.32 | 0.38 | 0.17 | 101 | 94 | 4 | Invention |
| 103 | 2 | 28 | 40 | 1 | A | 20 | 0.16 | 0.31 | 0.52 | 0.18 | 99 | 92 | 3 | Invention |
| 104 | 2 | 28 | 40 | 2 | 1 | 15 | 0.12 | 0.33 | 0.36 | 0.17 | 100 | 93 | 4 | Invention |
| 105 | 3 | 61 | 40 | 1 | A | 20 | 0.14 | 0.32 | 0.44 | 0.18 | 99 | 91 | 3 | Invention |
| 106 | 3 | 61 | 40 | 2 | 1 | 15 | 0.12 | 0.30 | 0.40 | 0.17 | 101 | 93 | 4 | Invention |
| 107 | 5 | B | 56 | 1 | A | 20 | 0.23 | 0.26 | 0.88 | 0.21 | 101 | 88 | 1 | Comparative |
| 108 | 5 | B | 56 | 2 | 1 | 15 | 0.20 | 0.32 | 0.63 | 0.19 | 102 | 92 | 3 | Invention |
| 109 | 3 | 11 | 40 | 1 | A | 20 | 0.14 | 0.31 | 0.45 | 0.18 | 100 | 92 | 3 | Invention |
| 110 | 3 | 11 | 40 | 2 | 1 | 15 | 0.12 | 0.29 | 0.41 | 0.17 | 101 | 94 | 4 | Invention |

The coating amount of each compound (g/m$^2$) for the image forming layer is as follows.

| | |
|---|---|
| Silver salt of fatty acid | 5.42 |
| Pigment-1 (C.I. Pigment Blue 60) | 0.036 |
| Organic polyhalogen compound-1 | 0.12 |
| Organic polyhalogen compound-2 | 0.25 |
| Phthalazine compound-1 | 0.18 |
| SBR latex | 9.70 |
| Reducing agent-1 | 0.40 |
| Reducing agent-2 | 0.40 |
| Hydrogen bonding compound-1 | 0.58 |
| Development accelerator-1 | 0.019 |
| Development accelerator-2 | 0.016 |
| Mercapto compound-1 | 0.002 |
| Mercapto compound-2 | 0.012 |
| Silver halide (on the basis of Ag content) | 0.10 |

Conditions for coating and drying are as follows.

Coating was performed at the speed of 160 m/min. The clearance between the leading end of the coating die and the support was 0.10 mm to 0.30 mm. The pressure in the vacuum chamber set to be lower than atmospheric pressure by 196 Pa to 882 Pa. The support was decharged by ionic wind.

In the subsequent cooling zone, the coating solution was cooled by wind having the dry-bulb temperature of 10° C. to 20° C. Transportation with no contact was carried out, and the coated support was dried with an air of the dry-bulb of 23° C. to 45° C. and the wet-bulb of 15° C. to 21° C. in a helical type contactless drying apparatus.

After drying, moisture conditioning was performed at 25° C. in the humidity of 40% RH to 60% RH. Then, the film surface was heated to be 70° C. to 90° C., and after heating, the film surface was cooled to 25° C.

Thus prepared photothermographic material had the matness of 550 seconds on the image forming layer side surface, and 130 seconds on the back surface as Beck's smoothness. In addition, measurement of the pH of the film surface on the image forming layer surface side gave the result of 6.0.

Chemical structures of the compounds used in Examples of the invention are shown below.

Spectral sensitizing dye A

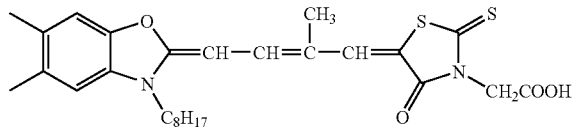

Spectral sensitizing dye B

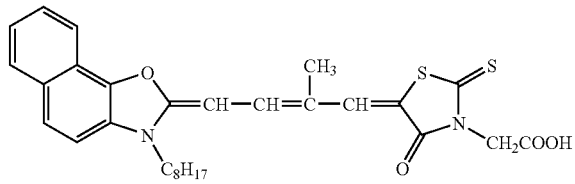

Tellurium sensitizer C

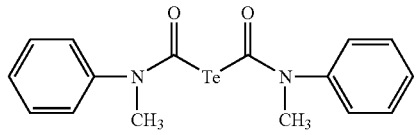

Compound 2 that can be one-electron-oxidized to provide a one-electron oxidation product which releases one or more electrons

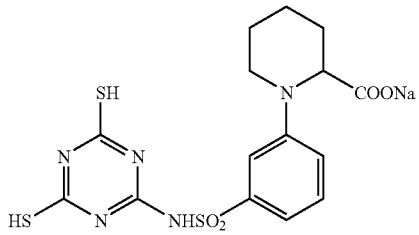

Compound 20 that can be one-electron-oxidized to provide a one-electron oxidation product which releases one or more electrons

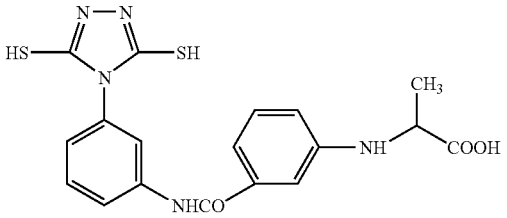

Compound 26 that can be one-electron-oxidized to provide a one-electron oxidation product which releases one or more electrons

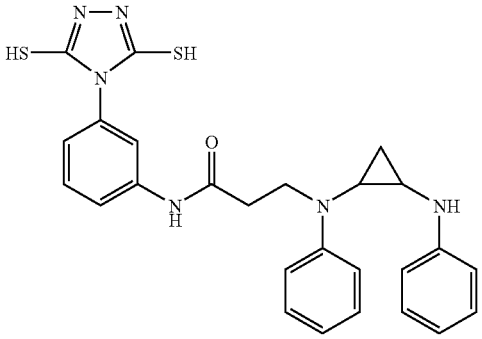

Reducing agent-1

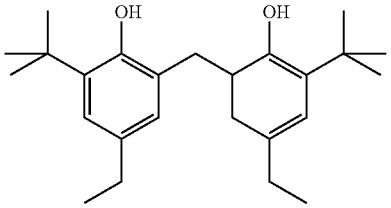

Reducing agent-2

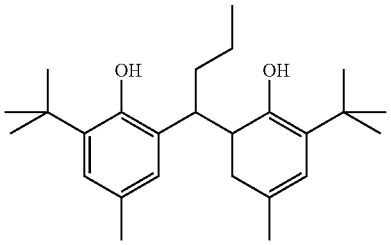

Hydrogen bonding compound-1

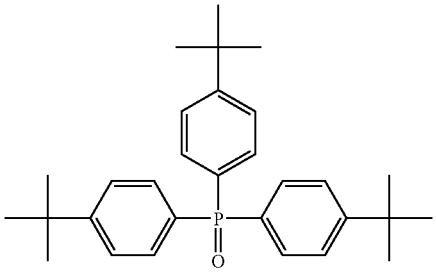

Organic polyhalogen compound-1

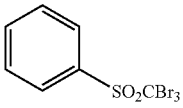

-continued

Oganic polyhalogen compound-2

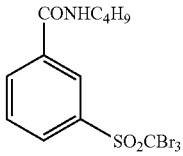

Mercapto compound-1

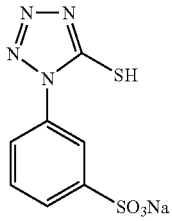

Mercapto compound-2

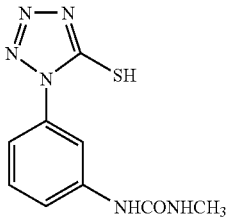

Phthalazine compound-1

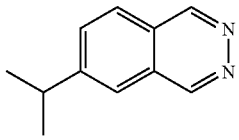

Development accelerator-1

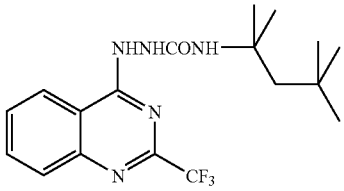

Development accelerator-2

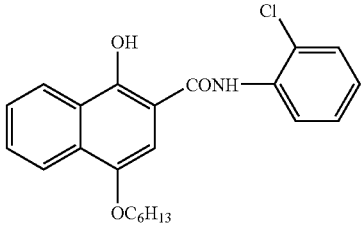

(F-1)

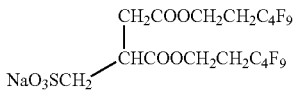

(F-2)

Mixture of 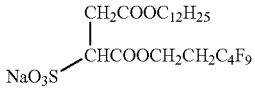 and

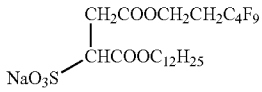

4. Evaluation of Photographic Properties

1) Preparation

The resulting sample was cut into a half-cut size, and was wrapped with the following packaging material under an environment of 25° C. and 50% RH, and stored for 2 weeks at an ambient temperature.

<Packaging Material>

A film laminated with PET 10 μm/PE 12 μm/aluminum foil 9 μm/Ny 15 μm/polyethylene 50 μm containing carbon at 2% by weight:

oxygen permeability at 25° C.: 0.02 mL $\cdot atm^{-1}m^{-2}day^{-1}$;

vapor permeability at 25° C.: 0.10 $g \cdot atm^{-1}m^{-2}day^{-1}$.

2) Exposure and Thermal Development

To each sample, exposure and thermal development (14 seconds in total with 3 panel heaters set to 107° C.-121° C.-121° C.) with Fuji Medical Dry Laser Imager DRYPIX 7000 (equipped with 660 nm laser diode having a maximum output of 50 mW (IIIB)) were performed. Evaluation on an image obtained was performed with a densitometer.

3) Measurement of Light Absorption Density

With regard to each sample after thermal development, a light absorption density at 610 nm ($D_{610}$) and a light absorption density at 660 nm ($D_{660}$) was measured by a densitometer. The obtained results are shown in Table 1. Further, the following density ratio is calculated and the value is also shown in Table 1.

$$\text{Density ratio}=D_{610}/D_{660}$$

4) Evaluation of Photographic Properties

The photothermographic material prepared above was subjected to exposure by changing the exposure value of a laser beam step by step. The density of the image obtained after developing process was measured by a Macbeth densitometer. The photographic characteristic curve was prepared by plotting the density against the exposure value.

<Fog>

The density of the part unexposed by a laser beam in the sample after developing process is defined as fog.

<Sensitivity>

Sensitivity is the inverse of the exposure value giving an image density of fog+1.0. The sensitivities are shown in relative value, detecting the sensitivity of a standard sample to be 100.

<Sharpness>

Sharpness is expressed by a relative value taken as 100 for the value obtained for the portion having a density of 1.2 and a width of 5 mm, where the sample was subjected to exposure to give a density of 1.2 and a width of 0.5 mm and then the width of the portion having a density of fog+0.1 or more was measured by a micro-densitometer with an aperture diameter of 50 μm.

<Residual Color>

With regard to the samples after developing process, the coloring of the unexposed part was evaluated by visual observation and classified into five sensory evaluation criteria as follows, [5]: excellent level, [1]: unacceptable level for practical use, and [3]: allowable level for practical use.

The obtained results are shown in Table 1.

The photothermographic materials of the present invention exhibit excellent results in photographic properties such as fog, sensitivity, sharpness, and residual color.

Example 2

1) Preparations of Coated Sample

Preparations of sample-201 to -211 were conducted in a similar manner to the process in the preparation of sample-102 in Example 1, except that changing the phthalocyanine compound in the back layer and in the intermediate layer to the compound shown in Table 2.

2) Evaluation of Photographic Properties

Evaluation was done similar to Example 1, and the obtained results are shown in Table 2.

TABLE 2

| | Back Layer | | Intermediate Layer | | | | | Photographic Properties | | | | |
|---|---|---|---|---|---|---|---|---|---|---|---|---|
| Sample No. | Compound of Formula (PC-1) No. | Coating Amount ($mg/m^2$) | Compound of Formula (PC-1) No. | Coating Amount ($mg/m^2$) | Abs 610 | Abs 660 | Density Ratio | Fog | Sensitivity | Sharpness | Residual Color | Note |
| 201 | 2 | 30 | 2 | 15 | 0.09 | 0.30 | 0.30 | 0.17 | 100 | 94 | 4 | Invention |
| 202 | 2 | 50 | 2 | 15 | 0.11 | 0.34 | 0.32 | 0.18 | 101 | 94 | 4 | Invention |
| 203 | 2 | 60 | 2 | 15 | 0.13 | 0.36 | 0.36 | 0.19 | 100 | 95 | 3 | Invention |
| 204 | 2 | 40 | 2 | 10 | 0.10 | 0.33 | 0.30 | 0.17 | 101 | 94 | 4 | Invention |
| 205 | 2 | 40 | 2 | 20 | 0.11 | 0.34 | 0.32 | 0.17 | 100 | 94 | 4 | Invention |
| 206 | 77 | 40 | 77 | 15 | 0.12 | 0.33 | 0.36 | 0.17 | 100 | 93 | 4 | Invention |
| 207 | 92 | 40 | 92 | 15 | 0.11 | 0.34 | 0.32 | 0.18 | 101 | 93 | 4 | Invention |
| 208 | 107 | 40 | 107 | 15 | 0.11 | 0.33 | 0.33 | 0.18 | 102 | 94 | 4 | Invention |
| 209 | 127 | 40 | 127 | 15 | 0.12 | 0.33 | 0.36 | 0.18 | 100 | 93 | 4 | Invention |
| 210 | 181 | 40 | 181 | 15 | 0.12 | 0.34 | 0.35 | 0.18 | 101 | 93 | 4 | Invention |
| 211 | 11 | 40 | 11 | 15 | 0.11 | 0.34 | 0.32 | 0.17 | 101 | 94 | 4 | Invention |

The photothermographic materials of the present invention exhibit excellent results in photographic properties such as fog, sensitivity, sharpness, and residual color.

Example 3

<<Example in which the Phthalocyanine Compound is Added to the Image Forming Layer>>

1) Preparations of Sample-301 to 306

Preparations of sample-301 to -306 were conducted in a similar manner to the process in the preparation of sample-102 in Example 1, except that removing the piment-1 dispersion from the coating solution for image forming layer and, instead of this, adding the phthalocyanine compound of the invention (5% by weight aqueous solution) as shown in Table 3.

2) Evaluation of Photographic Properties

Evaluation was done similar to Example 1, and the obtained results are shown in Table 3.

TABLE 3

| Image Forming Layer | | | | | | Photographic Properties | | | | |
|---|---|---|---|---|---|---|---|---|---|---|
| Sample No. | Dye No. | Coating Amount ($mg/m^2$) | Abs 610 | Abs 660 | Density Ratio | Fog | Sensitivity | Sharpness | Residual Color | Note |
| 102 | Pigment-1 | 36 | 0.22 | 0.25 | 0.88 | 0.17 | 100 | 93 | 4 | Invention |
| 301 | 2 | 25 | 0.12 | 0.27 | 0.44 | 0.16 | 100 | 95 | 5 | Invention |
| 302 | 28 | 25 | 0.11 | 0.28 | 0.39 | 0.16 | 101 | 94 | 5 | Invention |
| 303 | 77 | 25 | 0.12 | 0.30 | 0.40 | 0.16 | 102 | 94 | 5 | Invention |
| 304 | 92 | 25 | 0.13 | 0.27 | 0.48 | 0.16 | 100 | 94 | 5 | Invention |
| 305 | 107 | 25 | 0.14 | 0.26 | 0.54 | 0.16 | 101 | 94 | 5 | Invention |
| 306 | 11 | 25 | 0.12 | 0.30 | 0.40 | 0.16 | 101 | 94 | 5 | Invention |

The photothermographic materials of the present invention exhibit excellent results in photographic properties such as fog, sensitivity, sharpness, and residual color.

Example 4

<<Example in which the Phthalocyanine Compound is Added to an Under Layer Provided Under the Image Forming Layer>>

1) Preparations of Sample-401 to 405

Preparations of sample-401 to -405 were conducted in a similar manner to the process in the preparation of sample-102 in Example 1, except that removing the phthalocyanine compound from the back layer and, instead of this, providing an Under layer between the image forming layer and the support, and adding the dye to the layer to give an antihalation layer.

(Antihalation Layer)

A vessel was kept at 40° C., and thereto were added 40 g of gelatin, 20 g of monodispersed polymethyl methacrylate fine particles (mean particle size of 8 μm, standard deviation of particle diameter of 0.4), 0.1 g of benzisothiazolinone and 500 mL of water to allow gelatin to be dissolved. Additionally, 2.3 mL of a 1 mol/L aqueous sodium hydroxide solution, an aqueous solution of the phthalocyanine according to the invention or an aqueous solution of the phthalocyanine for comparision in an amount to be the amount shown in Table 4, 12 mL of a 3% by weight aqueous solution of poly(sodium styrenesulfonate), and 180 g of a 10% by weight solution of SBR latex were admixed. Just prior to the coating, 80 mL of a 4% by weight aqueous solution of N,N-ethylenebis(vinylsulfone acetamide) was admixed.

Antihalation Layer-1: Compound-2 according to the invention (5% by weight)

Antihalation Layer-2: Compound-61 according to the invention (5% by weight)

Antihalation Layer-3: Compound-77 according to the invention (5% by weight)

Antihalation Layer-4: Comparative compound-B (62-position subsitution product) (5% by weight)

Antihalation Layer-5: Compound-11 according to the invention (5% by weight)

Each of the above coating solution was coated to give the coating amount of the phthalocyanine compound to be 30 $mg/m^2$.

2) Evaluation of Photographic Properties

Evaluation was done similar to Example 1, and the obtained results are shown in Table 4.

The photothermographic materials of the present invention exhibit excellent results in photographic properties such as fog, sensitivity, sharpness, and residual color.

TABLE 4

| Antihalation Layer | | | | | | Photographic Properties | | | | |
|---|---|---|---|---|---|---|---|---|---|---|
| Sample No. | Compound of Formula (PC-1) No. | Coating Amount ($mg/m^2$) | Abs 610 | Abs 660 | Density Ratio | Fog | Sensitivity | Sharpness | Residual Color | Note |
| 401 | 2 | 30 | 0.11 | 0.29 | 0.38 | 0.17 | 100 | 94 | 5 | Invention |
| 402 | 61 | 30 | 0.12 | 0.28 | 0.43 | 0.18 | 101 | 92 | 5 | Invention |
| 403 | 77 | 30 | 0.12 | 0.27 | 0.44 | 0.18 | 102 | 93 | 5 | Invention |
| 404 | Comparative Compound-B | 30 | 0.24 | 0.27 | 0.89 | 0.18 | 102 | 91 | 5 | Comparative |
| 405 | 11 | 30 | 0.11 | 0.28 | 0.39 | 0.17 | 102 | 94 | 5 | Invention |

Example 5

1) Preparation of Coated Sample

In the preparation of sample-102 in Example 1, as a magenta dye for color tone-adjusting, a 1% by weight aqueous solution of the compound of formula (I) was added in the back layer as shown in Table 5. In this procedure, the addition amounts of the cyan dye and the magenta dye were adjusted to attain the hue angle to be 240° on the non-image part after thermal development. The hue angles of the cyan dye and the magenta dye were determined by measurement of the hue angle on nonimage part of performed sample containing each dye alone after thermal development. The measurement of the hue angle was performed by Spectrolino spectrometer (trade name, produced by Gretag-Macbeth Ltd.) under an illumination of F5.

2) Evaluation of Photographic Properties

Each sample was subjected to scanning exposure by changing the output power of laser oscillator to record an X-ray radiographic chest image using similar exposure equipment to that in Example 1. Thermal development was performed in a similar to Example 1. A diagnostic ability of the obtained chest images was evaluated by visual observation with ten monitors and classified into five sensory evaluation criteria as follows, [5]: excellent level, [1]: unallowable level for practical use, and [3]: allowable for practical use.

The obtained results are shown in Table 5.

TABLE 5

| Sample No. | Magenta Dye | Hue Angle Difference | Diagnostic Ability | Fog | Sensitivity | Sharpness | Note |
|---|---|---|---|---|---|---|---|
| 102 | — | — | 4 | 0.17 | 100 | 93 | Invention |
| 501 | Formula (I)-(1) | 90 | 5 | 0.17 | 100 | 93 | Invention |
| 502 | Formula (I)-(3) | 90 | 5 | 0.17 | 100 | 93 | Invention |
| 503 | Formula (I)-(4) | 120 | 5 | 0.18 | 95 | 94 | Invention |
| 504 | Formula (I)-(34) | 60 | 5 | 0.17 | 100 | 91 | Invention |

The samples containing the magenta dye of the present invention can improved diagnostic ability compared with the sample which does not contain magenta dyes. Furthermore, sample Nos. 501 and 502, whose hue angle difference to the cyan dyes was 90°, exhibit more excellent results in fog, sensitivity, and sharpness compared with sample Nos. 503 and 504.

Example 6

1. Preparations of Sample

Sample Nos. 601 to 610 were prepared in a manner similar to Example 1 except that using isoprene latex described below instead of SBR latex in the image forming layer and removing hydrogen bonding compound-1.

(Preparation of Isoprene Latex Dispersion)

Isoprene Latex (TP-2) was prepared as follows;

Into the polymerization vessel of gas monomer reaction apparatus (type TAS-2J manufactured by Tiatsu Garasu Kogyo Ltd.), 1500 g of distilled water were poured, and heated for 3 hours at 90° C. to make passive film over the stainless steel-made vessel surface and stainless steel-made stirring device, thereafter, 582.28 g of distilled water deaerated by nitrogen gas for one hour, 9.49 g of surfactant "PIONIN A-43-S" (trade name, available from Takemoto Oil & Fat Co., Ltd.), 19.56 g of 1 mol/L sodium hydroxide, 0.20 g of ethylenediamine tetraacetic acid tetrasodium salt, 314.99 g of styrene, 190.87 g of isoprene, 10.43 g of acrylic acid, and 2.09 g of tert-dodecyl mercapatn were added into the pretreated reaction vessel. And then, the reaction vessel was sealed and the mixture was stirred at the stirring rate of 225 rpm, followed by elevating the inner temperature to 60° C. A solution obtained by dissolving 2.61 g of ammonium persulfate in 40 mL of water was added to the aforesaid mixture and kept for 6 hours with stirring. At the point the polymerization ratio was 90% according to the solid content measurement. Thereto a solution obtained by dissolving 5.22 g of acrylic acid in 46.98 g of water was added, and then 10 g of water and a solution obtained by dissolving 1.30 g of ammonium persulfate in 50.7 mL of water were added. After the addition, the mixture was heated to 90° C. and stirred for 3 hours. After the reaction was finished, the inner temperature of the vessel was cooled to room temperature. And then by the addition of 1 mol/L NaOH and 1 mol/L $NH_4OH$, the mixture was adjusted to be $Na^+$ ion : $NH_4^+$ ion=1:5.3 (molar ratio) and then pH was adjusted to 8.3. Thereafter, the resulting mixture was filtered with a polypropylene filter having a pore size of 1.0 μm to remove foreign substances such as dust, and stored. 124 g of isoprene latex (TP-2) was obtained. The measurement of halogen ion by an ion chromatography showed that the concentration of residual chloride ion was 3 p.p.m. The measurement by a high speed liquid chromatography showed that residual chelating agent concentration was 142 p.p.m.

The obtained latex has an average particle size of 113 nm, Tg=15° C., a solid content of 41.3% by weight, an equilibrium moisture content under the atmosphere of 25° C. and 60 RH % of 0.4% by weight, and an ionic conductivity of 5.23 mS/cm (the measurement of which was carried out at 25° C. using a conductometer CM-30S produced by DKK-TOA Corp.).

2. Evaluation of Photographic Properties

The results of evaluation performed in a similar manner to that in Example 1 reveal that Samples of the present invention exhibit excellent quality similar to Example 1.

Example 7

In a similar manner to the preparation in Examples 1 to 3 described in JP-A No. 2004-212672, a sample similar to Sample No. 358 described in the said Example 3 was prepared, and the prepared sample was denoted as Sample No. 601. Sample No. 602 was prepared in a similar manner to the process in the preparation of Sample No. 601 except that changing the dye used in Sample No. 601 described below was changed to dye No. 11 (24 mg/m$^2$) of formula (PC-1) according to the present invention.

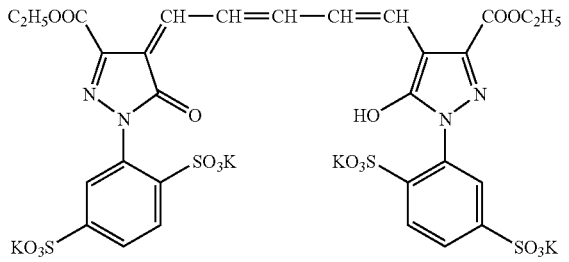

(Evaluation of Image Sharpness)

A rectangular pattern mask having a density difference of 0.5 by changing space frequency, which was vapor deposited on a glass substrate, was brought into contact with Sample No. 601 or No. 602, and that was subjected to exposure through a red filter and development similar to that in Sample No. 358. A density of the obtained rectangular pattern image was measured precisely using a micro-densitometer. CTF value was determined where the space frequency was 0.5, and taken to be one criterion for evaluating the image sharpness. The larger the CTF value, the excellent the sharpness of the image.

The result of the above evaluation of image sharpness showed that the samples of the present invention exhibit excellent image sharpness, because CTF value for Sample No. 602 was 15.5, while CTF value for Sample No. 601 was 13.2.

Separately, a sharpness evaluation utilizing the actual sample with respect to the character quality was carried out. A character pattern negative mask, [FUJI PHOTO FILM COLOR PAPER (in English) -FUJI SHASHIN FUIRUMU SEI (produced by Fuji Photo Film Co., Ltd. in Japanese)] written in Ming-style character with 6 points was prepared by using Digital Minilabo Printer Processor "Frontier 350", (produced by Fuji Photo Film Co., Ltd.). The samples were exposed with the prepared negative mask interposed between the light source and the sample, followed by developing to make prints. Organoleptic evaluations about the character quality were performed by ten persons. The results of the evaluation revealed that Sample No. 602 of the present invention showed an improvement in the definition around the character outlines compared with Sample No. 601. It is confirmed that samples of the present invention attain a remarkable result in a digital exposure.

Example 8

Similar comparisons in image sharpness evaluations performed in Example 7 were carried out for the following cases; a color negative film system as described in Example 1 of JP-A No. 11-305369, a color reversal film system as described in JP-A No. 7-92601, and Example 1 of JP-A No. 11-160828, an instant film system as described in Example 1 of JP-A No. 2000-284442, a graphic arts film system as described in Example 1 of JP-A No. 8-292512, and an X-ray film system as described in Example 1 of JP-A No. 8-122954. As a result, similar effects to those in Example 7 were observed.

What is claimed is:

1. A photothermographic material having, on at least one side of a support, an image forming layer comprising at least a photosensitive silver halide, a non-photosensitive organic silver salt, and a reducing agent for the organic silver salt and at least one non-photosensitive layer, wherein the photothermographic material contains a phthalocyanine compound represented by the following formula (PC-1):

Formula (PC-1)

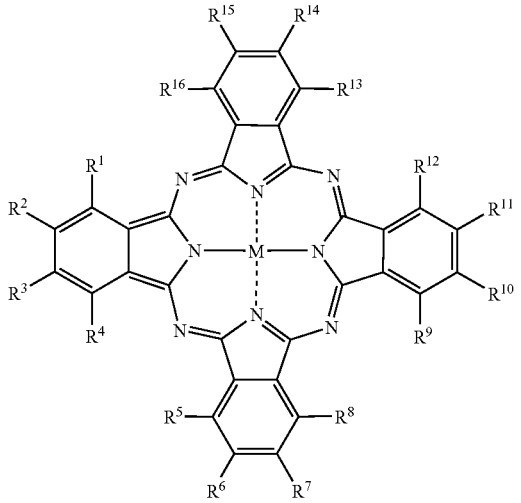

wherein in formula (PC-1), M represents a hydrogen atom or a metal atom; $R^1$, $R^4$, $R^5$, $R^8$, $R^9$, $R^{12}$, $R^{13}$, and $R^{16}$ each independently represent a hydrogen atom or a substituent; at least one of $R^1$, $R^4$, $R^5$, $R^8$, $R^9$, $R^{12}$, $R^{13}$, and $R^{16}$ represents an electron-attracting group; and $R^2$, $R^3$, $R^6$, $R^7$, $R^{10}$, $R^{11}$, $R^{14}$, and $R^{15}$ each independently represent a hydrogen atom or a substituent.

2. The photothermographic material according to claim 1, wherein at least one of $R^1$, $R^4$, $R^5$, $R^8$, $R^9$, $R^{12}$, $R^{13}$, and $R^{16}$ of the phthalocyanine compound represented by formula (PC-1) is a group represented by the following formula (II):

$$-L^1-R^{17} \qquad \text{Formula (II)}$$

wherein, $L_1$ represents a divalent group selected from **—$SO_2$—*, **—$SO_3$—*, **—$SO_2NR_N$—*, **—SO—*, **—CO—*, **—$CONR_N$—*, **—COO—*, **—COCO—*, **—$COCO_2$—*, and **—$COCONR_N$—*; ** denotes a bond with a phthalocyanine skeleton at this position; * denotes a bond with $R^{17}$ at this position; $R_N$ represents one selected from a hydrogen atom, an alkyl group, an aryl group, a heterocyclic group, an acyl group, an alkoxycarbonyl group, a carbamoyl group, a sulfonyl group, and a sulfamoyl group; and $R^{17}$ represents one selected from a hydrogen atom, an alkyl group, an aryl group, and a heterocyclic group.

3. The photothermographic material according to claim 2, wherein 4 or more of $R^1$, $R^4$, $R^5$, $R^8$, $R^9$, $R^{12}$, $R^{13}$, and $R^{16}$ of the phthalocyanine compound represented by formula (PC-1) are a group represented by formula (II).

4. The photothermographic material according to claim 1, wherein the phthalocyanine compound represented by formula (PC-1) is soluble in water.

5. The photothermographic material according to claim 1, wherein the phthalocyanine compound has an absorption maximum within a range of 620 nm to 700 nm.

6. The photothermographic material according to claim 1, wherein the phthalocyanine compound is contained in the image forming layer.

7. The photothermographic material according to claim 1, wherein the phthalocyanine compound is contained in a non-photosensitive layer.

8. The photothermographic material according to claim 7, wherein the non-photosensitive layer is a back layer.

9. The photothermographic material according to claim 7, wherein the non-photosensitive layer is provided between the support and the image forming layer.

10. The photothermographic material according to claim 7, wherein the non-photosensitive layer is provided on the image forming layer at an upper layer with respect to the support.

11. The photothermographic material according to claim 10, wherein the photothermographic material has an outermost layer on the image forming layer at an upper layer with respect to the support, and the non-photosensitive layer is provided between the outermost layer and the image forming layer.

12. The photothermographic material according to claim 1, further comprising a magenta dye.

13. The photothermographic material according to claim 12, wherein the magenta dye is contained in the same layer with the phthalocyanine compound.

14. The photothermographic material according to claim 2, wherein $R^2$, $R^3$, $R^6$, $R^7$, $R^{10}$, $R^{11}$, $R^{12}$, and $R^{15}$ represent a hydrogen atom, and at least one of $R^1$, $R^4$, $R^5$, $R^8$, $R^9$, $R^{12}$, $R^{13}$, and $R^{16}$ of the phthalocyanine compound represented by formula (PC-1) is a group represented by formula (II).

15. The photothermographic material according to claim 14, wherein 4 or more of $R^1$, $R^4$, $R^5$, $R^8$, $R^9$, $R^{12}$, $R^{13}$, and $R^{16}$ of the phthalocyanine compound represented by formula (PC-1) are a group represented by formula (II).

16. The photothermographic material according to claim 14, wherein $R^1$, $R^4$, $R^5$, $R^8$, $R^9$, $R^{12}$, $R^{13}$, and $R^{16}$ of the phthalocyanine compound represented by formula (PC-1) are a group represented by formula (U).

17. The photothermographic material according to claim 14, wherein the phthalocyanine compound represented by formula (PC-1) is soluble in water.

18. The photothemiographic material according to claim 14, wherein the phthalocyanine compound has an absorption maximum within a range of 620 nm to 700 nm.

* * * * *